US007637855B2

(12) United States Patent
Bizzell et al.

(10) Patent No.: US 7,637,855 B2
(45) Date of Patent: Dec. 29, 2009

(54) UNSTEADY EXERCISE PLATFORM HAVING RESISTANCE BANDS

(75) Inventors: Daniel Lee Bizzell, Davidson, NC (US); Christopher Hoy, Charlotte, NC (US); Jerry Shew, Charlotte, NC (US); Amy Fessler Cotta, Franklin, TN (US); James Cotta, Franklin, TN (US); Ryan S. Gorman, Charlotte, NC (US); Todd S. Stancombe, Charlotte, NC (US); Andrew Donati, Charlotte, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 12/126,924

(22) Filed: May 25, 2008

(65) Prior Publication Data

US 2008/0318743 A1 Dec. 25, 2008

Related U.S. Application Data

(63) Continuation-in-part of application No. 11/936,066, filed on Nov. 6, 2007.

(60) Provisional application No. 60/975,261, filed on Sep. 26, 2007, provisional application No. 61/024,963, filed on Jan. 31, 2008, provisional application No. 60/864,437, filed on Nov. 6, 2006.

(51) Int. Cl.
*A63B 26/00* (2006.01)

(52) U.S. Cl. ..... 482/142

(58) Field of Classification Search ..... 482/34, 482/146–147, 79–80, 139, 142, 148, 121–130, 482/91, 907

See application file for complete search history.

(56) References Cited

U.S. PATENT DOCUMENTS

| | | | | | |
|---|---|---|---|---|---|
| 3,893,667 | A * | 7/1975 | Snyder et al. | 482/114 |
| 4,183,521 | A * | 1/1980 | Kroeker | 482/146 |
| 4,629,181 | A * | 12/1986 | Krive | 482/71 |
| 5,261,864 | A * | 11/1993 | Fitzpatrick | 482/52 |
| 5,472,390 | A * | 12/1995 | Faye | 482/52 |
| 5,536,072 | A * | 7/1996 | Chang | 297/423.45 |
| 5,562,575 | A * | 10/1996 | Gvoich | 482/52 |
| 6,461,285 | B1 * | 10/2002 | Theunissen et al. | 482/146 |
| 6,558,301 | B1 * | 5/2003 | Jackson | 482/129 |
| 6,767,313 | B2 * | 7/2004 | Sayce | 482/71 |
| 2006/0128540 | A1 * | 6/2006 | Engle | 482/123 |
| 2007/0232468 | A1 * | 10/2007 | Levy et al. | 482/121 |

* cited by examiner

*Primary Examiner*—Lori Baker
(74) *Attorney, Agent, or Firm*—Chad D. Tillman; James D. Wright; Tillman Wright, PLLC

(57) ABSTRACT

An exercise apparatus includes a platform for use in exercises in an unstable configuration. The platform includes a stepping deck for receiving a user; an arched base for rocking support of the stepping deck on a workout surface; and a resistance band assembly housed within the platform, with the resistance band assembly including a plurality of resistance bands. The exercise apparatus may include a frame that is adapted to removably receive and support the platform above a workout surface in a stable configuration for use in exercises. In another exercise apparatus, the platform is secured to the frame such that, in a first orientation, the platform is stable; and in a second, inverted orientation, the platform is unstable. The platform is plank-shaped, and the stepping deck includes two stepping surfaces, each surface being located on an opposite side of the stepping deck.

23 Claims, 74 Drawing Sheets

10

114

UNSTEADY EXERCISE PLATFORM HAVING RESISTANCE BANDS

CROSS-REFERENCE TO RELATED APPLICATION

For purposes of the United States, the present application is a U.S. nonprovisional patent application of and claims priority under 35 U.S.C. §119(e) to both U.S. provisional patent application No. 60/975,261, filed Sep. 26, 2007; and U.S. provisional patent application No. 61/024,963, filed Jan. 31, 2008. Furthermore, for purposes of the United States, the present application is a U.S. continuation-in-part patent application of and claims priority under 35 U.S.C. §120 to U.S. nonprovisional patent application Ser. No. 11/936,066, filed Nov. 6, 2007, which '066 application published as U.S. patent application publication no. 2008/0108487 A1, and which '066 application is a nonprovisional of and claims priority to U.S. provisional patent application No. 60/864,437, filed on Nov. 6, 2006. Each of these above mentioned patent applications and the above mentioned patent application publication is hereby incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to exercise systems, apparatus, and methods and, in particular, to exercise systems, apparatus, and methods that include an unsteady platform having a resistance band system.

Exercise devices are known that are intended to provide balance and strength training for a person's core muscles, i.e., the muscles of the abdomen and back that are often associated with providing balance, stability, and a straight posture. Such devices often include an unsteady platform member upon which a person is to stand and attempt to keep his or her balance. The platform may tend to rotate, tilt, twist, or move in some combination of these motions so as to create an unsteady platform surface for the user. By regaining his or her balance, a user is able to exercise core muscles in the abdomen and back. Examples of patents disclosing a balancing device for core strengthening include U.S. Pat. No. 4,183,521 and U.S. Pat. No. 7,008,359.

In addition, exercise devices are known that provide a step device upon which a person may step on and step off in order to perform cardiovascular exercises. Such step devices may be used for various other strength training exercises. These step devices may include the ability to adjust the height of the step or may include a step surface that includes a cushion or some other resilient surface upon which a user will step. Examples of patents disclosing exercise devices providing a step device include U.S. Pat. No. 5,683,331 and U.S. Pat. No. 5,562,575. U.S. Patent Application Publication No. 2006/0040796, which is incorporated herein by reference, also discloses an exercise device providing a step and, moreover, providing a degree of unsteadiness during use.

Still other known exercise devices provide a platform surface with one or more resistive elements that permit the user to exercise an even wider array of muscle groups. Known resistive elements that may be used in connection with exercise devices include coiled springs and elastic bands. A user may grasp and pull a terminal end of the resistive element in order to strengthen various muscle groups, such as arm muscles, leg muscles, shoulder muscles, or back muscles. Depending on the position of the user's body (i.e., standing, sitting, or lying down) and how the user grasps and pulls the resistive element (i.e., pulling with a hand or foot), the user may target a specific muscle group for strengthening. Examples of patents disclosing exercise devices providing one or more resistive elements include U.S. Pat. No. 3,893,667 and U.S. Pat. No. 6,558,301.

While these devices perform their intended functions, a need exists for a more versatile exercise device that enables a person to have a complete workout experience with a single device, i.e., a single device that may be used for stretching, core strength training, balance training, cardiovascular exercise, and general strength training.

SUMMARY OF THE INVENTION

The present invention includes many aspects and features.

In an aspect of the invention, an exercise apparatus includes an unstable platform having a stepping deck for receiving a user. The stepping deck is configured to be supported on a workout surface such that the stepping deck rocks back and forth between opposite ends thereof on the workout surface. The exercise apparatus further includes a resistance band extending from each of the opposite ends of the unstable stepping deck.

In features of this aspect: a user interface is attached to an end of each of the resistance bands, wherein the user interface includes a handle with a carabineer attaching the handle to the resistance band, or a strap with a carabineer attaching the strap to the resistance band; the stepping deck includes resilient characteristics such that the impact experienced by a user in stepping onto the platform is lessened; and the exercise apparatus further includes non-slip material located on a bottom surface of the exercise apparatus for abutment with the workout surface.

In another feature of this aspect, the resistance bands are part of a resistance band system that includes a plurality of resistance bands each of which is at least partially located within an interior of the platform.

In accordance with this feature, the resistance band assembly includes a plurality of pulleys located within the platform, each of the resistance bands extending around at least one of the plurality of pulleys; the platform includes a plurality of openings at each opposite end thereof, and wherein a respective end of one of the plurality of resistance bands extends through a respective one of the plurality of openings; each resistance band has an end thereof anchored within the platform at one of the opposite ends of the platform; and the plurality of resistance bands have varying resistance levels.

Furthermore, a plurality of rollers are located at the openings for engaging the resistance bands; the plurality of rollers including a first set of rollers disposed on a first common shaft and a second set of rollers disposed on a second common shaft; and the anchored end and the exposed end of each respective resistance band are both located at the same end of the platform; and the platform includes indicia indicating the resistance levels of the resistance bands.

Additionally, the plurality of rollers may include at least one horizontal roller located at each opening for engaging a respective one of the resistance bands; may include of two vertical rollers located at each opening for engaging a respective one of the resistance bands; or may include at least one horizontal roller and two vertical rollers located at each opening for engaging a respective one of the resistance bands.

In another aspect of the invention, an exercise apparatus includes an unstable platform for use in exercises. The platform has a stepping deck for receiving a user and an arched base for rocking support of the stepping deck on a workout surface. Furthermore, the exercise apparatus includes a resistance band extending from each of the opposite ends of the unstable platform.

In yet another feature of the invention, an exercise apparatus includes an unstable platform for use in exercises. The unstable platform has a stepping deck for receiving a user and an arched base for rocking support of the stepping deck on a workout surface. The unstable platform further includes a resistance band assembly housed within the platform and a resistance band extending from each of the opposite ends of the unstable platform. The exercise apparatus further may include non-slip material located on a bottom surface of the arched base.

In another aspect of the invention, an exercise apparatus includes a platform for use in exercises in an unstable configuration. The platform includes a stepping deck for receiving a user; an arched base for rocking support of the stepping deck on a workout surface; and a resistance band assembly housed within the platform, with the resistance band assembly including a plurality of resistance bands. The exercise apparatus further includes a frame that is adapted to removably receive and support the platform above a workout surface in a stable configuration for use in exercises.

In a feature of this aspect, the frame includes a pair of side rails, a pair of connection bars that extend between and connect ends of the side rails, and a pair of support cross bars that extend between and connect the side rails. The platform may include groove within which the connection bars are received in a snap-fit frictional fit. Furthermore, the connection bars may include handle grips.

In another feature of this aspect, the platform is further configured to receive the frame in an inverted orientation such that the arched base supports both the stepping deck and the frame on the workout surface. In this respect, the platform may include a pair of grooves on opposite sides thereof that are configured to receive the connection bars of the frame in a snap-fit frictional fit.

In another feature, at least a portion of the frame is encased in a non-slip covering for gripping contact.

In another aspect of the invention, an exercise apparatus includes a platform including a stepping deck and a resistance band assembly housed within the platform, with the resistance band assembly including a plurality of resistance bands. The exercise apparatus further includes a frame supporting the platform above a workout surface. The frame includes a pair of arcuate rails disposed in generally parallel relation to one another. The platform is secured to the frame such that, in a first configuration, the exercise apparatus is configured for use in an exercise in which the platform is supported above a workout surface by the arcuate rails so as to provide an unstable platform; and in a second configuration, the exercise apparatus is configured for use in an exercise in which the platform is supported above a workout surface by the frame so as to provide a stable platform.

In a feature of this aspect, the exercise apparatus transitions from the first configuration to the second configuration, and vice-versa, simply by being inverted (i.e., turned upside down). In this feature, the stepping deck may include two stepping surfaces, each surface located on an opposite side of the stepping deck.

In another feature of this aspect, the platform is generally plank-shaped, i.e., the platform comprises an elongate, rectangular member.

In another aspect of the invention, an exercise apparatus includes a resilient platform including a first panel and a second panel detachably interconnected to one another such that when the first and second panel are interconnected, an interior space is created between the first and second panel. A resistance band assembly includes a plurality of resistance bands partially disposed within the interior space of the platform and having ends that are disposed exterior to the platform for accessing by a user. The support frame includes a pair of arcuate rails disposed in fixed parallel relation to one another, with a vertical plane of said arcuate rails being disposed generally orthogonally to a surface on which the exercise apparatus is placed. The support frame further includes a pair of connection bars disposed in fixed parallel relation to one another and fixedly connecting ends of the pair of arcuate rails to one another to form the support frame. The platform is supported by the arcuate rails in an orientation that is generally orthogonal to the vertical plane of the arcuate rails and generally parallel to the surface on which the exercise apparatus is placed.

In another aspect of the invention, an exercise apparatus includes a platform including a pair of generally planar panels disposed in fixed parallel relation to one another; and a support frame that includes a pair of arcuate rails disposed in fixed parallel relation to one another, with each rail having opposite ends and an apex intermediate its opposite ends, and a pair of connection bars oriented generally orthogonally to planes of the arcuate rails, connecting ends of the arcuate rails to one another to form the support frame. The support frame supports the platform in a position that is intermediate the apexes of the arcuate rails and the connection bars and in an orientation that is parallel to a surface on which the exercise apparatus is placed. The exercise apparatus furthermore is configured for use at least two configurations, including: a stationary configuration wherein the connection bars of the frame rest on the surface on which the exercise apparatus is placed such that the exercise apparatus does not move relative to the surface when a user is positioned on the platform; and a rocking configuration wherein the arcuate rails of the frame rest on the surface such that the apparatus may rock from side to side when a user is positioned on the platform.

In still yet another inventive aspect, an exercise apparatus includes a frame and a resilient platform. The frame includes a pair of side rails disposed a fixed distance from one another, each rail having opposite ends, and a pair of connection bars disposed a fixed distance from one another, oriented generally orthogonally in relation to planes of the pair of side rails, and fixedly attached to the ends of the side rails to form the frame. The resilient platform is detachably connected to and supported by the frame, the platform including an arched panel and a flat panel detachably interconnected to one another such that when the arched panel and the flat panel are interconnected, an interior space is created therebetween. The exercise apparatus further includes a resistance band assembly including a plurality of resistance bands partially disposed within the interior space of the platform and having ends thereof that are disposed exterior to the platform for accessing by a user.

In another aspect of the invention, an exercise apparatus includes a frame having a pair of side rails connected to a pair of connection bars to form the frame; and a platform supported by the frame, the platform having an arched panel and a flat panel interconnected to one another. The frame may be separated from the platform, flipped upside down relative to its original orientation, and placed on the platform such that with the platform in a single orientation, the frame may be oriented in one of two ways: with the connection bars of the frame abutting and resting on a surface on which the exercise apparatus is placed such that the exercise apparatus does not move relative to the surface when a user is positioned on the platform; and with the side rails and connection bars projecting away from the surface such that the arched panel rests on the surface thereby enabling the exercise apparatus to rock from side to side when a user is positioned on the platform.

Another aspect of the invention includes an exercise platform having an arched panel and a flat panel detachably interconnected to one another such that when the arched panel and the flat panel are interconnected an interior space is created therebetween, the interior space being dimensioned such that a resistance band assembly may be partially disposed therein.

Other aspects of the invention relate to performing exercises using any of the foregoing exercise apparatus.

In this regard, another aspect of the present invention relates to methods of using an exercise device having an unstable platform having a stepping deck for receiving a user and an arched base for rocking support of the stepping deck on a workout surface, the platform further including a resistance band assembly housed within the platform and a resistance band extending from each of the opposite ends of the unstable platform. The methods include the step of exerting force on the exercise device with one or more body parts of a user.

In a feature of this aspect of the invention, a user may stand on the platform of the exercise device and grasp handles corresponding to one or more of the resistance bands with his or her hands extended downwardly at his or her sides. The user may then raise each arm to a generally horizontal position in generally parallel disposition relative to the stepping deck while keeping the elbow of each arm slightly bent. The arms then may be lowered through the same motion in reverse, and the routine repeated.

In a feature of this aspect of the invention, a user may stand on the platform of the exercise device and grasp handles corresponding to one or more of the resistance bands with his or her hands. The user may then position each arm in a generally vertical orientation at his or her respective sides, this position being defined as a starting position. Then, the user may raise a first arm out to the side and slightly forward, while keeping an elbow of the first arm slightly bent, until the first arm is generally vertically oriented. The first arm may then be lowered through the same motion in reverse to return to the starting position.

In a feature of this aspect of the invention, a user may stand on the platform of the exercise device and grasp handles corresponding to one or more of the resistance bands with his or her hands. The user may then position each arm in a generally vertical orientation at his or her respective sides, this position being defined as a starting position. Then, the user may raise a first arm upward and across his or her chest, while keeping an elbow of the first arm slightly bent, until the hand of the first arm is proximate the shoulder of the second arm of the user. The first arm may then be lowered through the same motion in reverse to return to the starting position.

In a feature of this aspect of the invention, a user may stand on the platform of the exercise device and grasp handles corresponding to one or more of the resistance bands with his or her hands. In particular, the user may stand on the platform in such a way that if the user's arms are positioned in generally vertical orientations at his or her respective sides, then one of the plurality of resistance bands will be crossed with another of the plurality of resistance bands. The user may then position his or her arms across his or her torso such that his or her hands are generally at a waist level in front of the user, this position being defined as a starting position. Then, the user may raise a first arm up and across his or her torso, while keeping the elbow of the first arm slightly bent, until the first arm is generally parallel to the stepping deck of the platform. The first arm may then be lowered through the same motion in reverse to return to the starting position.

In a feature of this aspect of the invention, a user may stand on the platform of the exercise device and grasp handles corresponding to one or more of the resistance bands with his or her hands. The user may then position handles of the resistance bands at a height that is level with his or her shoulders, this position being defined as a starting position. Then, the user may press the handles upward generally simultaneously, until the handles are above the user's head. The handles may then be lowered downward through the same motion in reverse to return to the starting position. Additionally, a user may stand on the platform of the exercise device and grasp handles corresponding to one or more of the resistance bands with his or her hands. The user may then position handles of the resistance bands in front of his or her hips with his or her palms facing backward, this position being defined as a starting position. Then, the user may pull the handles upward, generally simultaneously, by bending his or her elbows, while keeping his or her hands close to his or her torso. This action may be continued until the handles are proximate the user's chin. The handles may then be lowered downward through the same motion in reverse to return to the starting position.

In a feature of this aspect of the invention, a user may lie on the platform of the exercise device such that a portion of his or her upper back rests on the platform. The user may grasp handles corresponding to one or more of the resistance bands with his or her hands. The user may then position the handles at a level that is equal to the user's chest proximate the arm pits of the user, this position being defined as a starting position. Then, the user may press the handles upward, generally simultaneously, until his or her arms are oriented generally vertically. The handles are then lowered downward through the same motion in reverse to return to the starting position.

In a feature of this aspect of the invention, a user may lie on the platform of the exercise device such that a portion of his or her upper back rests on the platform. The user may grasp handles corresponding to one or more of the resistance bands with his or her hands. The user may then position the handles above his or her chest with elbows straight, this position being defined as a starting position. Then, the user may lower the handles downward and outward through an arc, generally simultaneously, until his or her arms are oriented generally parallel to the stepping deck of the platform. The handles may then be raised upward and inward through the same motion in reverse to return to the starting position.

In a feature of this aspect of the invention, a user may sit on the platform of the exercise device such that a portion of the user's rear rests on the platform. The user may grasp handles corresponding to one or more of the resistance bands. The user may then position the handles at a level that is equal to the user's chest proximate his or her shoulders, this position being defined as a starting position. Then, the user may press the handles upward generally simultaneously, until his or her elbows are generally straight. The handles may then be lowered downward through the same motion in reverse to return to the starting position.

In a feature of this aspect of the invention, a user may sit on the floor or ground with his or her knees generally straight and his or her feet pressed against the platform of the exercise device. The user may grasp handles corresponding to one or more of the resistance bands. The user may position the handles proximate his or her ankles, this position being defined as a starting position. Then, the user may pull the handles toward his or her torso, generally simultaneously, until his or her elbows are bent at a generally 90° angle and his or her shoulder blades are contracted. The handles may then be returned through the same motion in reverse to return to the starting position.

In a feature of this aspect of the invention, a user may stand on the platform of the exercise device and grasp handles corresponding to one or more of the resistance bands with his or her hands. The user may bend forward at his or her hips while preventing his or her back from rounding. The user may bend forward until his or her torso is generally parallel to the stepping deck of the platform. The user may then position the handles proximate the user's knees, this position being defined as a starting position. Then, the user pulls the handles toward his or her torso, generally simultaneously, until his or her elbows are bent at a generally 90° angle and his or her shoulder blades are contracted. The handles may then be returned through the same motion in reverse to return to the starting position.

In a feature of this aspect of the invention, a user may stand on the platform of the exercise device such that the distance between the user's feet is generally equal to the distance between the user's shoulders. The user may grasp handles corresponding to one or more of the resistance bands. The user may bend his or her knees slightly. The user may then position his or her arms each in a generally vertical orientation with elbows at a generally 90° angle and palms facing upward, this position being defined as a starting position. Then, the user may pull up by bending at the elbows and curling the handles until the handles are proximate the user's shoulders. The handles may then be lowered through the same motion in reverse to return to the starting position. Additionally, a user may stand on the platform of the exercise device such that the distance between the user's feet is generally equal to the distance between the user's shoulders. The user may grasp handles corresponding to one or more of the resistance bands. The user may then position his or her arms each in a generally vertical orientation with elbows bent at a generally 90° angle and with palms facing inward, this position being defined as a starting position. Then, the user may pull up by bending at the elbows and curling the handles until the handles are proximate the user's shoulders. The handles may then be lowered through the same motion in reverse to return to the starting position.

In a feature of this aspect of the invention, a user may stand on the platform of the exercise device and grasp handles corresponding to one or more of the resistance bands with his or her hands. The user may bend forward at his or her hips while keeping his or her back from rounding. The user may bend forward until his or her torso is generally parallel to the stepping deck of the platform. The user may then position the handles proximate his or her ankles, this position being defined as a starting position. Then, the user may straighten at the hips while keeping his or her back straight. The user may then undergo the same motion in reverse to return to the starting position.

In a feature of this aspect of the invention, a user may stand on the platform of the exercise device and grasp handles corresponding to one or more of the resistance bands with his or her hands. The user may stand with knees slightly bent with the handles at a height that is level with the user's shoulders, this position being defined as a starting position. Then, the user may bend his or her knees until the knees are bent at a generally 90° angle. The user may then straighten his or her knees through the same motion in reverse to return to the starting position. Additionally, a user may stand on the platform of the exercise device and grasp handles corresponding to one or more of the resistance bands with his or her hands. The user may stand with knees slightly bent with the handles at a height that is level with a portion of the user's torso, this position being defined as a starting position. Then, the user may bend his or her knees until the knees are bent at a generally 90° angle. The user may then straighten his or her knees through the same motion in reverse to return to the starting position.

In a feature of this aspect of the invention, a user may position the foot of a first leg on the platform of the exercise device with the knee slightly bent. The user may position his or her other foot in front of his or her body such that the other foot is not supported by the platform. The user may grasp handles corresponding to one or more of the resistance bands. The user may position the handles at a height that is level with the user's shoulders, this position being defined as a starting position. Then, the user may bend the knee of the first leg until the knee is bent at a generally 90° angle. The user may then straighten the knee of the first leg through the same motion in reverse to return to the starting position.

In a feature of this aspect of the invention, a user may position the foot of a first leg on the platform of the exercise device with the knee slightly bent. The user may position his or her other foot behind his or her body such that the other foot is not supported by the platform. The user may grasp handles corresponding to one or more of the resistance bands. The user may position the handles at a height that is level with the user's shoulders, this position being defined as a starting position. Then, the user may bend the knee of the first leg until the knee is bent at a generally 90° angle. The user may then straighten the knee of the first leg through the same motion in reverse to return to the starting position.

In a feature of this aspect of the invention, a user may stand on the platform of the exercise device and grasp handles corresponding to one or more of the resistance bands with his or her hands. The user may bend forward at the hips while keeping his or her back from rounding until his or her torso is generally parallel to the stepping deck of the platform. Then, the user may position the handles proximate his or her ankles, this position being defined as a starting position. The user may then straighten at the hips while keeping his or her back straight. Then, the user may pull the handles upward, generally simultaneously, by bending his or her elbows while keeping his or her hands close to the torso. This action may be performed until the handles are proximate the user's chin. The user may then undergo the same motion in reverse to return to the starting position.'

In a feature of this aspect of the invention, a user may position the foot of a first leg on the platform of the exercise device. The user may position the second leg in the air with the knee slightly bent at a generally 90° angle. The user may grasp handles corresponding to one or more of the resistance bands. The user may position his or her arms each in a generally vertical orientation with elbows bent at a generally 90° angle and with palms facing upward, this position being defined as a starting position. Then, the user may pull up by bending at the elbows and curling the handles until the handles are proximate the user's shoulders. The handles may then be lowered through the same motion in reverse. Additionally, the user may lower the second leg and remove his or her foot of the first leg from the platform so that both feet are supported by the floor or ground.

In a feature of this aspect of the invention, a user may stand on the platform of the exercise device and grasp a handle corresponding to one or more of the resistance bands with a hand. The user may then position a first arm in a vertical orientation such that a portion of the forearm is above the user's head with a palm of the hand facing forward, this position being defined as a starting position. Then, the user lowers the forearm of the first arm behind the user by bending the first arm at the elbow while keeping his or her shoulders and an upper portion of the first arm above the elbow in generally fixed positions. The user may then raise the forearm of the first arm so as to return to the starting position while keeping his or her shoulders and the upper portion of the first arm in generally fixed positions.

In a feature of this aspect of the invention, a user may position the foot of one leg on the platform of the exercise device with the knee bent. The user may grasp a handle corresponding to one or more of the resistance bands with a hand. The user may then position the hand grasping the handle proximate his or her chest with the palm of the hand facing downward, this position being defined as a starting position. Then, the user may press the hand grasping the handle up and away from his or her chest. The hand grasping the handle may then be returned through the same motion in reverse to the starting position.

In a feature of this aspect of the invention, a user may position the foot of one leg on the platform of the exercise device with the knee bent. The user may grasp a handle corresponding to one or more of the resistance bands with a hand. The user may then bend forward at his or her hips. The user may position an elbow of the arm that retains the handle behind his or her body such that the elbow is generally at an equal height with the user's shoulders and such that the elbow is bent with the palm of the hand facing inward, this position being defined as a starting position. Then, the user may straighten the elbow of the arm that retains the handle. The elbow may then be returned through the same motion in reverse to return to the starting position.

In a feature of this aspect of the invention, a user may position the foot of one leg on the platform of the exercise device with the knee bent. The user may grasp a handle corresponding to one or more of the resistance bands with a hand. The user may then bend forward at his or her hips. The user may position the hand grasping the handle generally proximate to or below the knee of the user with a palm of the hand facing inward, this position being defined as a starting position. Then, the user may pull the hand grasping the handle up and slightly back until the elbow of the first arm is at an equal height with the user's shoulder. The hand grasping the handle may then be returned through the same motion in reverse to the starting position.

In a feature of this aspect of the invention, a user may position the foot of one leg on the platform of the exercise device with the knee of the leg bent. The user may grasp a handle corresponding to one or more of the resistance bands with the hand of a first arm. The user may then bend forward at his or her hips. Then, the user may place the second arm on an upper portion above the knee of the leg supported on the platform. The user may then position the hand of the first arm generally proximate to or below the knee supported on the platform with a palm of the hand facing inward, this position being defined as a starting position. Then, the user may pull the hand of the first arm up and slightly back until the elbow of the first arm is at an equal height with the user's shoulder. The hand of the first arm may then be returned through the same motion in reverse to the starting position.

In a feature of this aspect of the invention, a user may stand on the platform of the exercise device and grasp a handle corresponding to one or more of the resistance bands with a hand. The user may position a first arm in a generally vertical orientation with the elbow either straight, or else bent at an angle greater than about 90°, with the palm of the hand grasping the handle facing inward, this position being defined as a starting position. Then, the user may pull the hand grasping the handle up by bending the first arm at the elbow of the first arm, thereby curling the hand to a height equal with the user's shoulder. This action may be performed while keeping the elbow slightly in front of the user and close to the user's abdomen and while squeezing the user's shoulder blades together. The hand grasping the handle may then be returned through the same motion in reverse to the starting position.

In a feature of this aspect of the invention, a user may position the foot of one leg on the platform of the exercise device with the knee bent. The user may grasp a handle corresponding to one or more of the resistance bands with the hand of a first arm. The user may then bend forward at his or her hips. The user may then place a second arm on an upper portion above the knee of the leg supported on the platform. Then, the user may position the elbow of the first arm behind his or her body such that the elbow is generally at an equal height with the user's shoulder. In this regard, the elbow may be bent with a palm of the hand facing inward. This position may be defined as a starting position. The user may then straighten the elbow of the first arm. The elbow of the first arm may then be returned through the same motion in reverse to return to the starting position.

In a feature of this aspect of the invention, a user may stand on the platform of the exercise device such that the distance between the user's feet is generally equal to the distance between the user's shoulders. The user may grasp a handle corresponding to one or more of the resistance bands with a hand. The user may bend toward the side of the body that retains the handle. This bending action may be performed while keeping the knees straight and the elbow of the arm that retains the handle straight. The user may then return through an unbending motion to a standing position.

In a feature of this aspect of the invention, the user may stand behind the platform of the exercise device and to one side of the platform where a first leg is closer to the platform than a second leg. At that particular side, the user may grasp a handle corresponding to one or more of the resistance bands with a hand. The user may then raise the second leg and cross the raised second leg over the first leg. Then, the user may place the foot of the second leg on the platform and bend the knee of the second leg to a generally 90° angle. The user may then push off from the platform by straightening the knee of the second leg.

In a feature of this aspect of the invention, the user may lie on the platform of the exercise device with the user's feet in contact with the ground. The user may grasp a handle corresponding to one or more of the resistance bands with both hands. The user may then position the handle behind the user's head. Then, the user may curl his or her torso upward, thereby lifting his or her shoulder blades off of the platform. The user may then lower his or her torso downward through the same motion in reverse.

In a feature of this aspect of the invention, the user may sit on the platform of the exercise device and grasp a handle corresponding to one or more of the resistance bands with both hands. The user may position the handle proximate the user's midsection, this position being defined as a starting position. Then, the user may twist his or her torso away from a side of the platform associated with the one or more resistance bands in use while keeping his or her elbows slightly bent. The user may then return through the same motion in reverse to the starting position.

In a feature of this aspect of the invention, the user may stand on the platform of the exercise device and grasp a handle corresponding to one or more of the resistance bands with both hands. The user may stand on the platform such that the distance between the user's feet is generally equal to the distance between the user's shoulders. The user may then bend his or her knees slightly and bend forward slightly at his or her hips. Then, the user may extend his or her arms down toward his or her feet. The user may then raise his or her arms upward and across the torso until the handle is above the user's shoulders. The user's arms may then be lowered downward through the same motion in reverse.

In a feature of this aspect of the invention, the user may stand on the platform of the exercise device and secure a strap corresponding to one or more of the resistance bands to the foot of a working leg. The user may then extend the working leg forward while keeping the knee generally straight. Additionally, the user may stand on the platform of the exercise device and secure a strap corresponding to one or more of the resistance bands to the foot of a working leg. The user may then extend the working leg backward while keeping the knee generally straight.

In a feature of this aspect of the invention, the user may stand on the platform of the exercise device and secure a strap corresponding to one or more of the resistance bands to the foot of a working leg. The user may then raise the working leg outward while keeping the knee slightly bent. Additionally, the action may be reversed, where the strap is secured to the opposite leg of the user.

In a feature of this aspect of the invention, the user may stand on the platform of the exercise device and secure a strap corresponding to one or more of the resistance bands to the foot of a working leg. The user may then pull the working leg inward across a non-working leg while keeping the knee of the working leg slightly bent.

In a feature of this aspect of the invention, the user may stand on the platform of the exercise device and secure a strap corresponding to one or more of the resistance bands to the foot of a working leg. The user may raise the working leg upward until his or her thigh is generally parallel with the stepping deck of the platform and his or her knee is bent at a generally 90° angle. The user may then extend the foot of the working leg forward by straightening the knee without moving the thigh of the working leg.

In a feature of this aspect of the invention, the user may stand on the platform of the exercise device and secure a strap corresponding to one or more of the resistance bands to the foot of a working leg. The user may bend the working leg behind the user's body at the knee while keeping the knee in line with the user's hip.

In a feature of this aspect of the invention, the user may position the user's hands and knees on the platform of the exercise device and secure a strap corresponding to one or more of the resistance bands to the foot of a working leg. The user may then extend the working leg back and up in one motion while simultaneously straightening the knee of the working leg.

As will be understood, the exercise device may also be used to exert muscles through exercises such as lunging, stepping, jumping, and hopping. In a feature of this aspect of the invention, a user may perform a forward lunge exercise with a single leg. In a feature of this aspect of the invention, a user may perform a lateral lunge exercise with a single leg. In a feature of this aspect of the invention, a user may perform a reverse lunge exercise. The user may begin in a standing position with both feet on the platform. The user may step back with one foot so that the foot is positioned flatly on the floor or ground, while bending the other knee to a generally 90° angle. The user then returns the foot back to the platform and returns to a standing position. In a feature of this aspect of the invention, a user may begin in a standing position with both feet on the platform. The user may step back with one foot so that the user's toes touch the floor or ground, while bending the other knee to a generally 90° angle. The user then returns the foot back to the platform and returns to a standing position. In each lunging exercise, the user may repeat the exercise several times, or in combination with other exercises, as might be required for a particular workout.

In a feature of this aspect of the invention, a user may perform a basis step exercise, by stepping on and off of the platform with one foot at a time. In a feature of this aspect of the invention, a user may perform a step exercise, where the user raises his or her knee while stepping on and off of the platform with one foot at a time. In a feature of this aspect of the invention, a user may perform a step exercise while standing on the platform, where the user alternates between raising each knee while stepping. In exercises where the user raises his or her knee, the knee may be raised such that his or her thigh is generally parallel to the stepping deck of the platform when the knee is bent. In a feature of this aspect of the invention, a user may perform an "over the top" step exercise where the user steps onto and over the platform one foot at a time. In particular, a user may position the first foot on the platform followed by the second foot. Once standing on the platform, the user may then step off of the platform on the opposite side thereof beginning with the first foot followed by the second foot. In each stepping exercise, the user may repeat the exercise several times, or in combination with other exercises, as might be required for a particular workout.

In a feature of this aspect of the invention, a user performs a forward jump exercise onto the platform. In a feature of this aspect of the invention, a user performs a lateral jump exercise onto the platform. In a feature of this aspect of the invention, a user performs a single leg jump exercise, where the user may jump from the floor or ground and land on the platform with a single leg. In a feature of this aspect of the invention, a user may perform an exercise where the user begins with a first foot on the floor or ground and a second foot supported by the platform. The user may then quickly push off from the platform and alternate the position of his or her feet during the jump so that the first foot is supported by the platform and the second foot is on the floor or ground. In a feature of this aspect of the invention, a user may perform an exercise where the user may stand at one side of the exercise device with a first foot on the floor or ground and the second foot supported by the platform. The user may bounce quickly with the foot on the floor or ground before jumping. During the jump, the user may switch the position of his or her feet so that the first foot is supported by the platform and the second foot is on the floor or ground at the other side of the exercise device. In a feature of this aspect of the invention, a user may perform an exercise where the user stands with a first foot on the floor or ground and a second foot supported by the platform. The user may then jump and land with the first foot supported by the platform and the second foot on the floor or ground. In each jumping exercise, the user may repeat the exercise several times, or in combination with other exercises, as might be required for a particular workout.

Advantageously, a broad range of exercises may be performed with either of a stable surface or an unstable surface. The exercises set forth above are described with a user using the exercise device having a stable surface, where the platform is supported by the frame. It should also be appreciated that each of the exercises set forth above may also be performed in connection with an unstable surface.

In this regard, the platform may be separated from the frame and placed on the floor or ground with the arched base in contact with the floor or ground. As such, the user may then use the platform of the exercise device in order to provide an unstable surface that further enhances the versatility of the exercise device. For many of the exercises set forth above, performance by a user in connection with an unstable surface may also enhance the difficulty of the exercise and may increase the range of muscle groups that are engaged with each exercise.

The exercise device may also be used in connection with pushup exercises. To enhance pushup exercises with an unstable surface, the platform may be separated from the exercise device to create such an unstable surface.

In a feature of this aspect of the invention, a user may position his or her elbows on the platform and position his or feet on the floor or ground. The user may then raise his or her hips such that the user's feet, hips, and head are generally in a straight line. Additionally, a user may position his or her elbows on the platform. The user may position one foot on the floor or ground and the other foot in the air. The user may then raise his or her hips such that the user's feet, hips, and head are generally in a straight line.

In a feature of this aspect of the invention, a user may position one elbow on the platform and place a side of one foot on the floor or ground. The user may then raise his or her hips such that the user's foot, hips, and head are generally in a straight line.

In a feature of this aspect of the invention, a user may position a knee, hand, and foot on the platform. The user may then extend the other arm outward in front of his or her body and the other leg outward behind his or her body.

In a feature of this aspect of the invention, a user may position a portion of his or her upper back against the floor or ground. The user may then position one foot on the platform with the knee being bent. Then, the user may position the other foot in the air with the knee being generally straight. The user may then press his or her hips upward.

In a feature of this aspect of the invention, a user may position one hand generally more forward on the platform and position the other hand generally more backward on the platform. The user may then perform a pushup exercise.

In a feature of this aspect of the invention, a user may position both hands on the platform. The user may then perform an oblique pushup exercise, where the user's feet are positioned side by side behind the user's body and against the surface of the floor or ground.

In a feature of this aspect of the invention, a user may position both feet on the platform and position both hands on the surface of the floor or ground. The user may then perform a "T" pushup exercise, where the user raises one arm off of the floor or ground and rotates his or her body until the arm creates a straight line overhead with the user's body.

In a feature of this aspect of the invention, a user may position both feet on the platform and position both hands close together on the surface of the ground. The user may then perform a close-handed pushup exercise, where the user lowers his or her body to the floor or ground while his or her hands are positioned close together.

In a feature of this aspect of the invention, a user may position both feet on the platform and position both hands on the floor or ground such that the digits of each hand form a diamond shape when positioned together. The user may then perform a pushup exercise, where the user lowers his or her body to the floor or ground while his or her hands are positioned to form the diamond shape.

In a feature of this aspect of the invention, a user may position one foot on the platform and the other foot in the air with both hands on the floor or ground. The user may then perform a pushup exercise.

In a feature of this aspect of the invention, a user may position both hands on the platform and place one foot on the floor or ground and the other foot in the air. The user may then perform a pushup exercise.

In each pushup exercise, the user may repeat the exercise several times, or in combination with other exercises, as might be required for a particular workout. Additionally, as can be appreciated, a user may also prefer to have a stable surface for use in connection with any of the pushup exercises set forth above. In this regard, the user may choose to attach the platform to the frame in order to provide such a stable surface. Alternatively, the user may choose to use the frame alone for use in providing a stable surface for pushup exercises and other exercises. For example, a user may perform a pushup exercise using the frame. In particular, in one contemplated pushup exercise, a user may position his or her hands at either end of the frame and position his or her feet on the floor or ground. In accordance with another contemplated pushup exercise, the user may position his or her hands at either end of the frame and position one foot on the floor or ground and the other foot in the air.

The various exercises set forth above may be performed in connection with a stable surface, as provided by the exercise device or the frame, or with an unstable surface, as provided by the platform. Some exercises, discussed in greater detail below, are contemplated as providing a particular advantage to users when performed in connection with an unstable surface.

In a feature of this aspect of the invention, a user may perform a single leg forward lunge using the platform as an unstable surface. A user may stand with both feet on the floor or ground adjacent to the platform. The user may then lunge with one foot forward and place the foot on top of the platform. The user may bend his or her knee to about a 90° angle before pushing off to return to a standing position adjacent the platform.

In a feature of this aspect of the invention, various exercises may be performed that use the platform as an unstable surface. In each exercise, the user stands on the platform and may grasp handles corresponding to one or more of the resistance bands. The user may retain the handles at shoulder height with his or her elbows bent or at the sides of his or her body. In this position, the user may turn the palms of his or her hands to face outward. The user may then bend his or knees to about a 90° angle. As the user returns to a standing position, the user may curl or pull the handles such that each is raised approximately at shoulder height. The user may then repeat the exercise. Additionally, the user may incorporate additional steps to the exercise or replace some of the steps with alternate steps. According to one step, the user may continue to raise the handles such that each handle is extended over the user's head. According to another step, the user may extend the handles outwardly away from his or her body in a lateral direction.

Another aspect of the present invention relates to an exercise apparatus having a frame. The frame has a pair of arcuate rails having a central curved portion, a first end, and a second end, wherein the pair of rails are disposed in fixed parallel relation with one another. The frame further has a first end member interconnecting the first ends of the rails and a second end member interconnecting the second ends of the rails. The exercise apparatus further includes a platform operatively connected to the frame for supporting a person thereon. The apparatus may be oriented in various orientations, including a rocking orientation wherein the curved portions of the pair of rails abut a surface on which the device is placed such that the device may move in a rocking motion relative to the surface, and a stationary orientation wherein the first end member and the second end member abut the surface on which the device is placed such that the device is stationary relative to the surface.

In a feature of this aspect of the invention, the exercise apparatus includes a pair of handles.

In a feature of this aspect of the invention, the apparatus includes a pair of hooks.

In a feature of this aspect of the invention, the apparatus includes two pairs of hooks.

In a feature of this aspect of the invention, each rail of the pair of rails may alternate between a plurality of positions.

In a feature of this aspect of the invention, one of the plurality of positions is a curved position.

In a feature of this aspect of the invention, one of the plurality of positions is a release position.

In a feature of this aspect of the invention, each rail of the pair of rails includes a button.

Another aspect of the present invention relates to an exercise device having a frame. The frame includes a pair of arcuate rails having a central curved portion, a first end, and a second end, wherein the pair of rails are disposed in fixed parallel relation with one another. The frame further includes a first end member interconnecting the first ends of the rails, and a second end member interconnecting the second ends of the rails. The exercise device further includes a platform having a first end, a second end, and a generally planar central portion, wherein the first end of the platform is connected to the frame near the first end of the frame and the second end of the platform is connected to the frame near the second end of the frame. The device may be oriented in various orientations, including a rocking orientation wherein the curved portions of the pair of rails abut a surface on which the device is placed such that the device may move in a rocking motion relative to the surface, and a stationary orientation wherein the first end member and the second end member abut the surface on which the device is placed such that the device is stationary relative to the surface.

In a feature of this aspect of the invention, the device includes a pair of handles.

In a feature of this aspect of the invention, the device includes a pair of hooks.

In a feature of this aspect of the invention, the device includes two pairs of hooks.

In a feature of this aspect of the invention, each rail of the pair of rails may alternate between a plurality of positions.

In a feature of this aspect of the invention, one of the plurality of positions is a curved position.

In a feature of this aspect of the invention, one of the plurality of positions is a release position.

In a feature of this aspect of the invention, each rail of the pair of rails includes a button. Another aspect of the present invention relates to an exercise device. The exercise device includes a pair of arcuate rails having a central curved portion, a first end, and a second end, wherein the pair of rails are disposed in fixed parallel relation with one another. The exercise device further includes a first end member interconnecting the first ends of the rails and a second end member interconnecting the second ends of the rails. The central curved portions are operative in one of a plurality of positions, including a curved position, wherein the curved portions of the rails follow the arcuate curvature of the pair of rails, and a release position, wherein the curved portions of the rails are shifted directionally away from the arcuate curvature of the pair of rails such that they form curved dips in each rail of the pair of rails, respectively.

In a feature of this aspect of the invention, the device further includes a button on each rail of the pair of rails.

In a feature of this aspect of the invention, the buttons are used to move the central curved portions of the rails between the plurality of positions.

In addition to the aforementioned aspects and features of the present invention, it should be noted that the present invention further encompasses the various possible combinations of such aspects and features.

BRIEF DESCRIPTION OF THE DRAWINGS

One or more preferred embodiments of the present invention now will be described in detail with reference to the accompanying drawings, wherein the similar elements are referred to with the same or similar reference numerals, and wherein:

FIG. 12 is an elevational view of a front of the resistance band assembly of FIG. 9;

DETAILED DESCRIPTION

Figure 1:
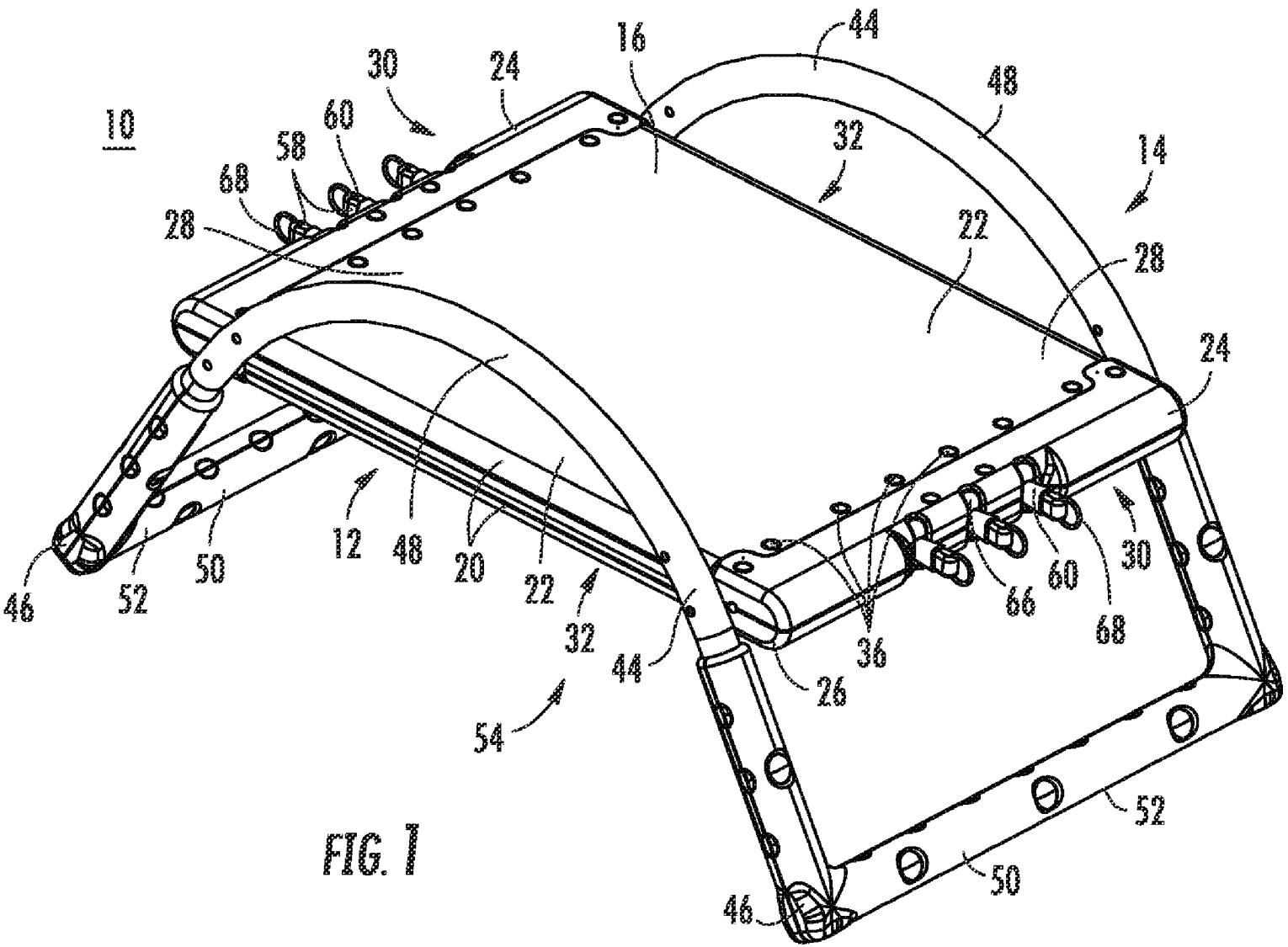
FIG. 1 is a perspective view of an exercise device in accordance with a preferred embodiment of the present invention.
Figure 2:
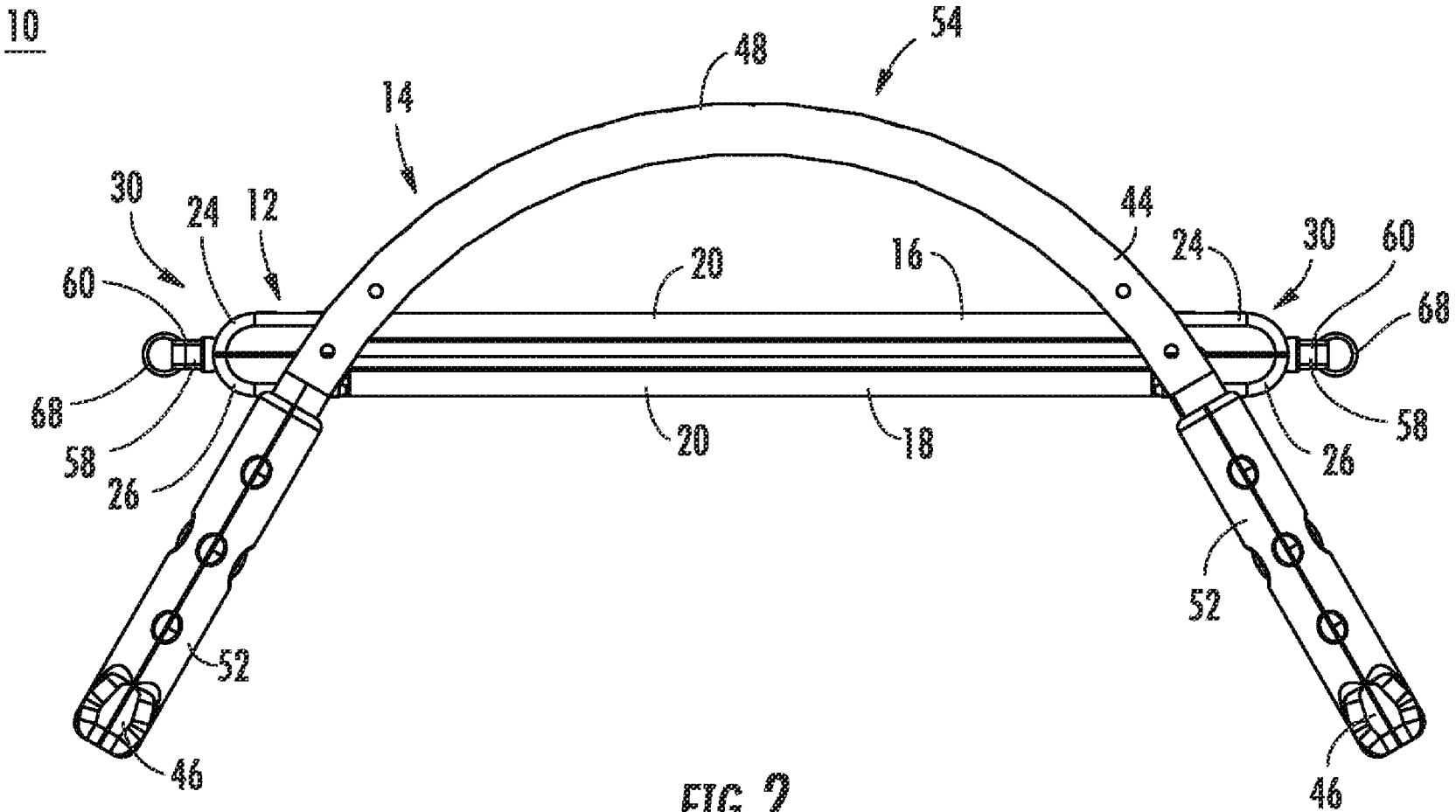
FIG. 2 is an elevational view of a front of the exercise device of FIG. 1.
Figure 3:
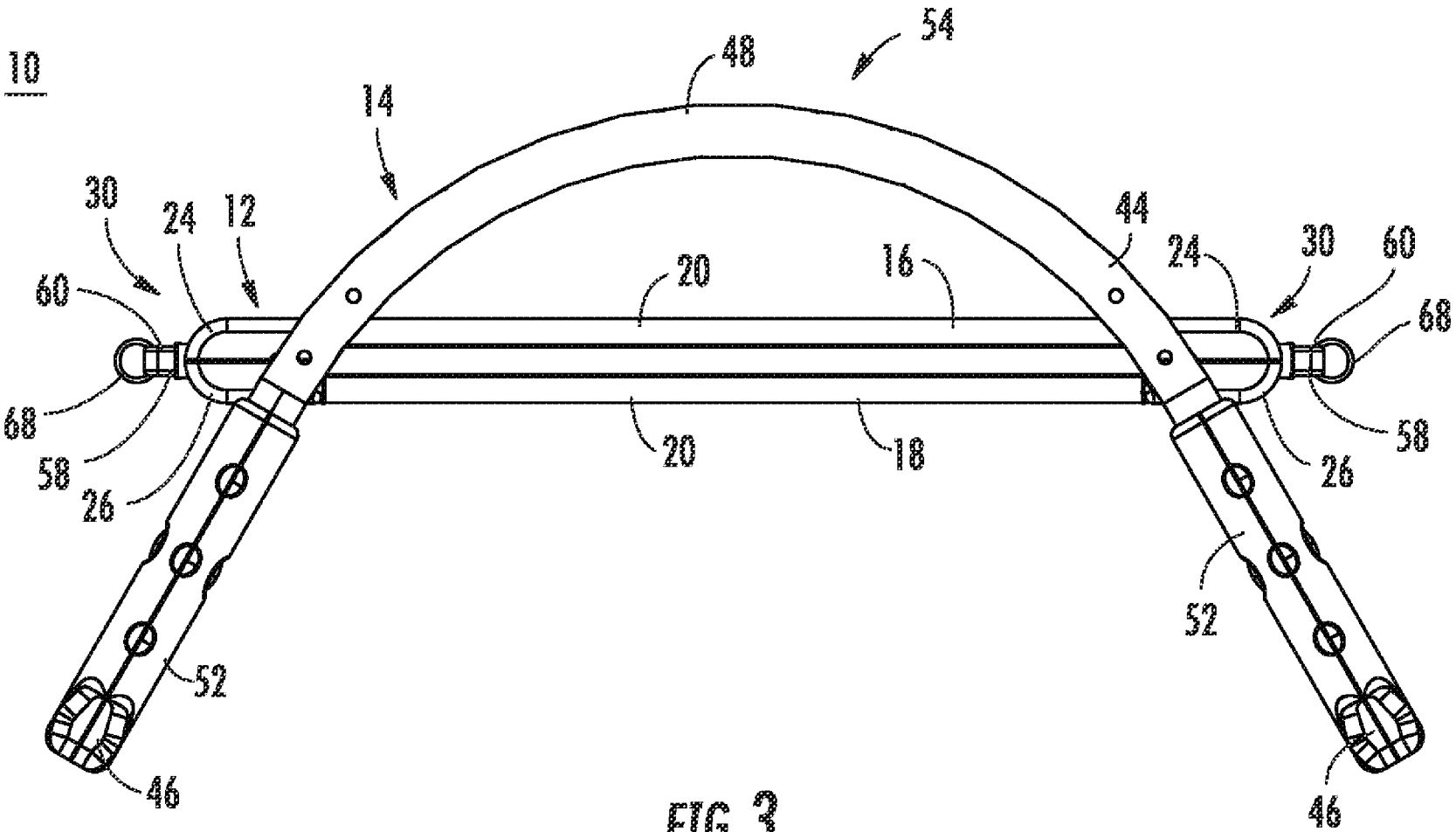
FIG. 3 is an elevational view of a rear of the exercise device of FIG. 1.
Figure 4:
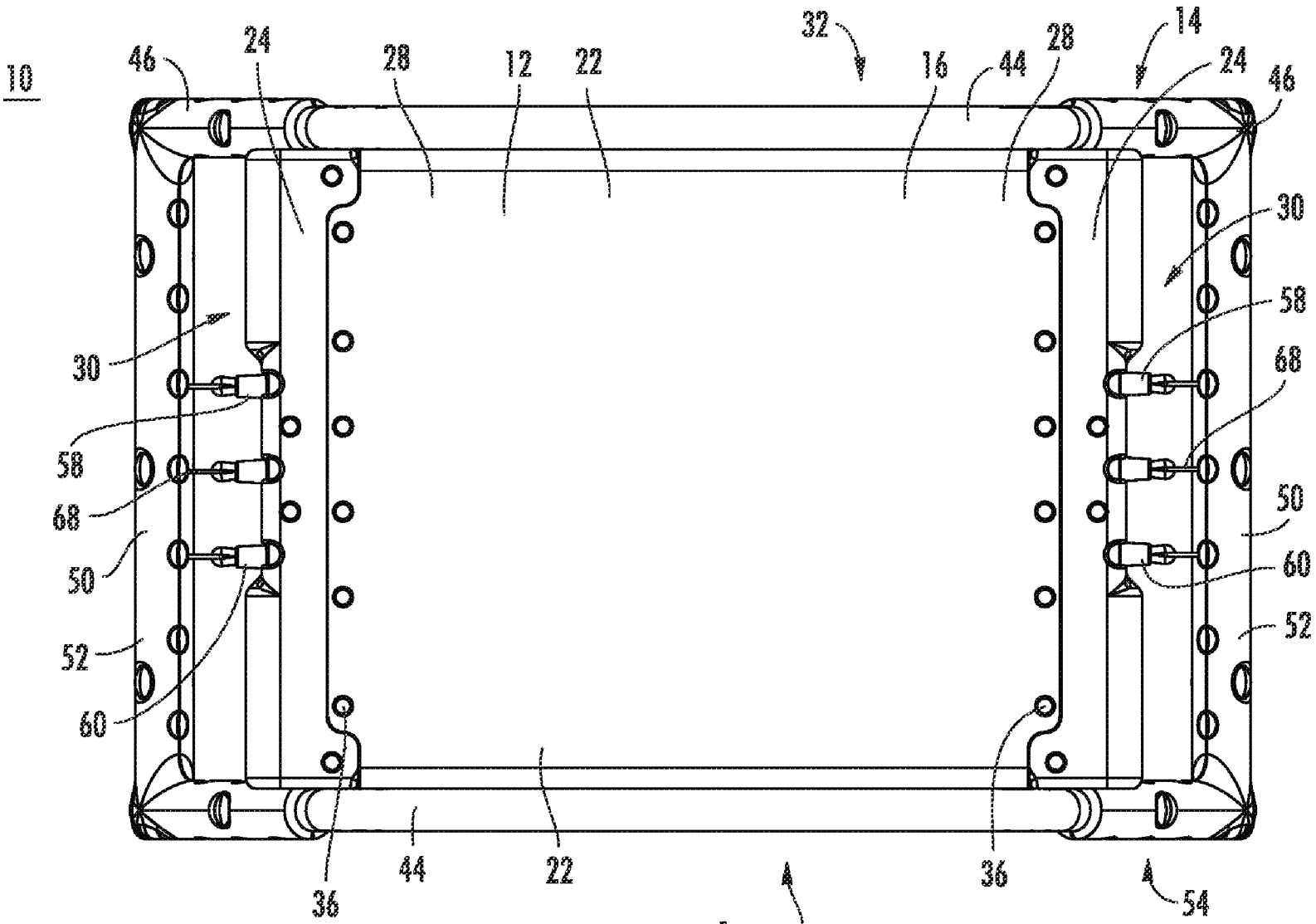
FIG. 4 is a plan view of a top of the exercise device of FIG. 1.
Figure 5:
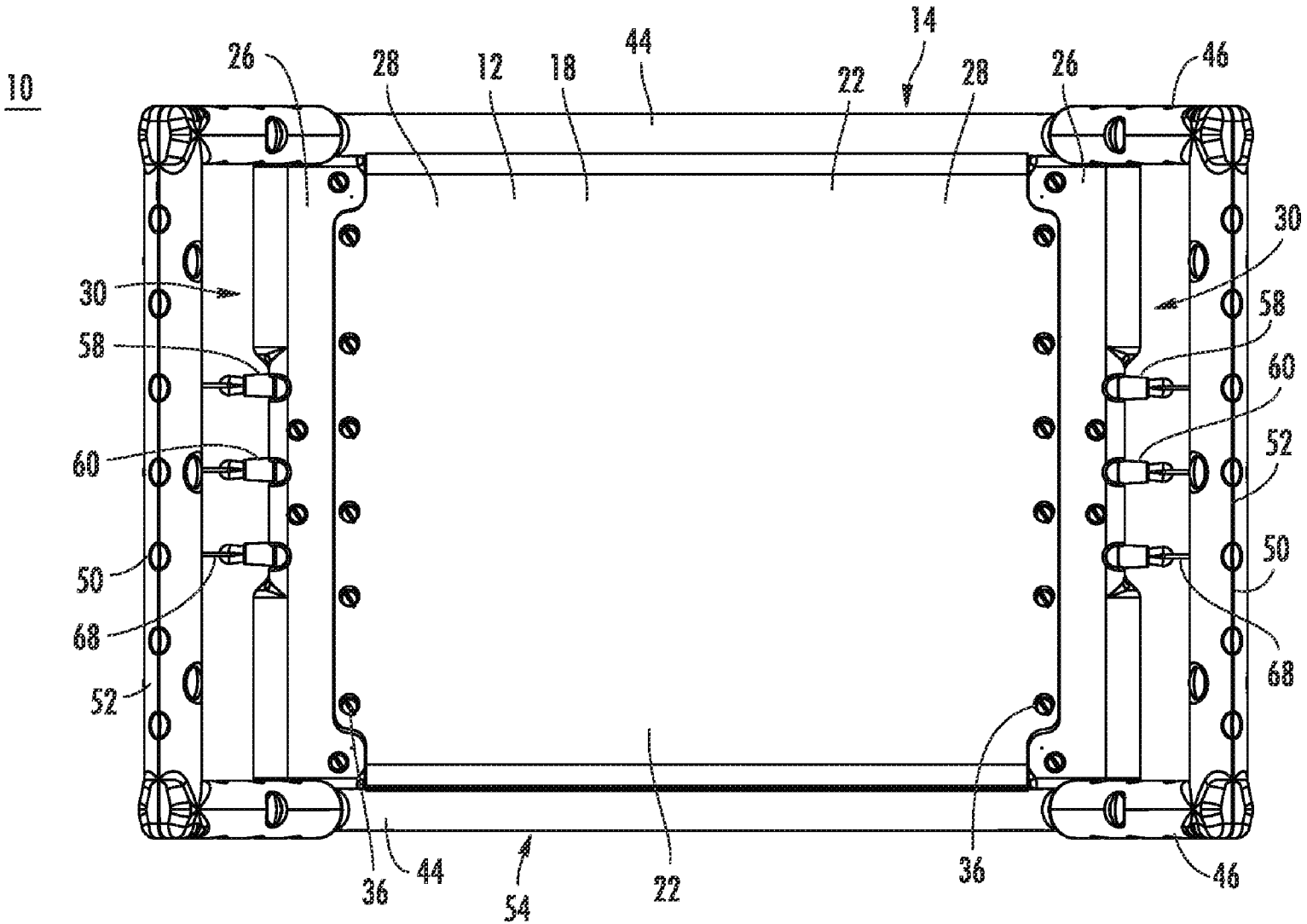
FIG. 5 is a plan view of a bottom of the exercise device of FIG. 1.
Figure 6:
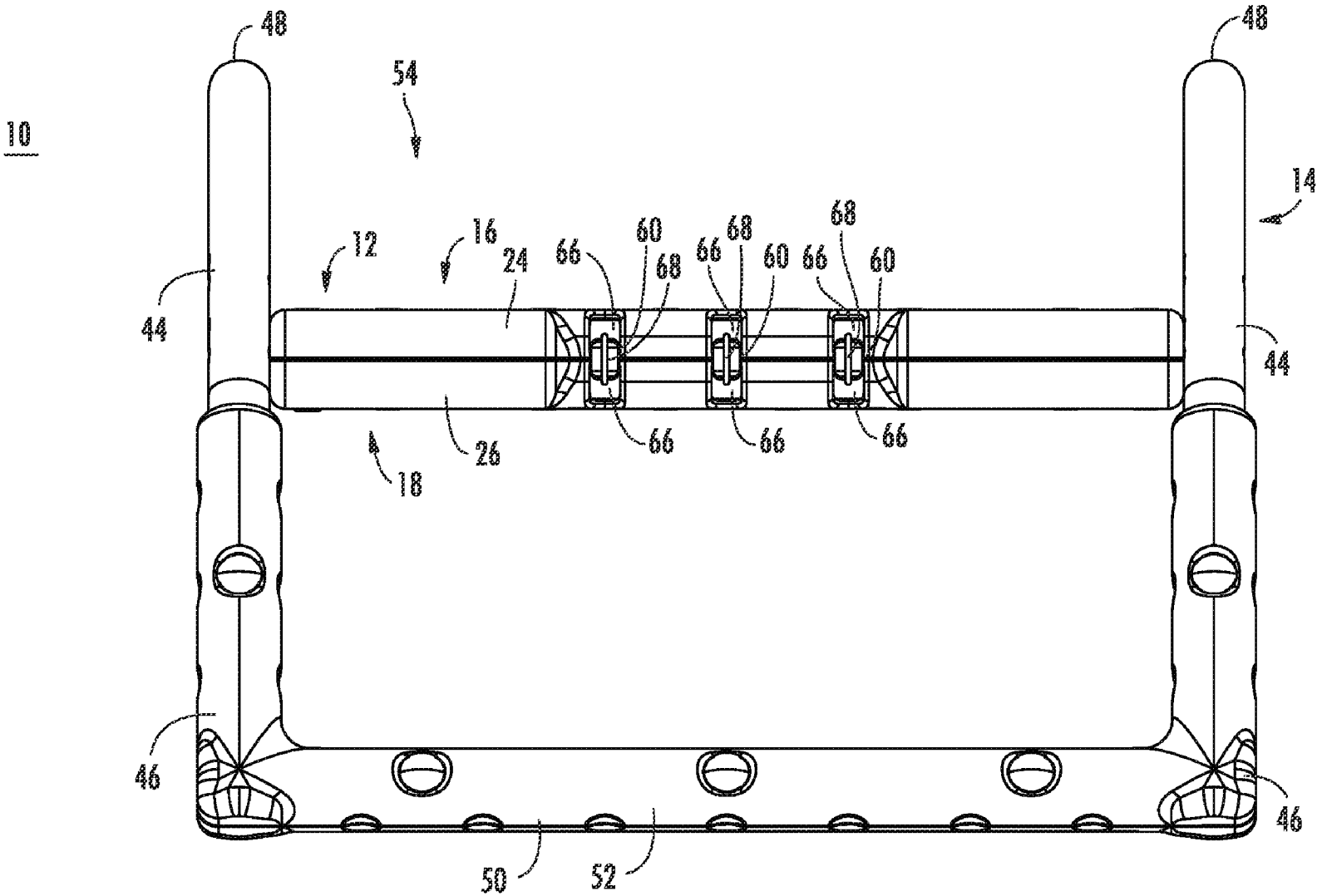
FIG. 6 is a an elevational view of a side of the exercise device of FIG. 1.
Figure 7:
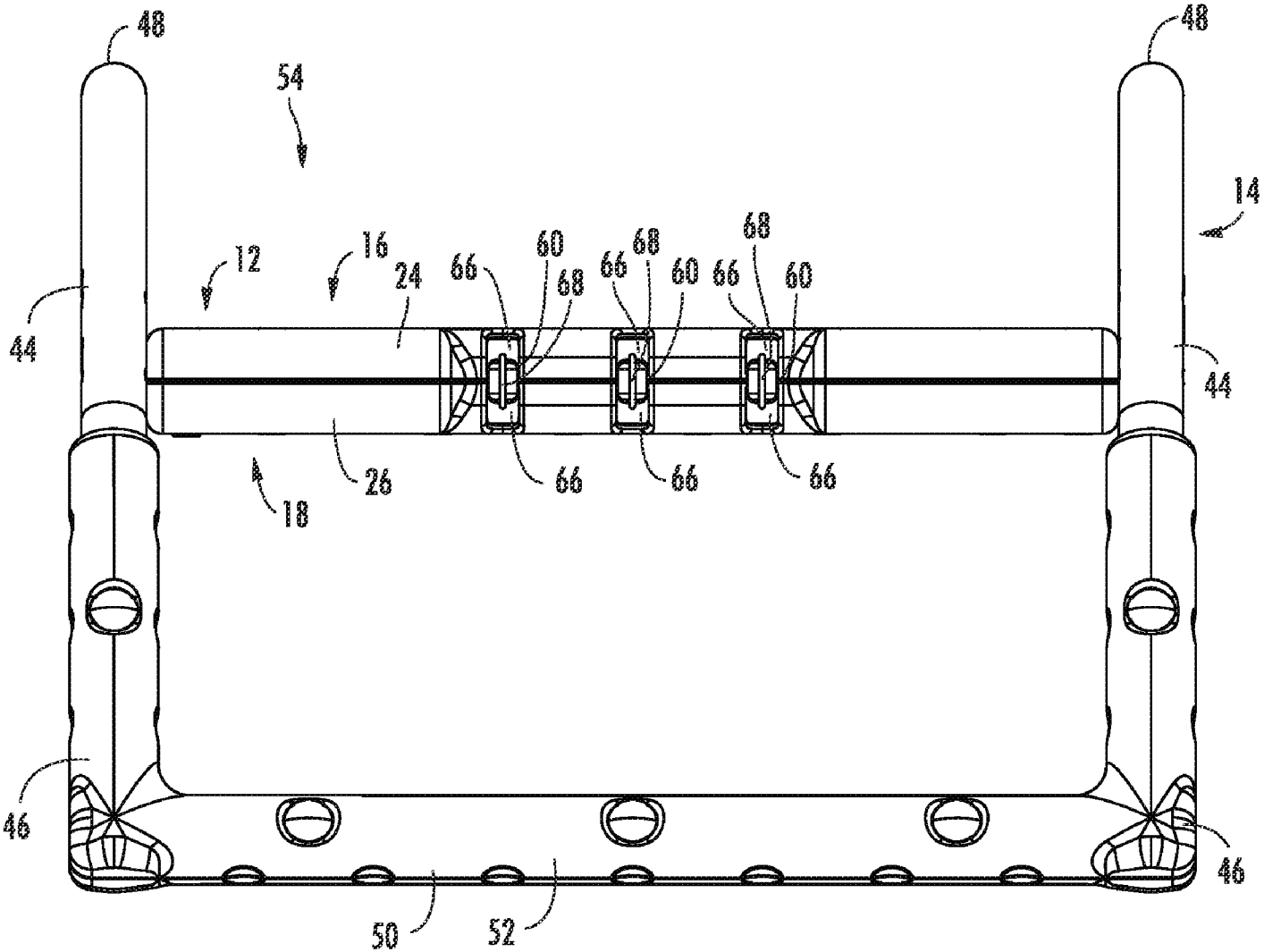
FIG. 7 is a an elevational view of an opposite side of the exercise device of FIG. 1.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

A First Preferred Embodiment

FIGS. 1-7 provide various views of an exercise device 10 in accordance with a preferred embodiment of the present invention. The exercise device 10 includes a platform 12 and a frame 14 with the frame 14 supporting the platform 12 above a surface on which the exercise device 10 is placed for use. The platform 12 includes a first platform member 16 having a generally planar stepping surface defining a stepping deck, and a second platform member 18 having a generally planar stepping surface defining a stepping deck (perhaps best seen in FIG. 2). The first and second platform members 16,18 are removably fastened to one another and are arranged in a generally parallel relationship with one another. Each platform member 16,18 may comprise a panel.

The first and second platform members 16,18 include curved edges 20 at sides 22 thereof. The curved edges 20 of the platform members 16,18 curve toward one another and abut one another when the platform members 16,18 are fastened together. The platform 12 further includes a plurality of end members 24,26. Each platform member 16,18 has a pair of end members 24,26 at opposite ends 28 thereof. As such, there are a pair of first end members 24 and a pair of second end members 26. The first end members 24 are detachably connected to the first platform member 16 and the second end members 26 are detachably connected to the second platform member 18. In addition, the first end member 24 at one end 28 of the first platform member 16 is detachably connected to the second end member 26 at a corresponding end 28 of the second platform member 18, and the first end member 24 at the opposite end 28 of the first platform member 16 is detachably connected to the second end member 26 at the corresponding end 28 of the second platform member 18. When the first and second platform members 16,18 are fastened together, the end members 24,26 essentially enclose ends 30 of the platform 12, and the curved edges 20 of the platform members 16,18 enclose sides 32 of the platform 12, to create a substantially enclosed platform interior space 34 (perhaps best seen in FIG. 8).

The platform 12, and hence the platform members 16,18 and the end members 24,26, are connected by a plurality of binding members 36 disposed near the ends 30 of the platform 12. The plurality of binding members 36 transect the first platform member 16, the first end members 24, the platform interior space 34, the second platform member 18, and the second end members 26. A portion of the binding members 36 are linearly disposed near one end 30 of the platform 12 and another portion of the binding members 36 are linearly disposed near the opposite end 30 of the platform 12. It will be understood by the Ordinary Artisan that any type of binding member having the physical characteristics needed to perform the functions of the binding members may be used.

Both of the first end members 24 include a plurality of slots 38 (perhaps best seen in FIG. 16) therethrough that match up with coinciding slots 38 in both of the second end members 26 when the end members 24,26 are connected. The coinciding slots 38 form openings 40 (perhaps best seen in FIG. 16) in the ends 30 of the platform 12. In the embodiment shown in FIGS. 1-7, there are three slots 38 in each end member 24,26, which results in three openings 40 at each end 30 of the platform 12 when the platform members 16,18 and end members 24,26 are connected. It will be understood that a platform 12 including more or fewer openings 40 than those shown in the exemplary embodiment is within the scope of the present invention.

The platform 12 may have resilient characteristics similar to conventional step exercise apparatus, whereby the impact experienced by a user in stepping onto the platform may be lessened. The resilient characteristics are enabled by the material from which the platform 12 is made and the configuration of the platform 12. For example, it is contemplated that the platform members 16,18 of the platform 12 may be made from nylon, high density polyethylene, or some other material with similar characteristics. In addition, the hollow nature of the platform interior space 34 combined with stiffeners 42 (perhaps best seen in FIG. 8) disposed inside the platform interior space 34 further enable the resilient characteristics of the platform 12. The stiffeners 42 will be described in greater detail below.

The frame 14 includes a pair of arcuate rails 44 disposed in fixed parallel relation to one another. Each arcuate rail 44 includes ends 46 and a rounded apex 48 intermediate the ends 46 thereof. Vertical planes of the rails 44 are disposed generally orthogonally to the generally planar surface of the first platform member 16. The frame 14 further includes a pair of connection bars 50 disposed in fixed parallel relation to one another and fixedly connecting the ends 46 of the pair of arcuate rails 44 to one another to form the frame 14. The connection bars 50, the intersection of the connection bars 50 and the arcuate rails 44, and the ends 46 of the arcuate rails 44 are encased in a covering 52. The covering 52 aids in inhibiting slipping of the exercise device 10 when it is in use. The covering 52 also provides an easily graspable surface for a user to grip when the exercise device 10 is in use. It is contemplated that the covering 52 will be made from a non-marking, non-slip, soft, but durable material. Examples of possible materials include, but are not limited to, neoprene, rubber, or a low cost thermoplastic elastomer.

The exercise device 10 may be used in the configuration shown in FIGS. 1-7, which is a stationary configuration 54 in which the exercise device provides stability during exercise by a user. In this stable configuration 54, the connection bars 50 are supported on a surface on which the device 10 is placed, typically the ground, and the exercise device 10 is immobile when a user is positioned on the platform 12.

The exercise device 10 may also be used in a configuration that is not stable, i.e., in a the rocking configuration. In the unstable rocking configuration, the exercise device 10 is basically turned upside-down relative to the stationary configuration 54. The rounded apexes 48 of the arcuate rails 44 are supported on the ground such that the exercise device 10 rocks back-and-forth from side to side when a force is applied to the platform 12 that is not directly centered relative to the ends of the device 10.

The exercise device 10 further includes a resistance band system that is housed within the interior space 34 of the platform 12 and that includes a plurality of resistance bands 58. An end 60 of each of the plurality of resistance bands 58 is disposed exterior to the platform 12 so that the user may easily access the resistance band 58. More particularly, an end 60 of each of the plurality of resistance bands 58 exits the interior 34 of the platform 12 through one of the openings 40 at the ends 30 of the platform 12. Each resistance band 58 exits through a designated opening 40 with only one resistance band 58 exiting through each opening 40; therefore, the number of resistance bands 58 corresponds to the number of openings 40. In the exemplary embodiment shown in FIGS. 1-7, there are six resistance bands 58 and six openings 40 with each resistance band 58 having a particular opening 40 through which to exit the platform interior 34.

It furthermore is contemplated that the resistance bands 58 at each end of the platform will have varying resistances so that varying amounts of strength or exertion are needed to engage and expand the respective resistance bands 58, and that each end of the platform will have a plurality of resistance bands that are the same as the plurality of resistance bands at the other end of the platform. Such varying resistance at respective ends of the platform may be accomplished by varying the thickness of the resistance bands, with a resistance band having a relatively greater thickness requiring more force to expand than a resistance band having a relatively lesser thickness. In addition, it is contemplated that a user can combine more than one resistance band when using the exercise device to add further versatility to a workout using the exercise device.

Figure 8:
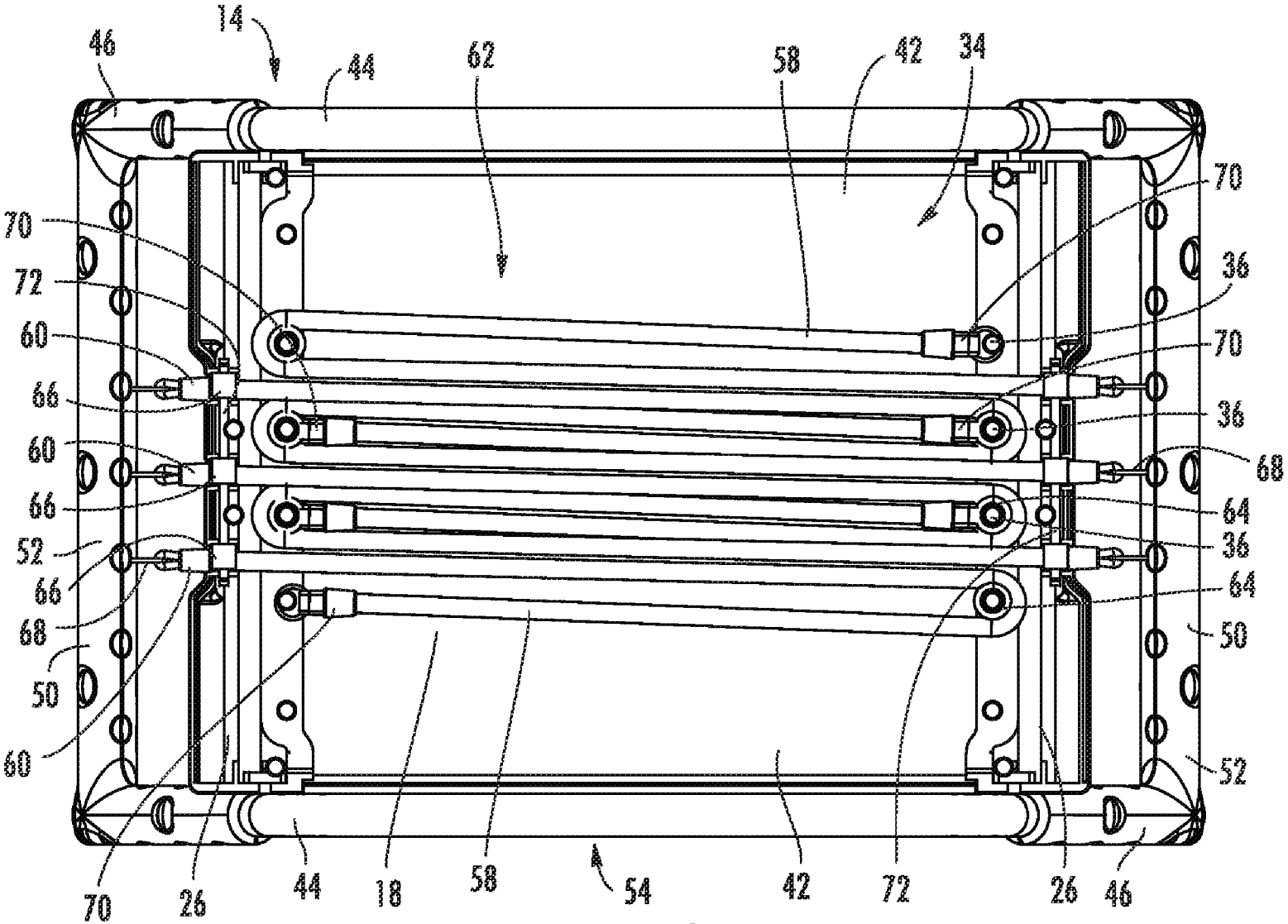
FIG. 8 is a plan view of the top of the exercise device of FIG. 1 with the first platform member and its associated end members having been removed.
Figure 9:
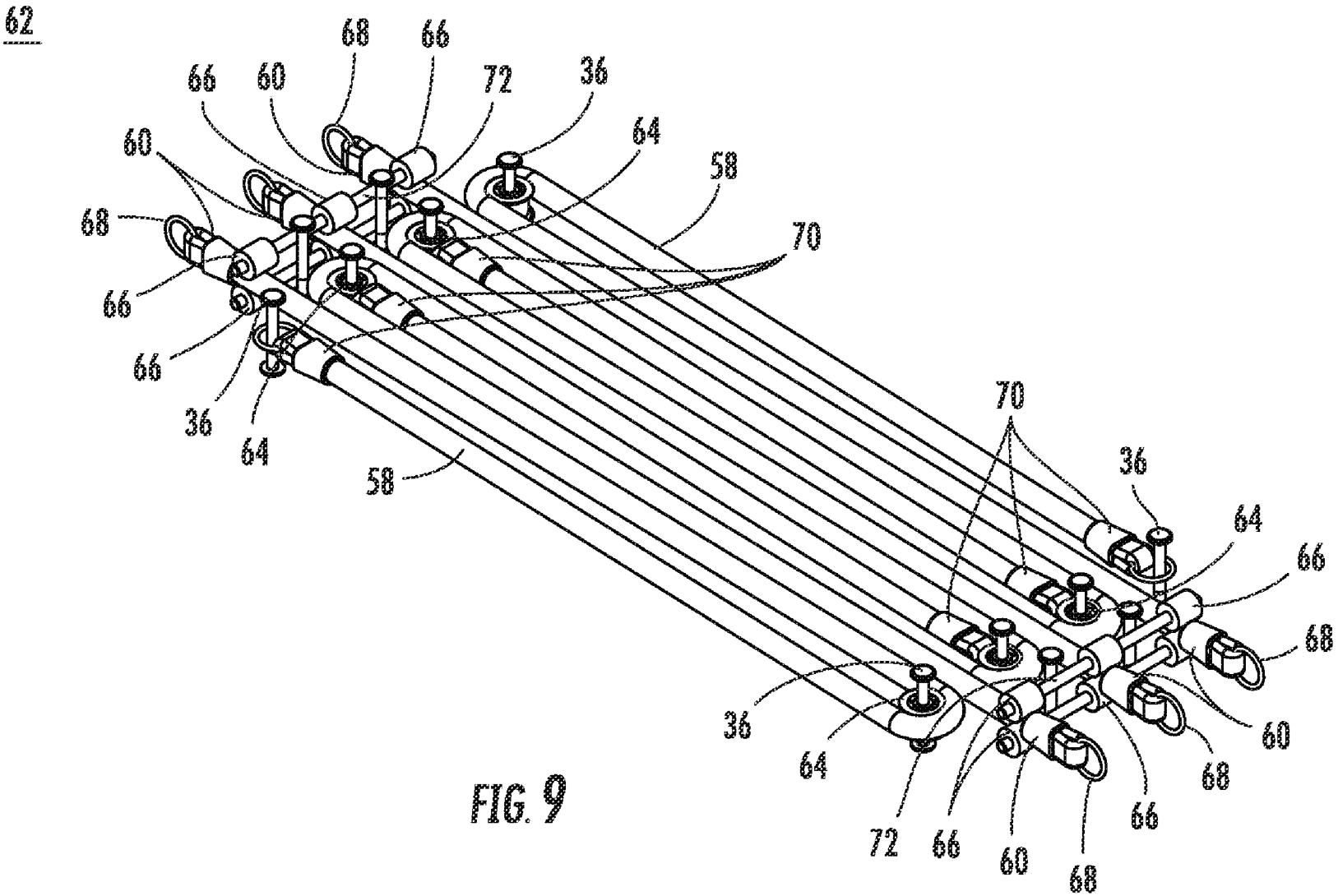
FIG. 9 is a perspective view of a resistance band assembly of the exercise device of FIG. 1.
Figure 10:
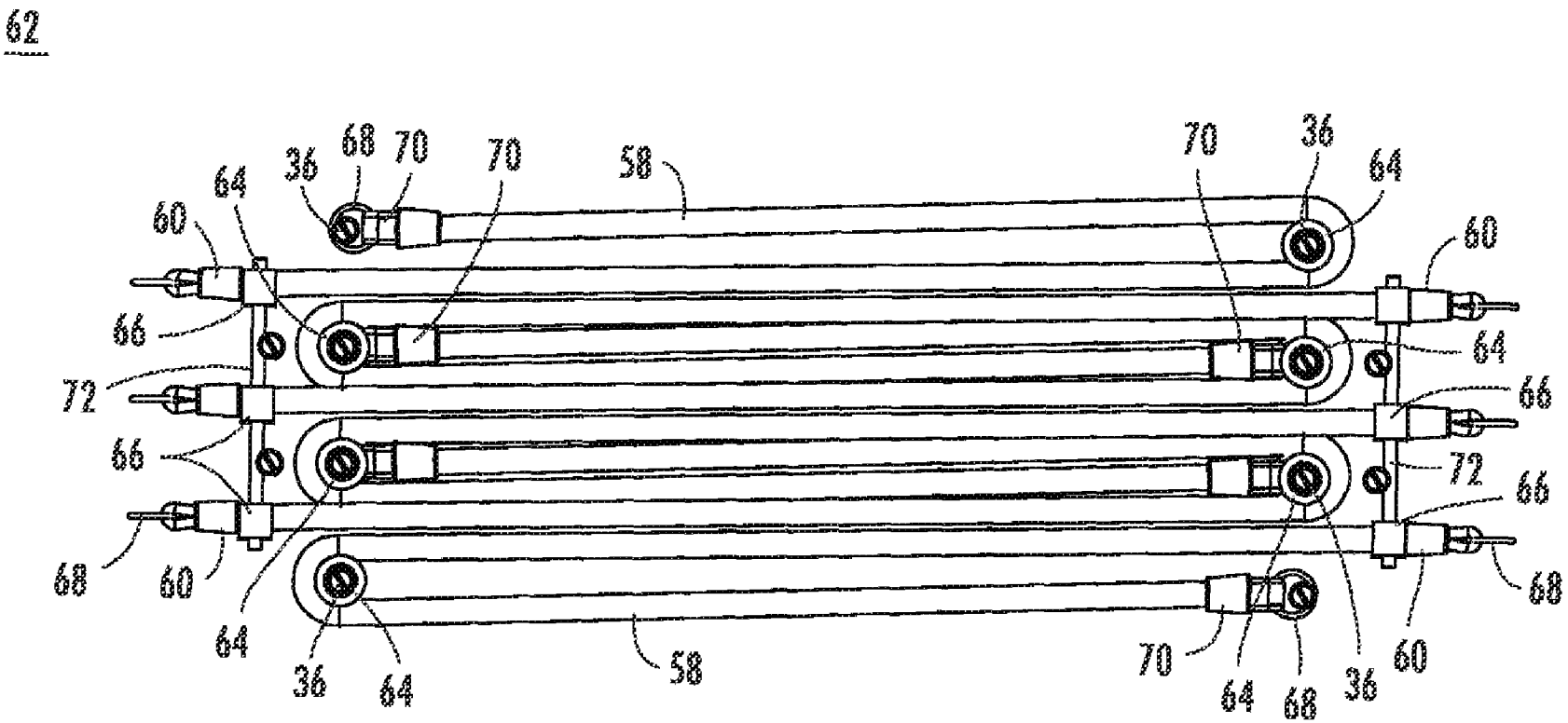
FIG. 10 is a plan view of a top of the resistance band assembly of FIG. 9.
Figure 11:
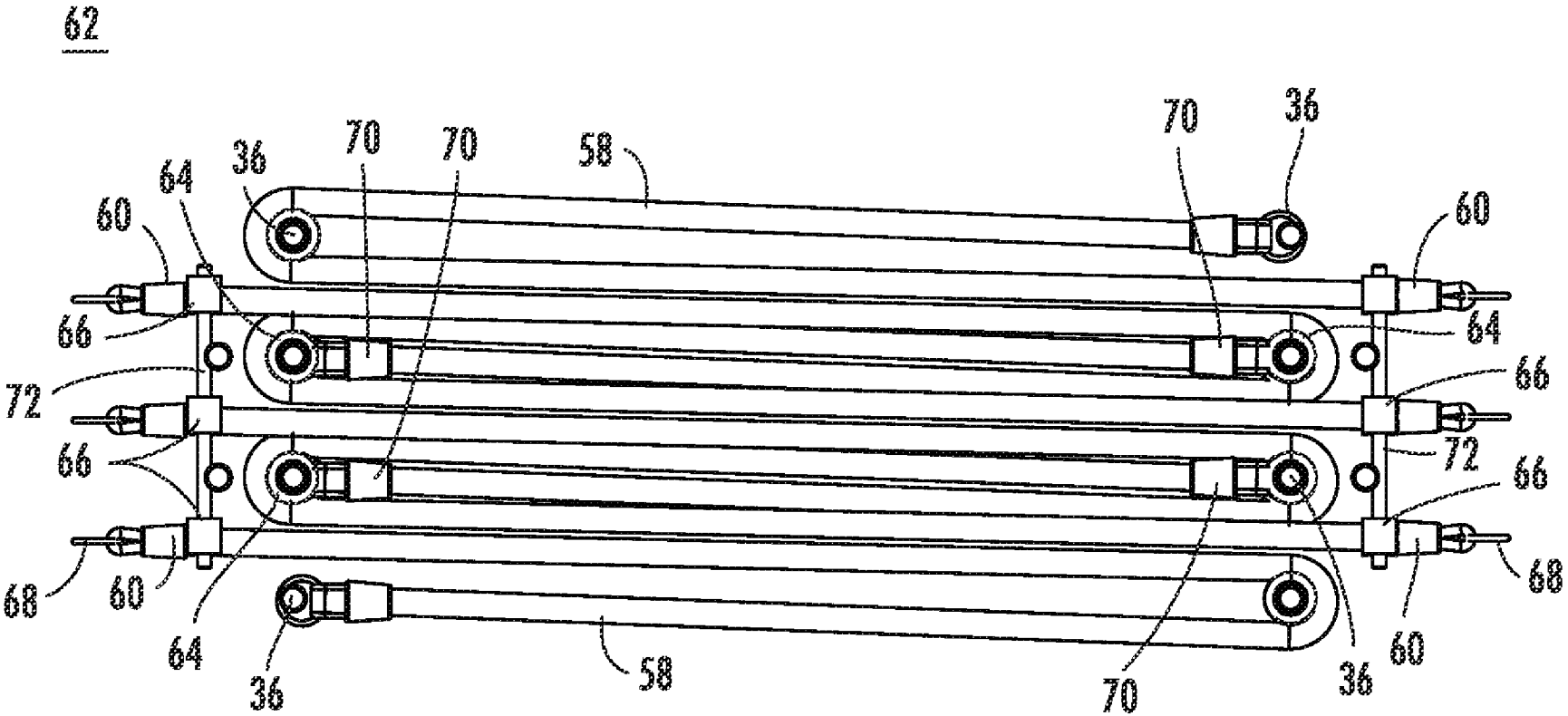
FIG. 11 is a plan view of a bottom of the resistance band assembly of FIG. 9.

With particular reference to the resistance bands 58, FIG. 8 shows the exercise device 10 with the first platform member 16 and first end members 24 removed so that the platform interior 34 and a resistance band assembly 62 may easily be seen, and FIGS. 9-15 show various views of the resistance band assembly 62 removed from the exercise device 10. The resistance band assembly 62 is primarily housed within the interior 34 of the platform 12. The resistance band assembly 62 includes the plurality of resistance bands 58, a plurality of pulleys 64, and a plurality of rollers 66.

Each of the resistance bands 58 has an attachment ring 68 at an end 60,70 thereof. The attachment ring 68 at one end 70—the "anchor end"—is used to anchor the resistance bands 58 to one of the plurality of binding members 36 within the interior 34 of the platform 12. The attachment ring 68 at the other end 60 of the resistance bands 58—the "exit end"—is used to enable a user of the exercise device 10 to more easily access the resistance bands 58.

For example, a user may attach a user interface to the end 60 of a resistance band 58 using the attachment ring 68. Additionally, a user may attach a user interface to multiple ends 60 of a plurality of particular resistance bands 58 at the same end of the platform using the attachment rings 68 of the particular resistance bands 58. In this way, resistance bands can be combined for greater variability in the levels of resistance. Additionally, a user interface may include, for example, a handle for grasping by the hand or a strap for attachment to a foot or ankle. A carabineer or other mechanism may be used to attach the user interface to each of the attachment rings of the resistance bands.

As indicated previously, in the exemplary embodiment, each end 30 of the platform 12 has three resistance bands 58 exiting therefrom for a total of six resistance bands 58 available in the exercise device 10. The resistance bands 58 are connected to the previously described binding members 36 that are aligned at opposite ends 30 of the platform 12. Further, the anchor end 70 of each resistance band 58 is anchored to a binding member 36 at the same end 30 of the platform 12 from which the exiting end 60 of the resistance band 58 exits.

More particularly, following a single exemplary resistance band 58, the anchor end 70 of the resistance band 58 is anchored to a binding member 36 at one end 30 of the platform 12. The resistance band 58 then travels longitudinally across the interior 34 of the platform 12 to a second binding member 36 at the opposite end 30 of the platform 12. The resistance band 58 is partially wrapped around the second binding member 36 such that the resistance band 58 makes approximately a 180° turn around the second binding member 36. The second binding member 36 has a pulley mechanism 64 disposed in surrounding relation thereto that freely rotates around the second binding member 36. The pulley mechanism 64 enables the resistance band 58 to readily change direction and turn around the second binding member 36. After turning around the second binding member 36 and its associated pulley mechanism 64, the resistance band 58 travels longitudinally back across the platform 12 in a direction opposite to the direction in which the resistance band 58 initially transects the platform 12. The exiting end 60 of the resistance band 58 then exits the platform interior 34 through its designated opening 40.

A pair of horizontal rollers 66 are disposed in the opening 40 above and beneath the resistance band 58 to facilitate more smooth movement of the resistance band 58 into and out of the interior 34 of the platform 12. The smooth movement makes exercising with the resistance band 58 more comfortable, i.e., less jerky, and increases the useful life of the resistance band 58 by reducing friction of the resistance band 58 at the opening 40 as the resistance band 58 expands and contracts.

Each of the six resistance bands 58 follows the configuration described above for an exemplary resistance band 58. As such, the resistance band assembly 62 includes six pulley mechanisms 64 and six pairs of horizontal rollers 66. With regard to the horizontal rollers 66, the rollers 66 above the platform openings 40 share a common shaft 72 about which they rotate, and the rollers 66 below the platform opening share a common shaft 72 about which they rotate.

Because the platform 12 has three resistance bands 58 exiting (and initiating) from one end 30 and three resistance bands 58 exiting (and initiating) from the opposite end 30, there is some functional overlap for the binding members 36. More particularly, for four of the resistance bands 58, the anchor binding member 36 for a first resistance band 58 also serves as the second binding member 36 or the pulley binding member 36 for a second resistance band 58 that initiates at the opposite end 30 of the platform 12 from the first resistance band 58. The resistance bands 58 are arranged in the resistance band assembly 62 such that the functional overlap of the binding members 36 does not interfere with the functionality of the resistance bands 58. Rather the arrangement of the resistance band assembly 62 enables maximum functionality while maintaining a compact size, which is desirable for the exercise device 10.

Figure 16:
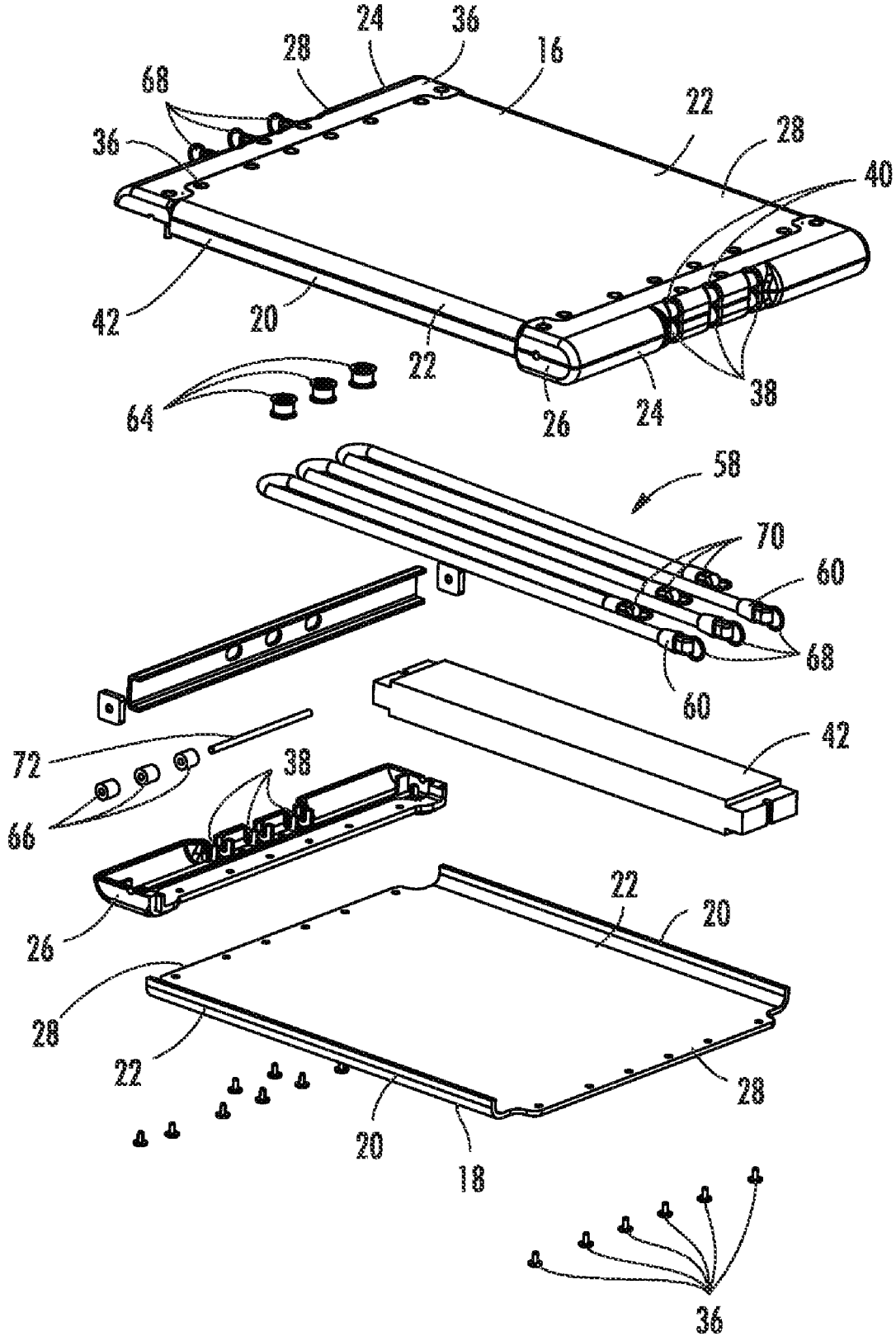
FIG. 16 is an exploded perspective view of a front of a platform of the exercise device of FIG. 1.
Figure 17:
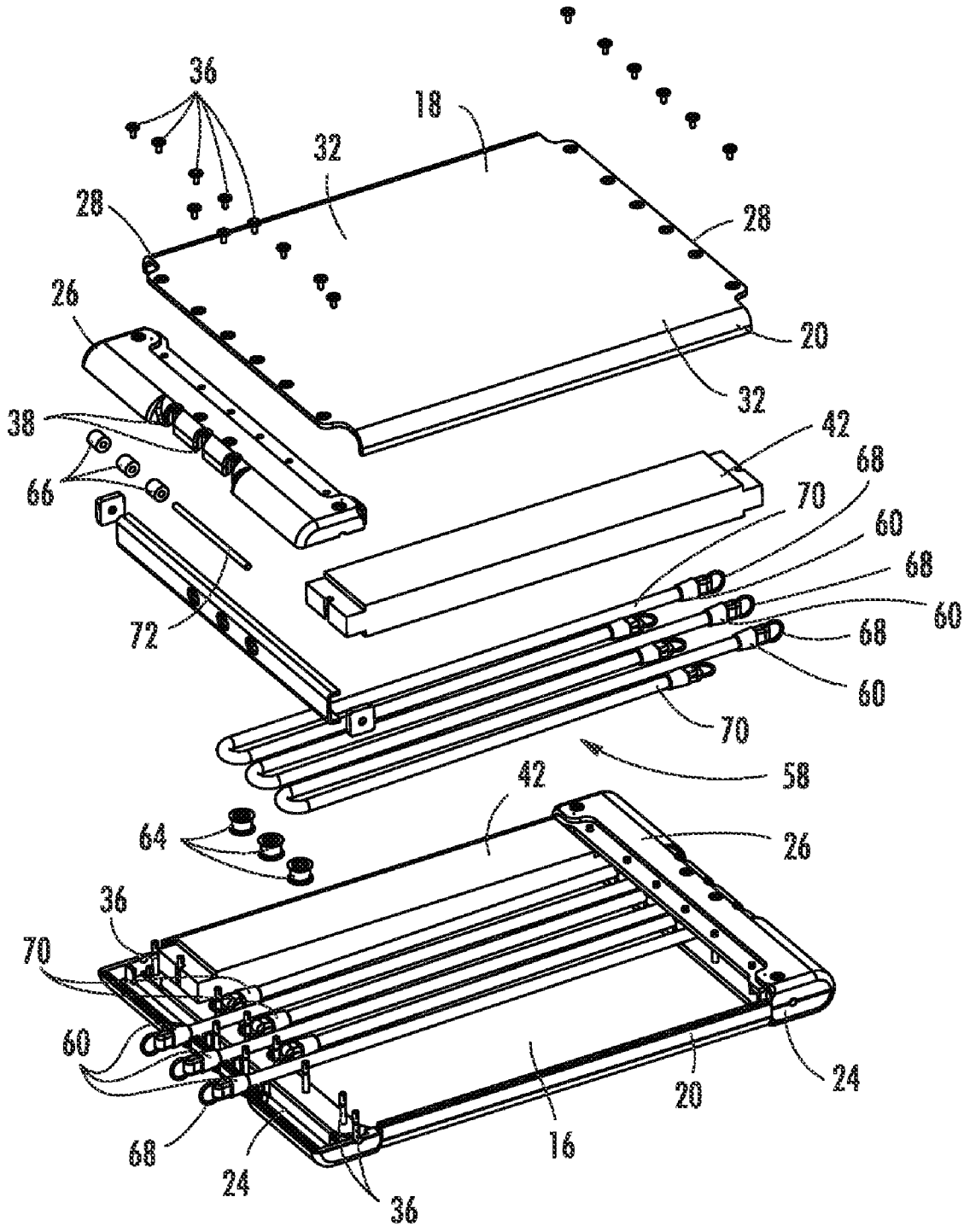
FIG. 17 is an exploded perspective view of a rear of the platform of FIG. 16.
Figure 18:
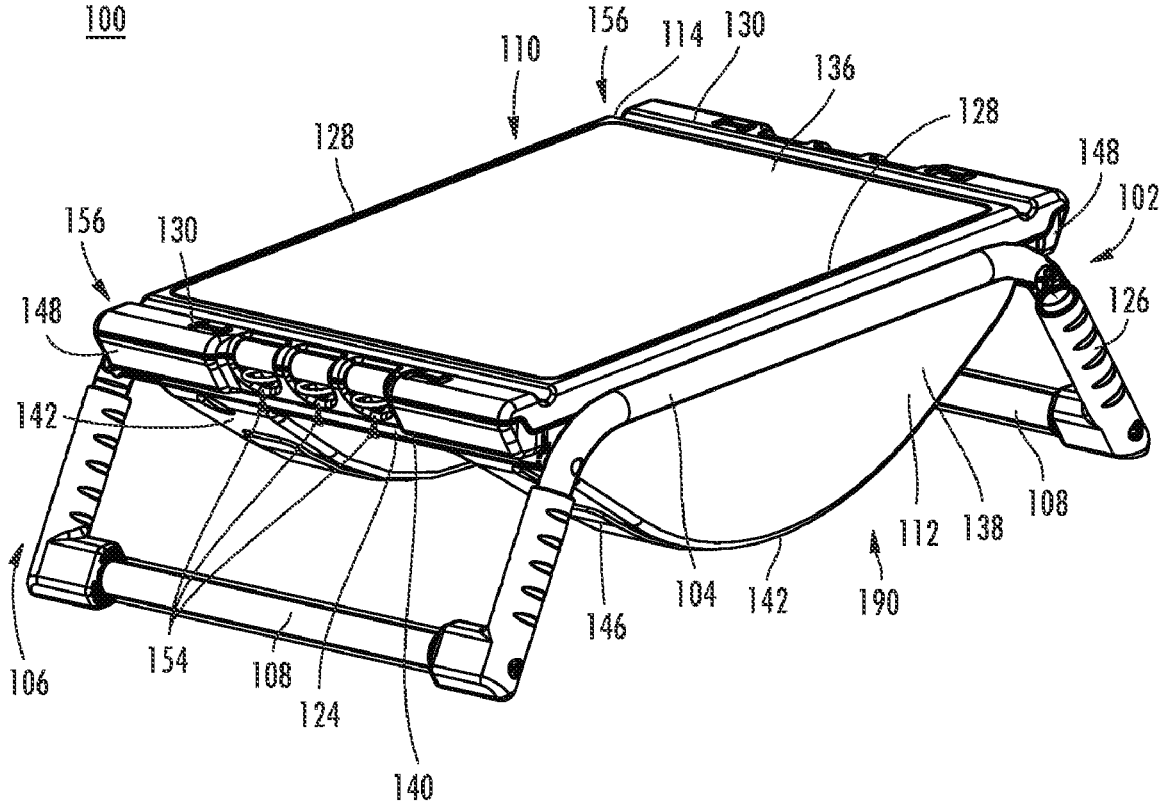
FIG. 18 is a perspective view of an exercise device in accordance with a preferred embodiment of the present invention.

FIGS. 16 and 17 provide exploded views of the platform 12 of the exercise device 10. As shown, the platform 12 includes a pair of stiffeners 42 disposed in the platform interior 34, one disposed adjacent each side 32 of the platform 12. The stiffeners 42 are connected to the platform 12 by a portion of the binding members 36. It is contemplated that the stiffeners 42 may be made of a foam rubber or neoprene material. The stiffeners 42 further enable the platform 12 resiliency, which was previously described above.

In use, the exercise device 10 can be used in the stable configuration and the unstable configuration. In the stable configuration 54, a user may sit, stand, or lie on the platform member 16 to perform various exercise movements including cardiovascular exercises, strength training exercises, and/or stretching exercises. In so doing, the user may engage the resistance bands 58 on either end 30 of the platform 12 by attaching handles thereto and causing the resistance bands 58 to expand. The user may pull one or more of the resistance bands 58 with one or more of his or her hands if it is desired to exercise some aspect of his or her upper body. In addition, the user may pull one or more of the resistance bands 58 with one or more of his or her legs by using straps that extend around his or her foot or ankle. As indicated previously, the resistance bands 58 may have varying resistances thereby enabling a versatile exercise experience. In addition, more than one resistance band 58 may be connected to a handle or a grasping member to further add to the versatility of the exercise device.

In the unstable configuration, a user may also sit, stand, or lie on the platform member 18 to perform various exercise movements. It is believed that the unstable configuration aids in strengthening a user's core muscles and in improving a user's balance. The resistance bands 58 may be used in the rocking configuration in the same way in which they would be used in the stationary configuration 54.

In addition, the exercise device 10 may also be used in either configuration without the user sitting, standing, or lying on the platform member 18. In this respect, the user may engage the connection bars 50 of the exercise device 10 with his hands to perform various exercises with the exercise device 10 without interacting with the platform 12. Preferably, the connection bars 50 include intermediate portions that are configured to be used as handle bars or handle grips. Indeed, such intermediate portions may include contoured surfaces for receiving the fingers and thumb of a hand in a gripping configuration.

As will be appreciated, the platform 12 and the frame 14 of the exercise device 10 are not intended to be coupled and uncoupled during use in exercising. Moreover, while the exercise device 10 has been disclosed and described as having a platform 12 that is secured to the frame 14, it is contemplated that, within the scope of the present invention, at least a portion of the platform 12 may be integrally formed with the frame 14 during manufacturing whereby such portion of the platform 12 is inseparable from the frame 14 without destroying this portion of the platform 12 and the frame 14.

A Second Preferred Embodiment

FIGS. 18-22 show various views of an exercise device 100 in accordance with a second preferred embodiment of the present invention.

The exercise device 100 includes a frame 102 having a pair of side rails 104 and a pair of connection bars 108 disposed at ends 106 of the side rails 104. The rails 104 are disposed at a fixed distance from one another, and the connection bars 108 are disposed at a fixed distance from one another. The connection bars 108 are oriented generally orthogonally in relation to planes defined by the pair of side rails 104 and are fixedly attached to the ends 106 of the side rails 104 to form the frame 102.

Figure 20:
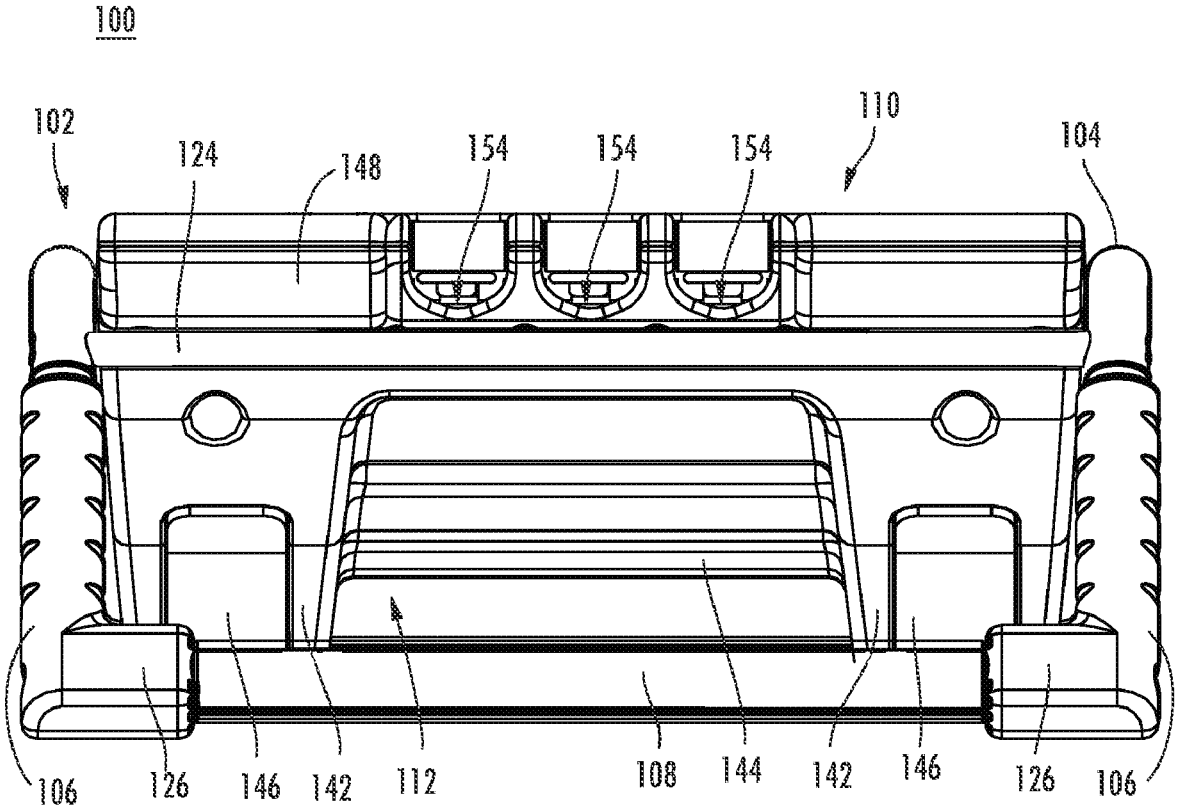
FIG. 20 is an elevational view of a side of the exercise device of FIG. 18.
Figure 20A:
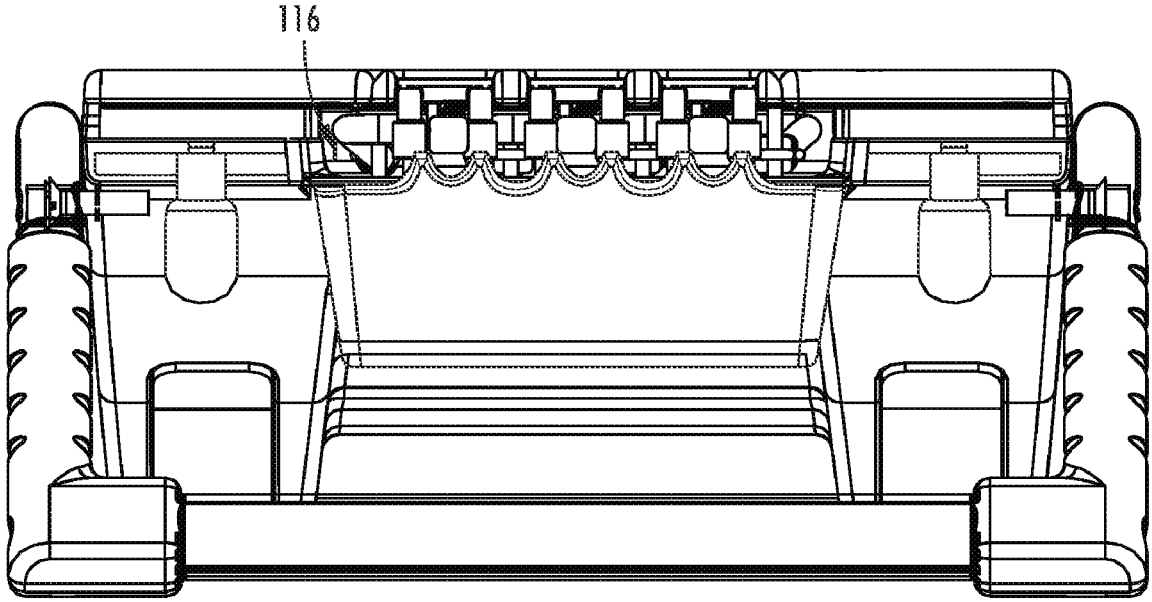
FIG. 20A is an elevational view, in partial cross-section, of the side of the exercise device of FIG. 20.
Figure 21:
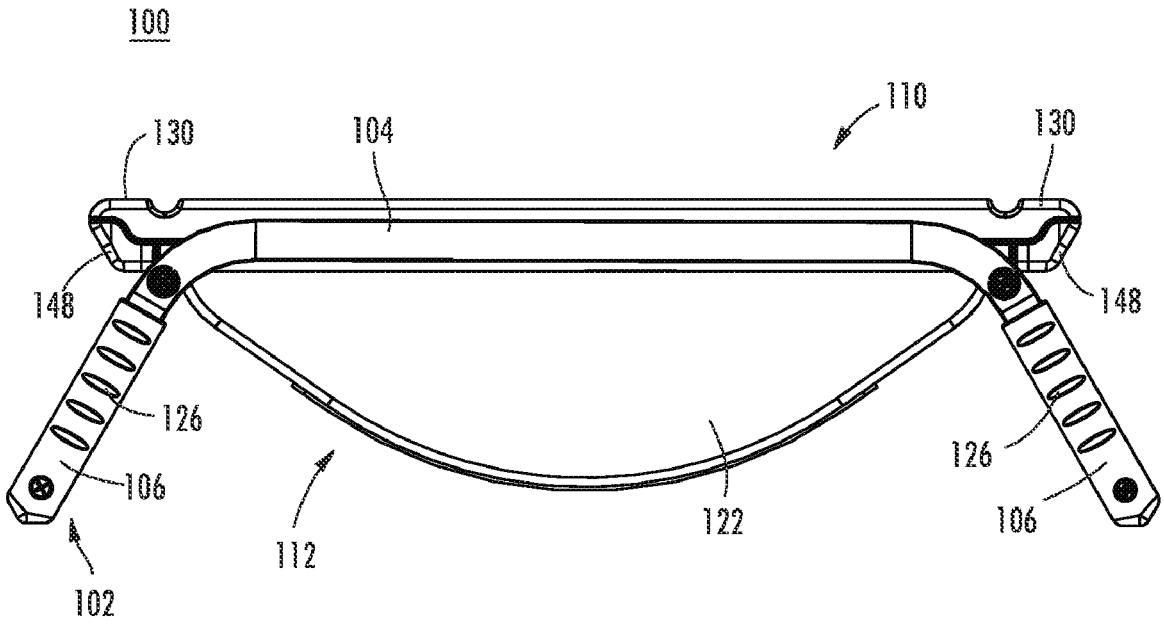
FIG. 21 is an elevational view of a front of the exercise device of FIG. 18.
Figure 22:
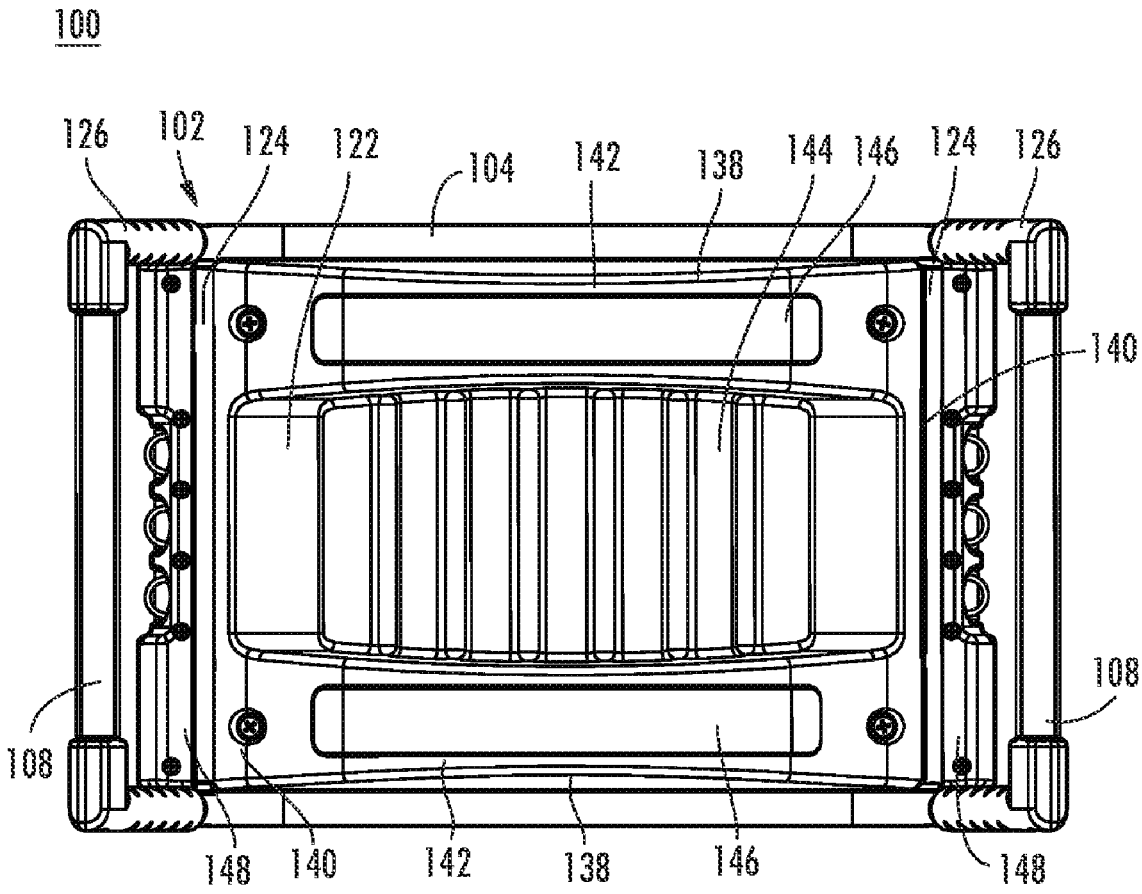
FIG. 22 is a plan view of a bottom of the exercise device of FIG. 18.

The exercise device 100 further includes a platform 110 having an arched base 112 and a stepping deck 114 removably coupled to one another to define an interior space 116 therebetween (perhaps best seen in FIG. 20A).

The exercise device 100 also includes a resistance band system having a resistance band assembly 118 that is housed within the platform 110 and that includes a plurality of resistance bands 120 (perhaps best seen in FIGS. 35-39). The plurality of resistance bands 120 are arranged within the interior space 116 of the platform 110 and have ends 200,202 that are disposed exterior to the platform 110 for easy access by a user.

The rails 104 have relatively level central portions and curved end portions. Vertical planes defined by the rails 104 are disposed generally orthogonally to a surface on which the exercise device 100 is placed, typically the ground.

The connection bars 108, the intersection of the connection bars 108 and the rails 104, and the end portions 106 of the rails 104 are encased in a covering 126. The covering 126 aids in inhibiting slipping of the exercise device 100 when it is in use. The covering 126 also provides an easily graspable surface for a user to grip when the exercise device 100 is in use. It is contemplated that the covering 126 will be made from a non-marking, non-slip, soft, but durable material. Examples of possible materials include, but are not limited to, neoprene, rubber, or a low cost thermoplastic elastomer.

The frame 102 also includes a pair of support cross bars 124 disposed near the transition between the curved end portions and level central portions of the rails 104. The support cross bars 124 are arranged in a parallel orientation with the connection bars 108 and serve to support the platform 110 when the platform 110 is received by the frame 102. To this end, the platform 110 includes groves within which the support cross bars 124 are received when the platform 110 is supported by the frame 102. In particular, as perhaps best shown in FIG. 22, the platform 110 is positioned between the rails 104 and is supported by the pair of support cross bars 124 disposed near the transition between the curved end portions and level central portions of the rails 104. The platform 110 thereby is supported on, and is separable from, the frame 102.

Figure 19:
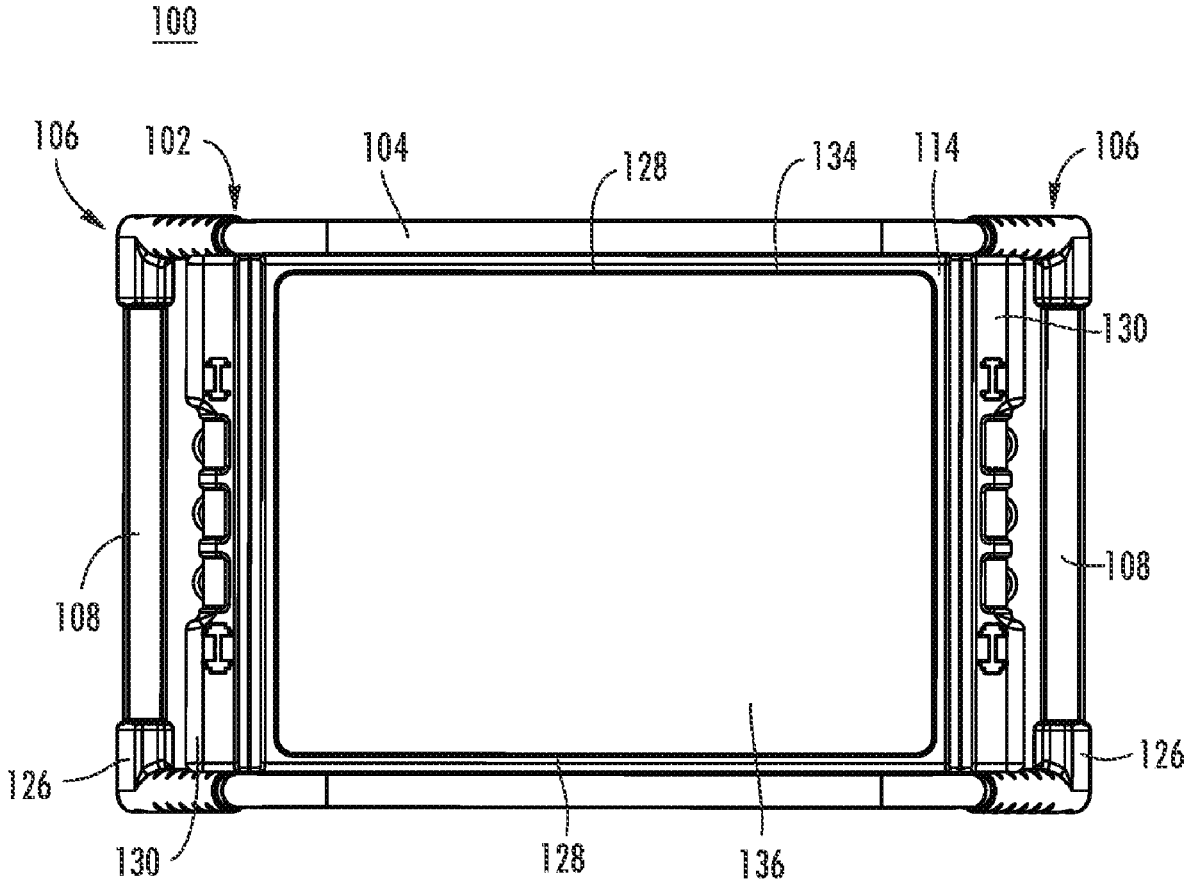
FIG. 19 is a plan view of a top of the exercise device of FIG. 18.
Figure 29:
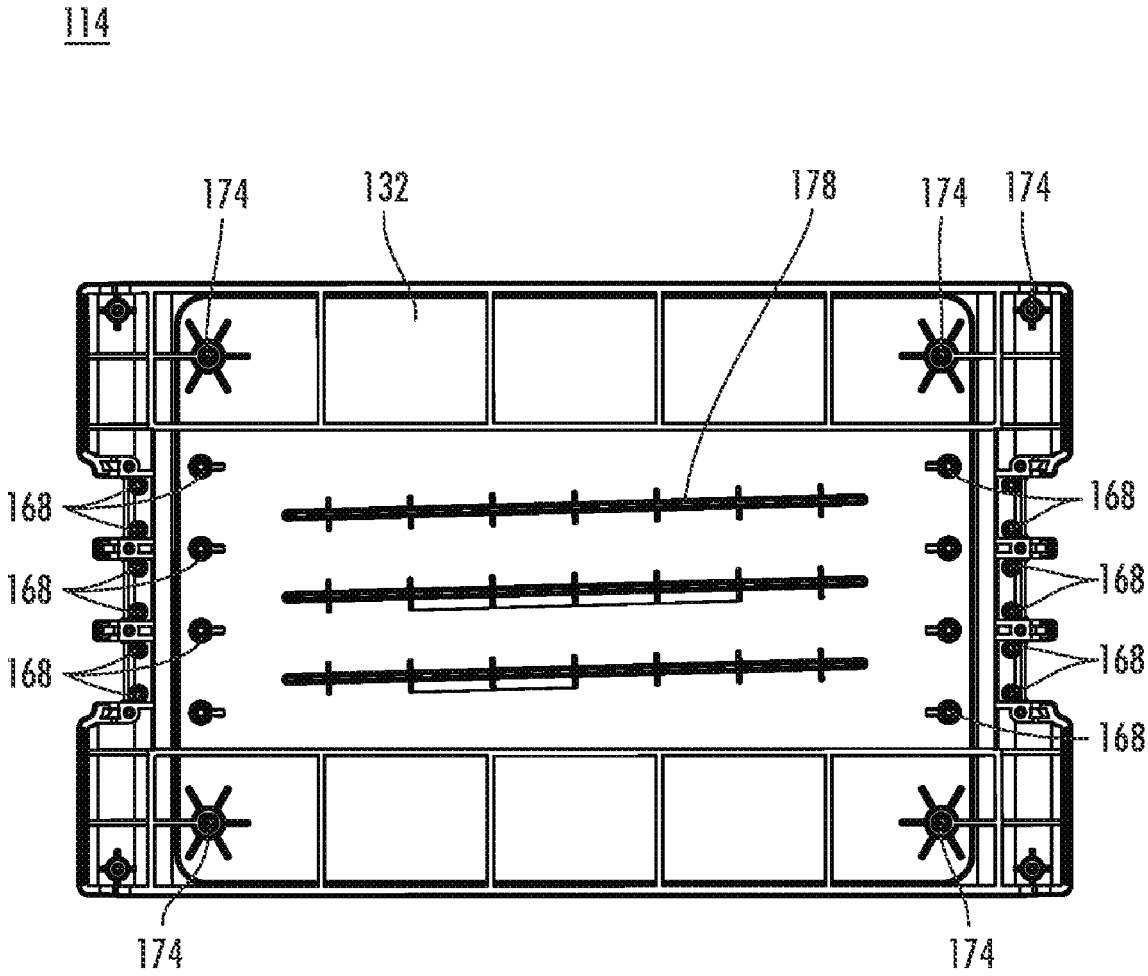
FIG. 29 is a plan view of a bottom of the stepping deck of FIG. 25.
Figure 30:
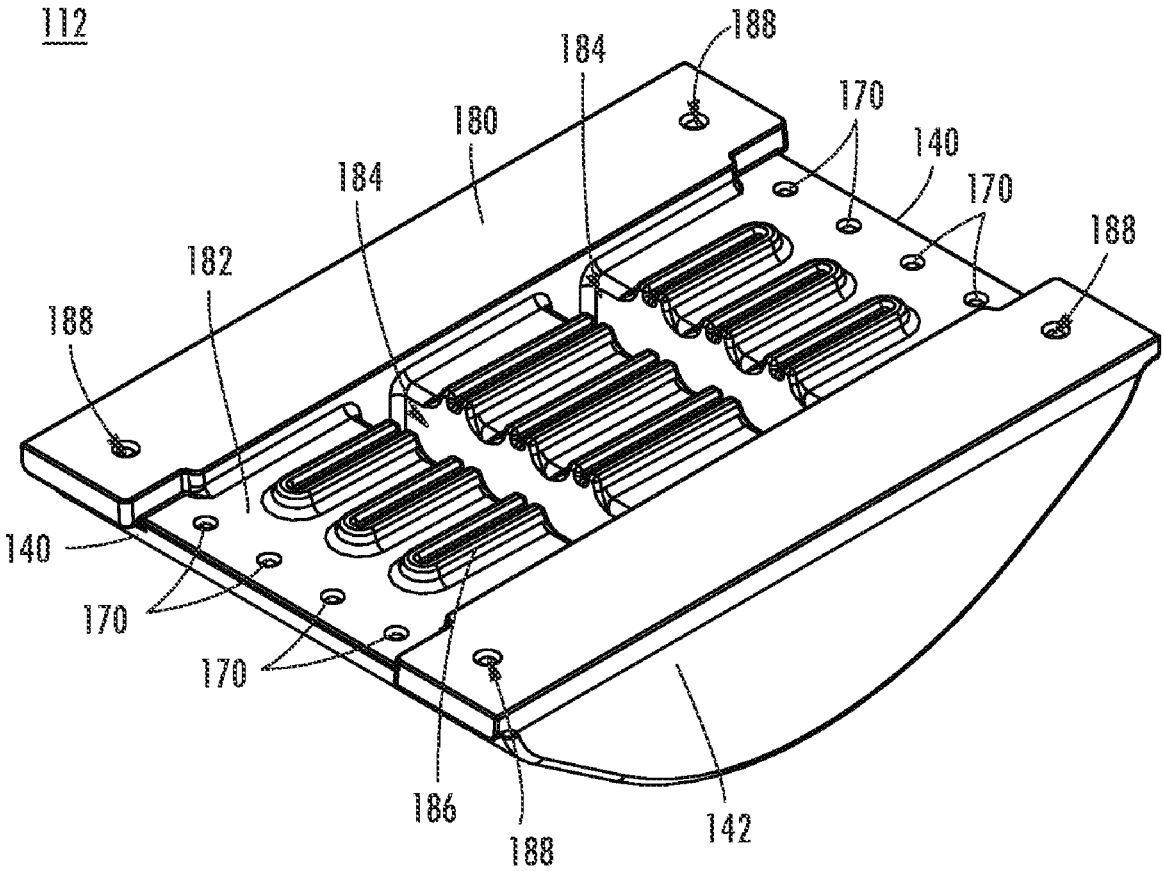
FIG. 30 is perspective view of an arched base of the exercise device of FIG. 18.

The stepping deck 114 has a generally planar stepping surface and includes sides 128, ends 130, an interior surface 132 (perhaps best seen in FIG. 29) and an exterior surface 134 (perhaps best seen in FIG. 19). Portions of the stepping deck 114 near side edges thereof curve toward a surface on which the exercise device 100 is placed and meet side edges of the arched base 112 when the platform 110 is assembled.

A cushioned pad 136 substantially covers the exterior surface 134 of the stepping deck 114 (as perhaps best seen in FIG. 19). The pad 136 is preferably approximately 3/16 inches thick. Further, it is preferably made from foam rubber, neoprene, or another non-skid, non-slip, cushioned material. The pad 136 aids in traction for a user stepping on the stepping deck 114.

The stepping deck 114 of the platform 110 itself further may have resilient characteristics similar to conventional step exercise apparatus, whereby the impact experienced by a user in stepping onto the platform may be lessened. The resilient characteristics are enabled by the material from which the stepping deck 114 as well as the structural configuration of the stepping deck 114. It is contemplated that the stepping deck 114 may be made from nylon, high density polyethylene, or some other material with similar characteristics. In addition, the hollow nature of the stepping deck 114 further enables the resilient characteristics.

The arched base 112 has a generally rectangular perimeter with sides 138 that are longer than ends 140 thereof. An exterior surface 122 of the arched base 112 includes a pair of arched portions 142 disposed adjacent sides 138 of the arched base 112. The exterior surface 122 further includes a recessed central portion 144 between the pair of arched portions 142. Non-skid pads 146 are disposed on the arched portions 142 of the arched base 112. The non-skid pads 146 are preferably made from foam rubber, neoprene, or another non-skid, non-slip material.

It is contemplated that the stepping deck 114, the arched base 112, or both, may include indicia indicating a trademark or brand of the exercise device 100. In the exemplary embodiment, the indicia is disposed on the exterior surface 122 of the arched base 112. One of ordinary skill in the art will understand that such trademark or brand indicia may be located anywhere on the exercise device 100 and still be within the scope of the present invention.

When assembled, the exercise device 100 may be used in the configuration shown in FIGS. 18-22, which is the stationary or stable configuration 190. In the stable configuration 190, the connection bars 108 are supported on a surface on which the exercise device 100 is placed, typically the ground, and the exercise device 100 is immobile when a user is positioned on the platform 110. In addition, the exterior surface 122 of the arched base 112 of the platform 110 is seated on and supported by the pair of support bars 124 and does not engage the ground.

Alternatively, the exercise device 100 may be used in an unstable configuration. To achieve this configuration, the platform 110 is removed from and used without the frame 102. In this respect, the arched base 112 engages the ground and the stepping deck 114 is oriented for receiving a person thereon. The platform 110, due to the arched base 112, is thereby rendered unstable and is prone to rock back and forth when a user exerts a force on the stepping deck 114.

Another unstable configuration of the exercise device 100 includes use of both the platform 110 and the frame 102. In this respect, the platform 110 is removed from the frame 102 and the frame 102 is turned upside down and is placed onto the stepping deck 114. More particularly, the support cross bars 124 of the frame 102 are inserted into the grooves 125 of the stepping deck 114, which grooves 125 are dimensioned to receive the support cross bars 124 in frictional snap-fit manner therein. The platform 110 remains in the same orientation as in the stable configuration, i.e., only the frame 102 is inverted. In this unstable configuration, the arched portions 142 of the arched base 112 are supported on the ground such that the exercise device 100 rocks from side to side when a user exerts force on the exercise device 110, whether such force is on the stepping deck 114 or on the connection bars 108.

The stepping deck 114 and the arched base 112 are connected by a pair of end caps 148 disposed at the ends 130,140 of the stepping deck 114 and arched base 112, respectively. The end caps 148 are identical; therefore, only one will be described in detail.

Figure 23:
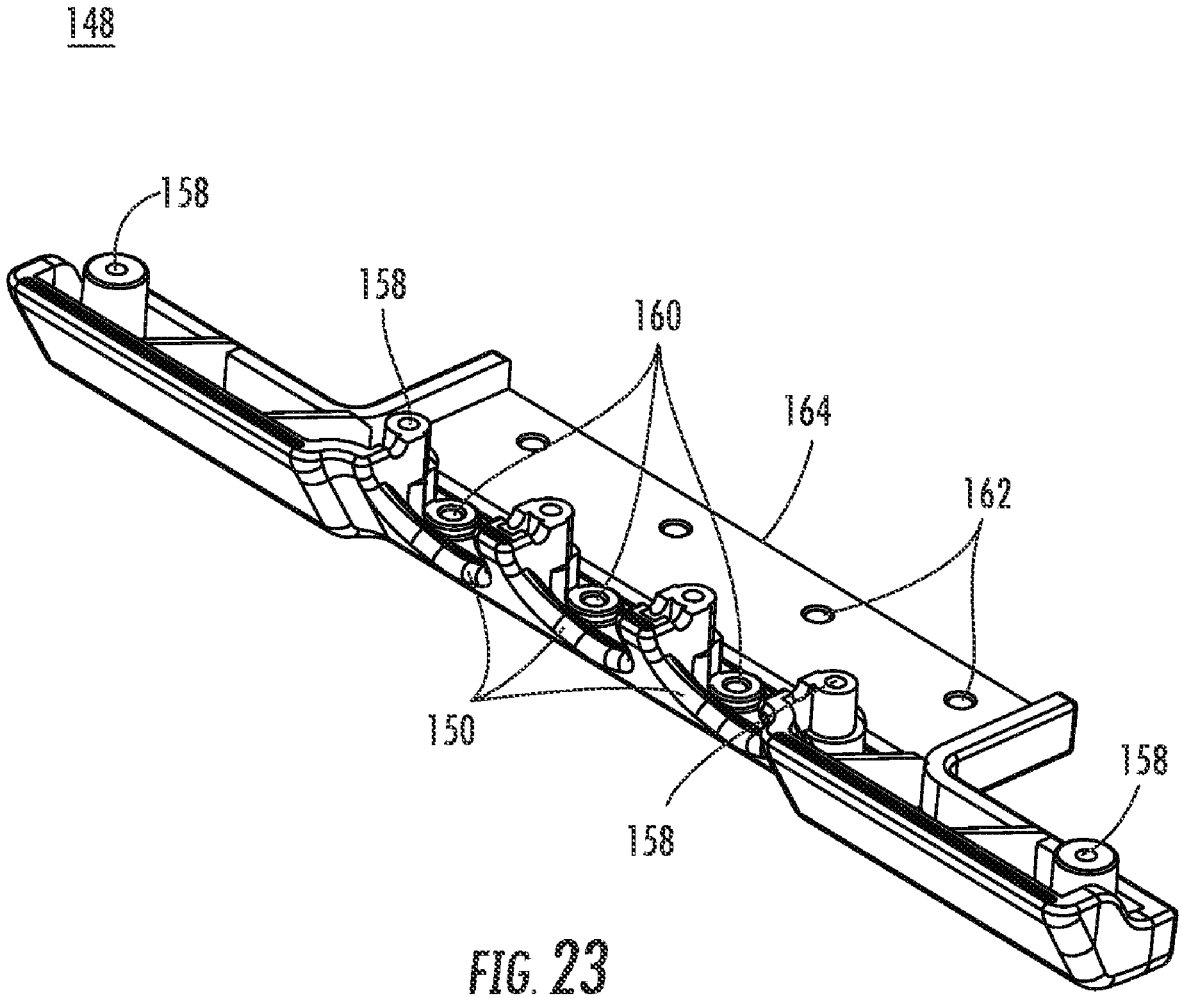
FIG. 23 is a perspective view of an end cap of the exercise device of FIG. 18.
Figure 24:
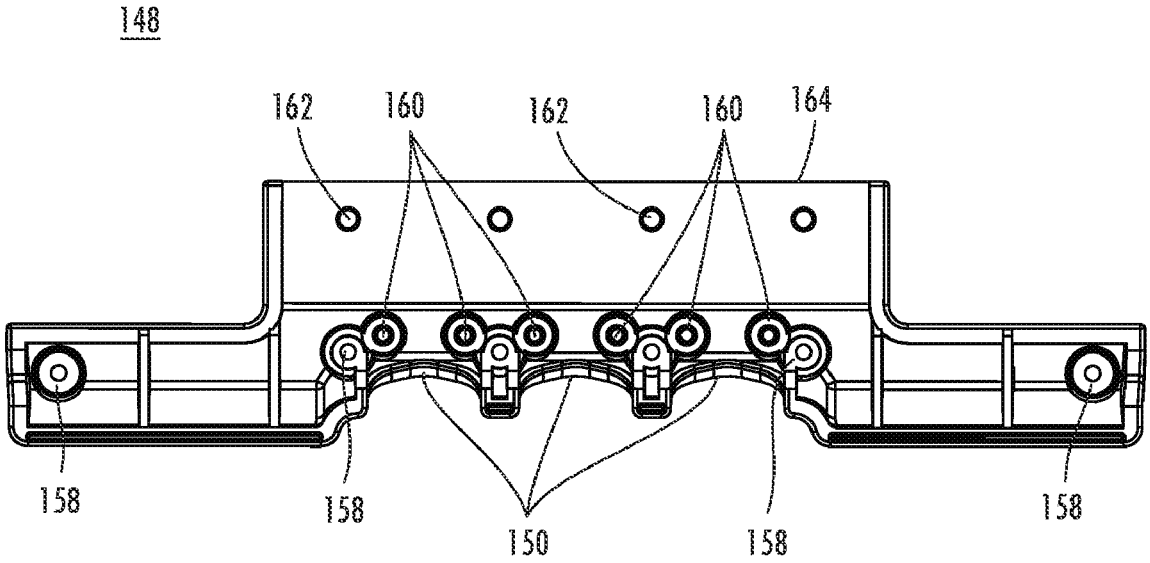
FIG. 24 is a plan view of a top of the end cap of FIG. 23.
Figure 25:
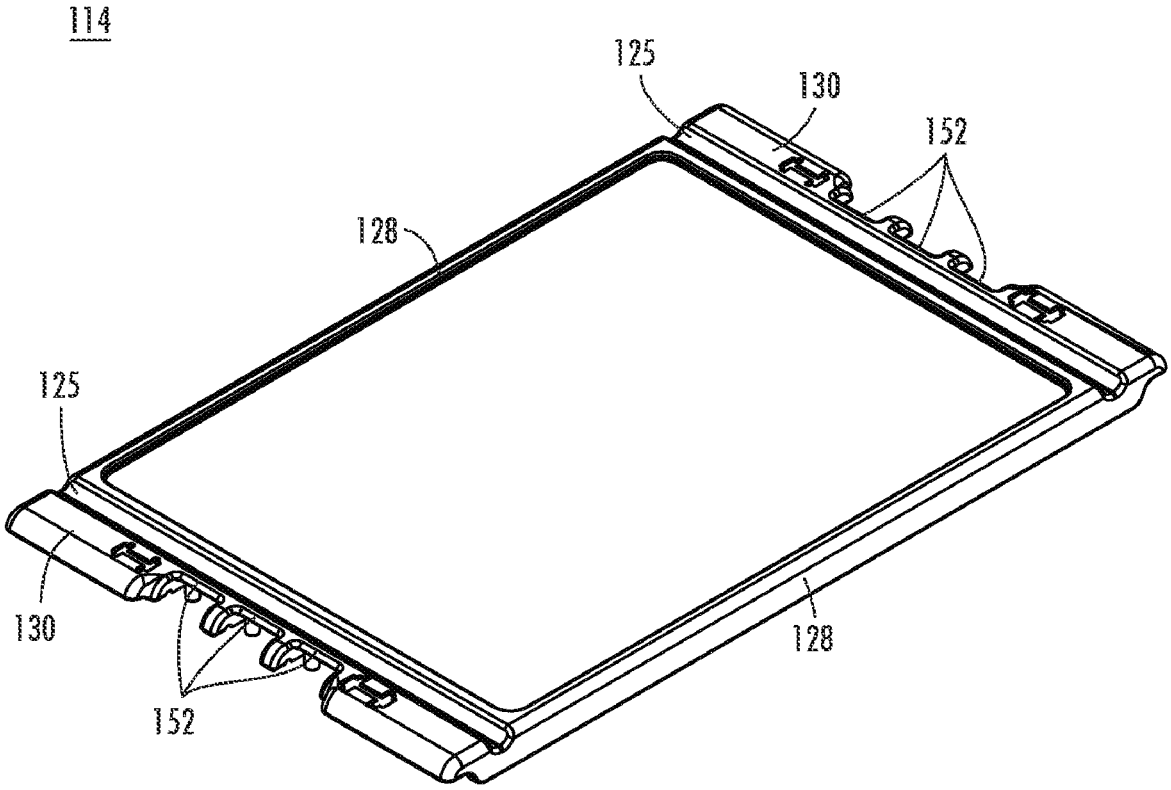
FIG. 25 is a perspective view of a stepping deck of the exercise device of FIG. 18.
Figure 26:
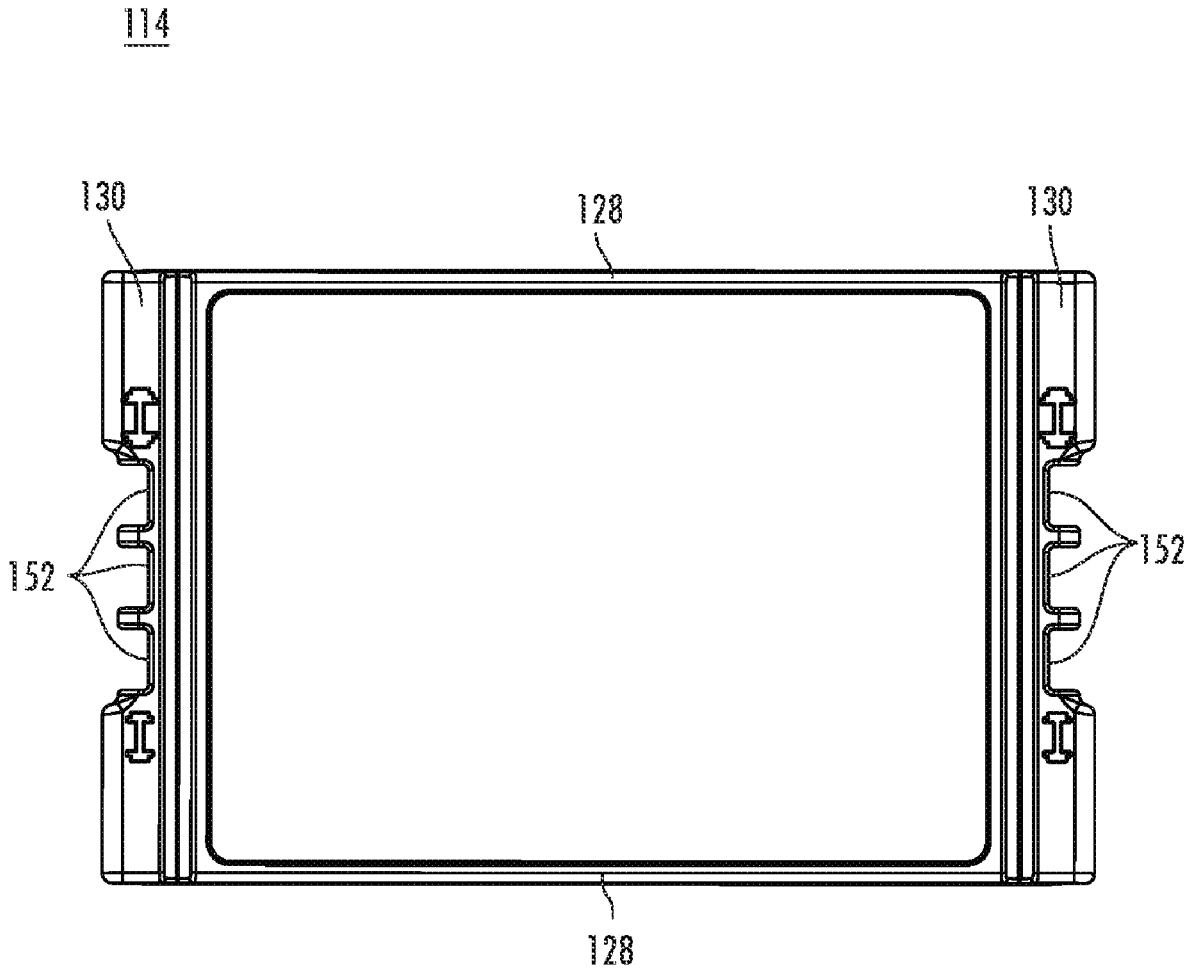
FIG. 26 is a plan view of a top of the stepping deck of FIG. 25.

As shown in FIGS. 23-24, the end cap 148 includes a plurality of curved indentations 150 that align with corresponding curved indentations 152 in the stepping deck 114 when the end caps 148 and stepping deck 114 are connected. The corresponding curved indentations 150,152 form openings 154 (perhaps best seen in FIG. 18) at ends 156 of the platform 110. In the embodiment shown herein, there are three curved indentations 150,152 in the end caps 148 and at each end 130 of the stepping deck 114, respectively, which results in three openings 154 at each end 156 of the platform 110 when the stepping deck 114 and end caps 148 are connected. It will be understood that a platform 110 including more or fewer openings 154 than those shown in the exemplary embodiment are within the scope of the present invention.

Figure 27:
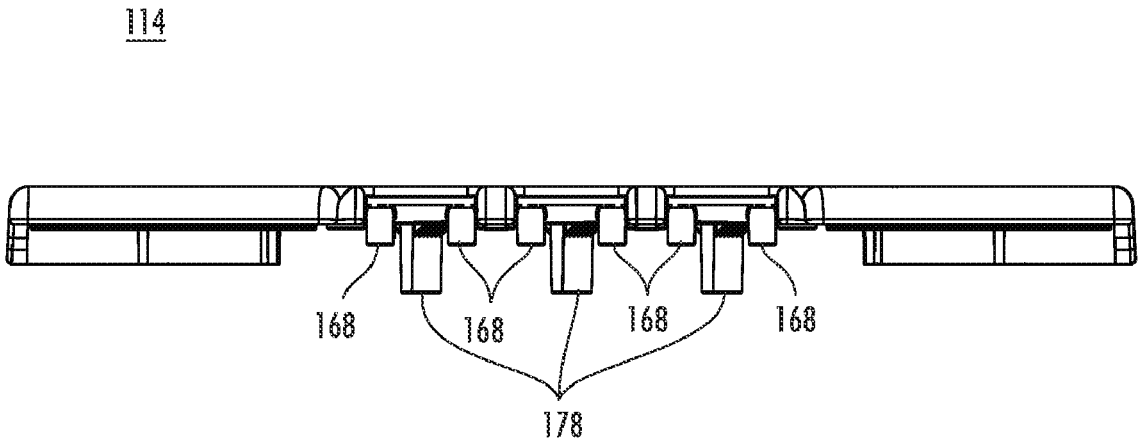
FIG. 27 is an elevational view of a side of the stepping deck of FIG. 25.
Figure 28:
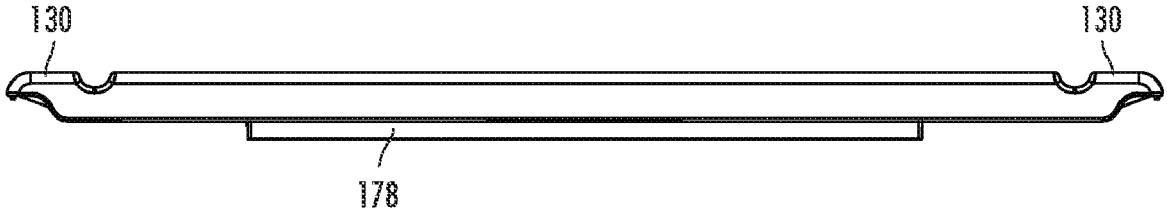
FIG. 28 is an elevational view of a front of the stepping deck of FIG. 25.
Figure 31:
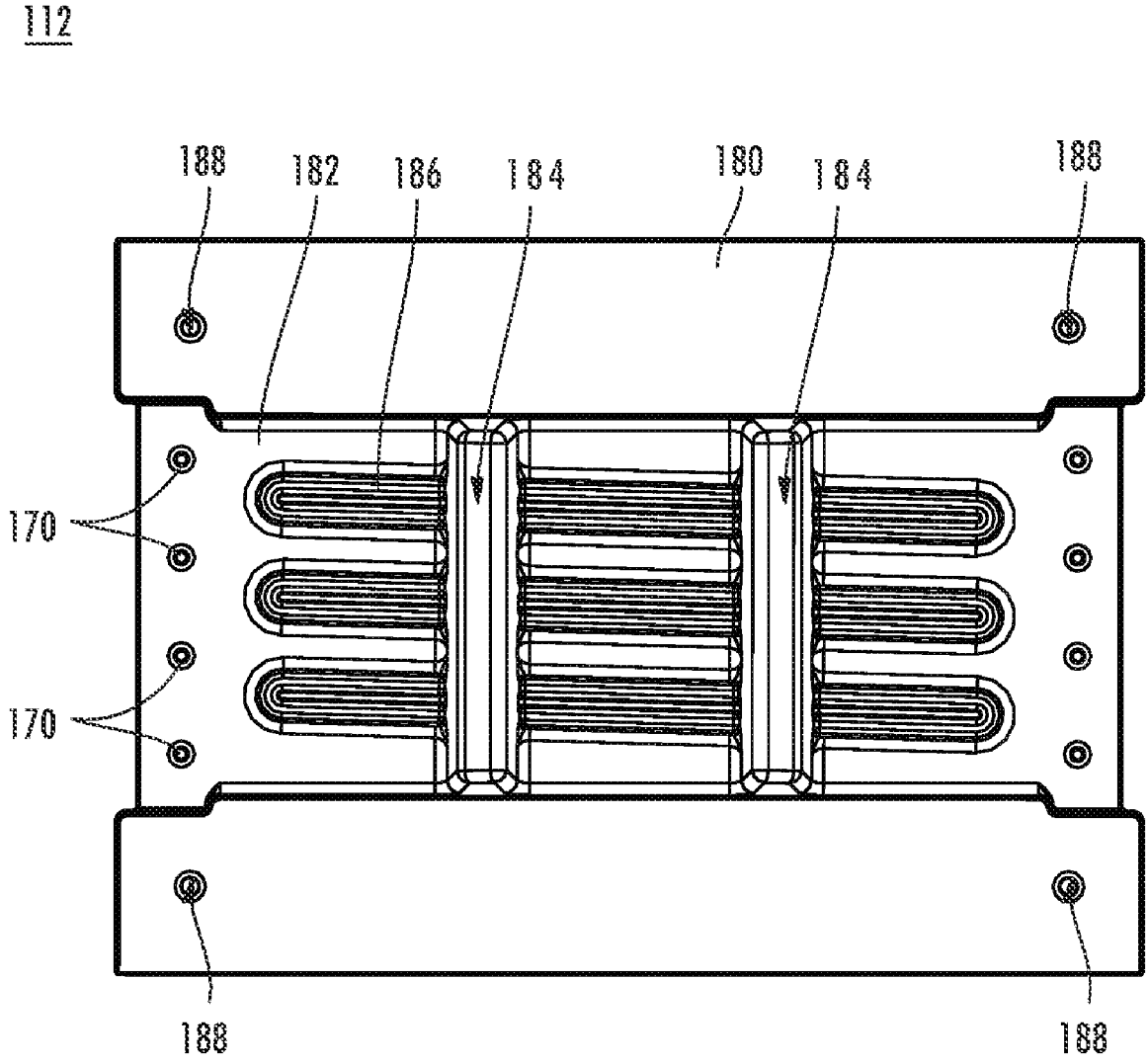
FIG. 31 is a plan view of a top of the arched base of FIG. 30.
Figure 32:
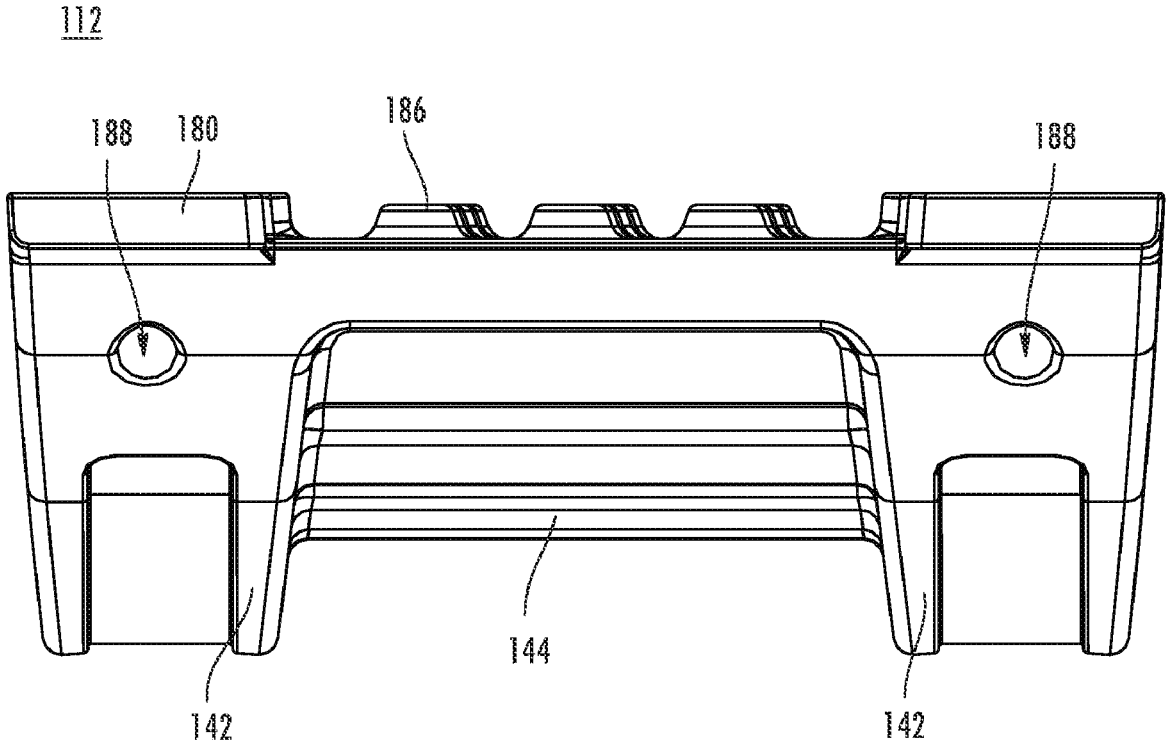
FIG. 32 is an elevational view of a side of the arched base of FIG. 30.
Figure 33:
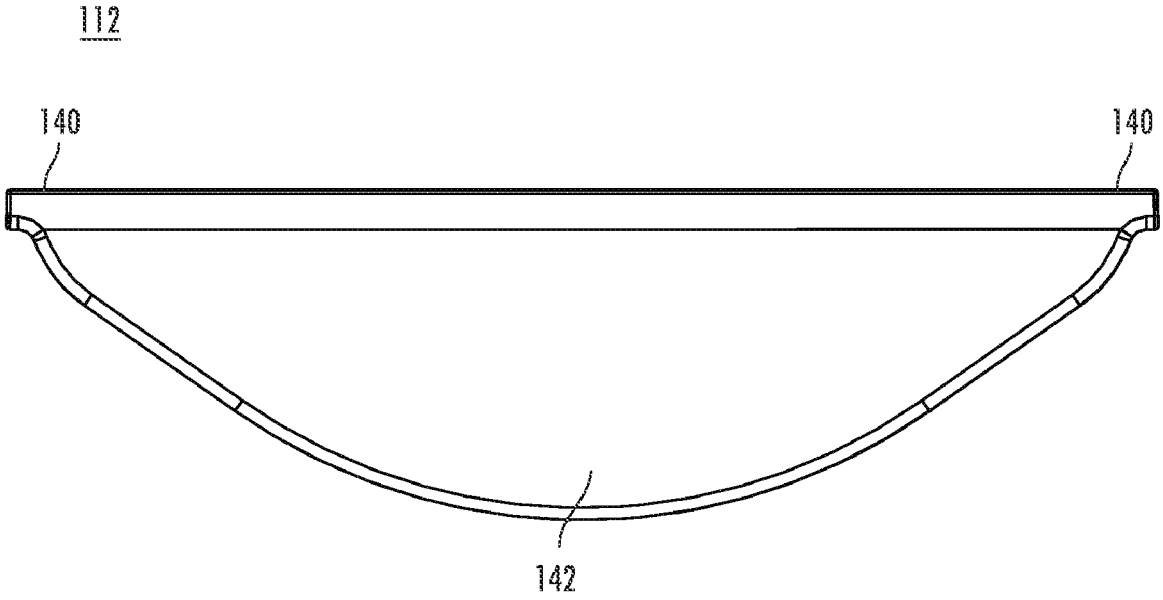
FIG. 33 is an elevational view of a front of the arched base of FIG. 30.
Figure 34:
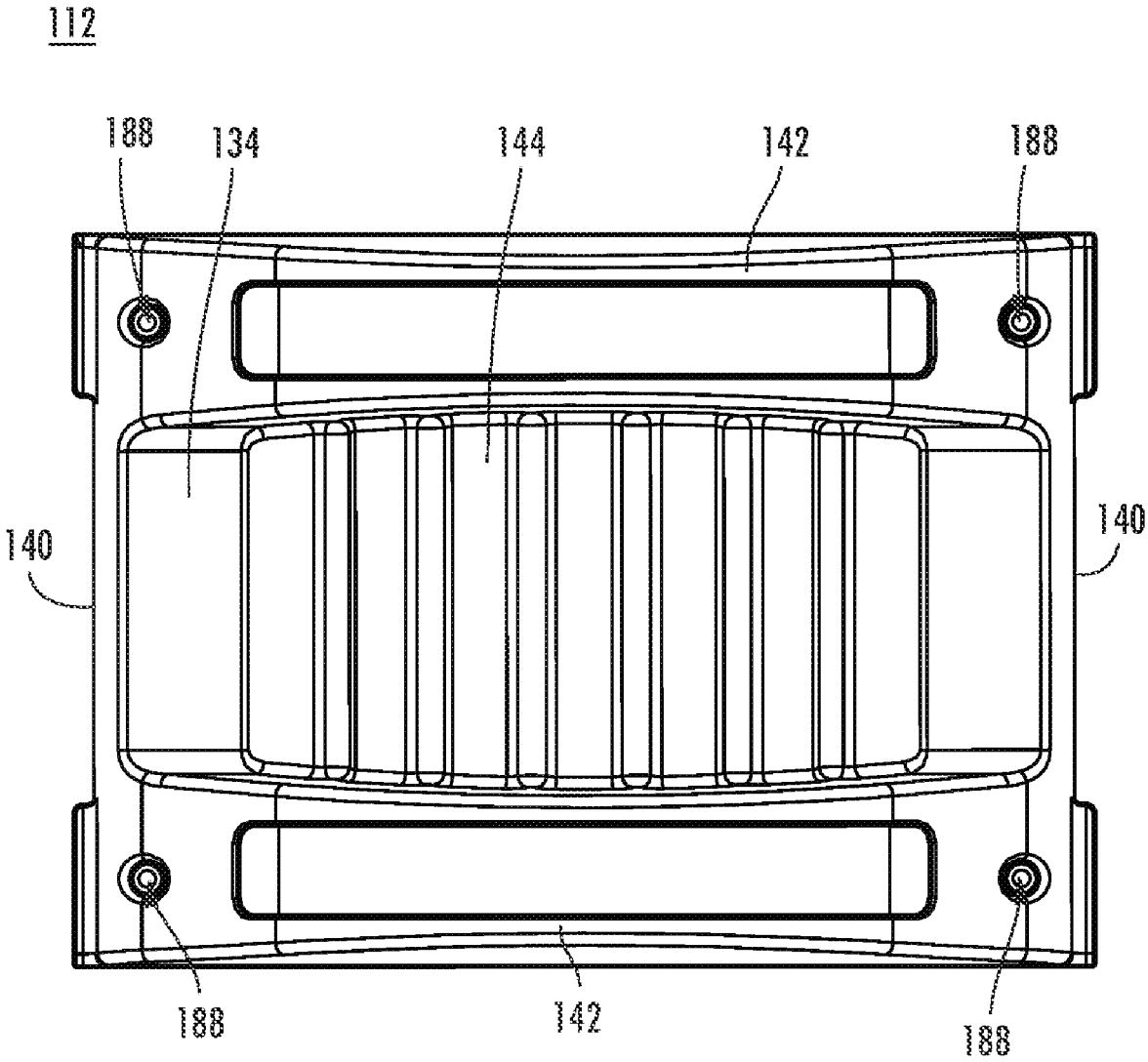
FIG. 34 is a bottom plan view of the arched base of FIG. 30.

The end cap 148 also includes a plurality of threaded apertures 158 and a plurality of shaft receiving recesses 160 and shaft receiving apertures 162. The threaded apertures 158 are disposed near corners of the end cap 148 near the curved indentations 150 of the end cap 148. The threaded apertures 158 receive binding members 176 (perhaps best seen in FIG. 35) for connecting the end cap 148 to the stepping deck 114. The shaft receiving apertures 162 are disposed near an edge 164 of the end cap 148. The shaft receiving apertures 162 provide an opening for pulley shafts 166 to pass through. The pulley shafts 166 (perhaps best seen in FIG. 35) are seated in shaft receiving knobs 168 (perhaps best seen in FIG. 27) of the stepping deck 114 and shaft recesses 170 (perhaps best seen in FIG. 31) of the arched base 112, which are described in greater detail below. The shaft receiving recesses 160 cooperate with a portion of the shaft receiving knobs 168 of the stepping deck 114 to receive and retain horizontal roller shafts 172 (perhaps best seen in FIG. 35) of the resistance band assembly 118, which will be described in greater detail below.

Turning to FIGS. 25-29, and with particular reference to the stepping deck 114, the stepping deck interior surface 132 includes a plurality of threaded knobs 174 projecting orthogonally therefrom. In the present embodiment, the plurality of threaded knobs 174 includes four threaded knobs disposed near four corners of the stepping deck interior surface 132. These four threaded knobs 174 receive threaded binding members 176 connecting the stepping deck 114 to the arched base 112. In addition, the plurality of threaded knobs 174 includes four threaded knobs 174 disposed adjacent four corners of the stepping deck 114 interior surface 132. These four threaded knobs 174 receive threaded binding members 176 connecting the stepping deck 114 to the end caps 148. The interior surface 132 also includes a plurality of shaft receiving knobs 168 projecting orthogonally therefrom. A portion of the shaft receiving knobs 168 cooperate with shaft recesses 170 of the arched base 112 to receive and retain pulley shafts 166 of the resistance band assembly 118, which will be described in greater detail below. In addition, a portion of the shaft receiving knobs 168 cooperate with shaft recesses 160 of the end caps 148 to receive and retain horizontal roller shafts 172 of the resistance band assembly 118, described in greater detail below.

The interior surface 132 further includes a plurality of ridges 178 projecting orthogonally therefrom. The plurality of ridges 178 are aligned lengthwise with the stepping deck 114.

Turning to FIGS. 30-34 and with particular reference to the arched base 112, the arched base 112 includes an interior surface 180. The interior surface 180 is generally planar and includes a recessed central portion 182 oriented lengthwise across the interior surface 180. A pair of further recessed ribs 184 transect the recessed central portion 182. The dimensions, location, and number of ribs 184 may be varied.

In addition, a plurality of raised slots 186 disposed orthogonally to the recessed ribs 184 are aligned along the central portion 182. The raised slots 186 mate with the ridges 178 of the stepping deck 114 when the platform 110 is assembled and serve to inhibit any relative rotational movement between the stepping deck 114 and the arched base 112.

A plurality of connection openings 188 are disposed at ends 140 of the arched base 112. More particularly, four connection openings 188 are disposed near four corners of the arched base 112. The connection openings 188 are aligned with the threaded knobs 174 of the stepping deck 114. The connection openings 188 and threaded knobs 174 receive threaded binding members 176 connecting the arched base 112 with the stepping deck 114 when the platform 110 is assembled.

The arched base 112 further includes a plurality of shaft recesses 170 disposed at ends 140 thereof. More particularly, four shaft recesses 170 transect the recessed central portion 182 near either end 140 of the arched base 112. As indicated previously, the shaft recesses 170 cooperate with the shaft receiving knobs 168 of the stepping deck 114 to receive and retain pulley shafts 166 of the resistance band assembly 118, which will be described in greater detail below.

Figure 35:
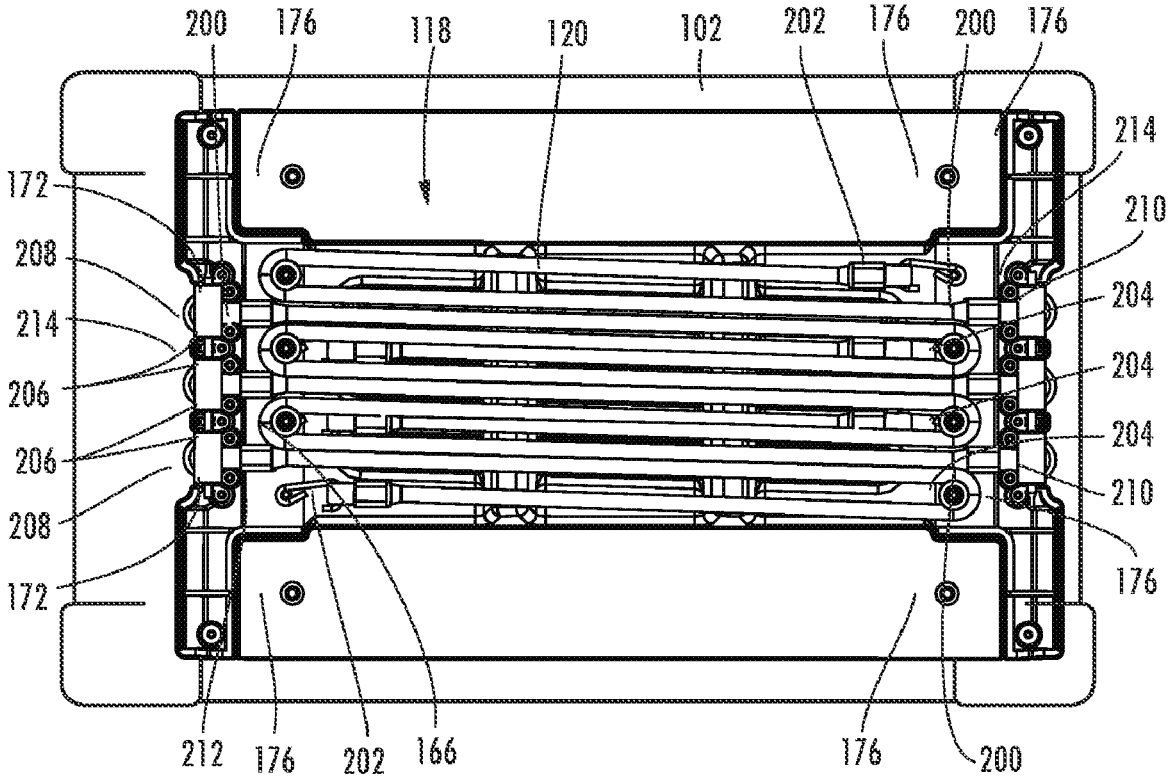
FIG. 35 is a plan view of a top of the exercise device of FIG. 18 with the stepping deck having been removed.
Figure 36:
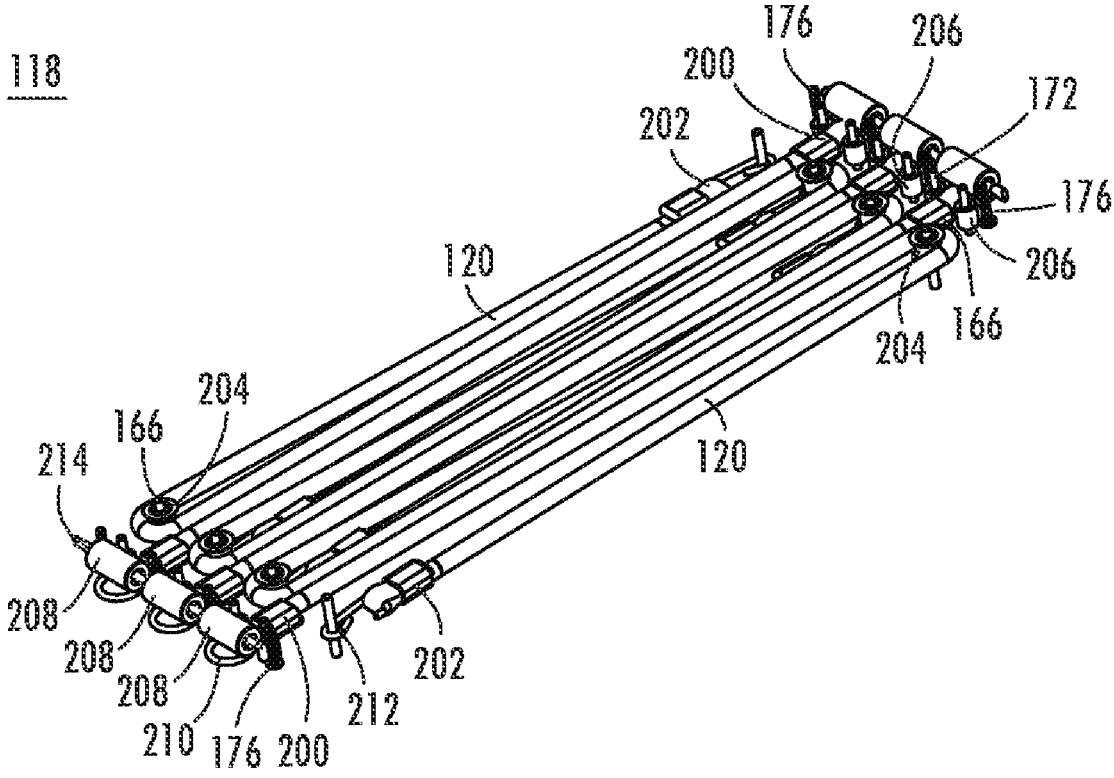
FIG. 36 is a perspective view of a resistance band assembly of the exercise device of FIG. 18.
Figure 37:
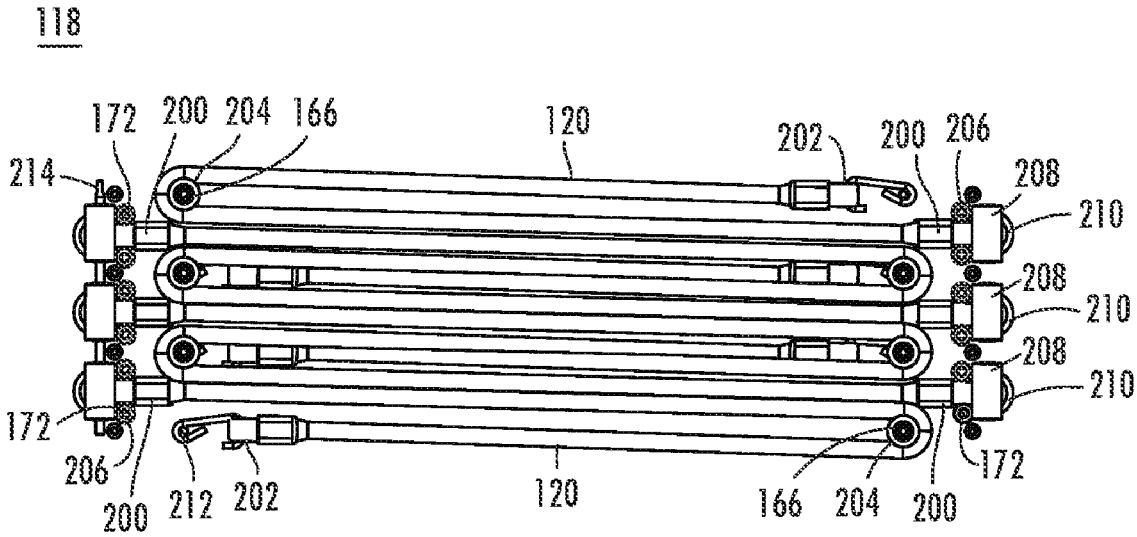
FIG. 37 is a plan view of a top of the resistance band assembly of FIG. 36.
Figure 38:
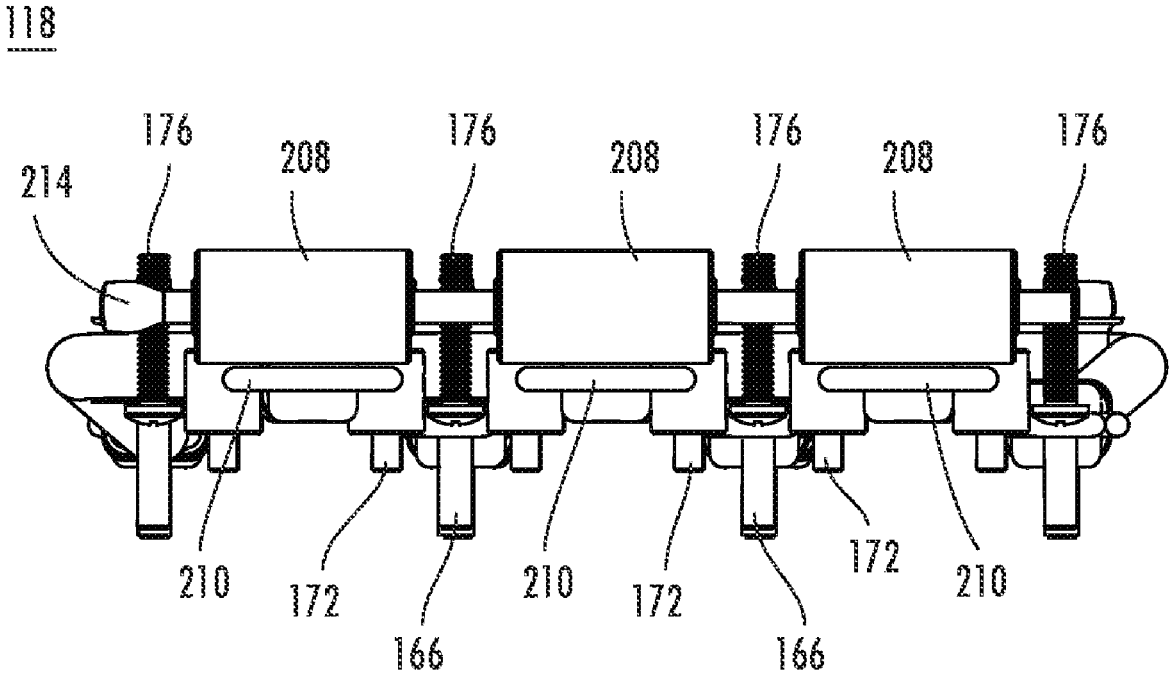
FIG. 38 is an elevational view of a side of the resistance band assembly of FIG. 36.
Figure 39:
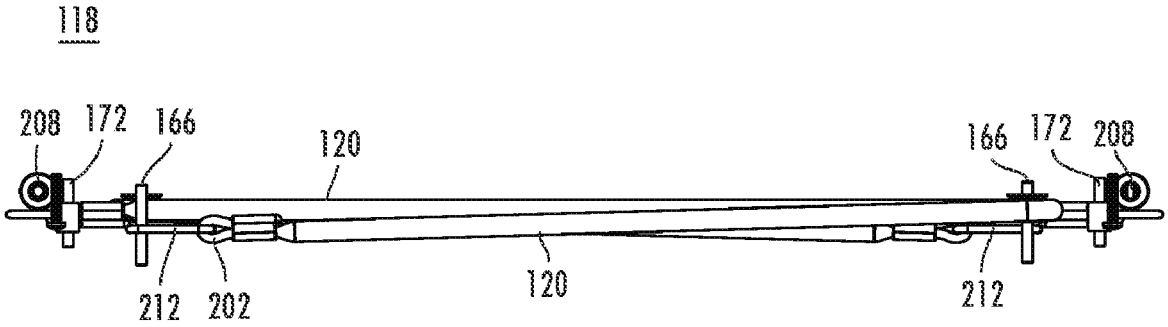
FIG. 39 is an elevational view of a front of the resistance band assembly of FIG. 36.
Figure 40:
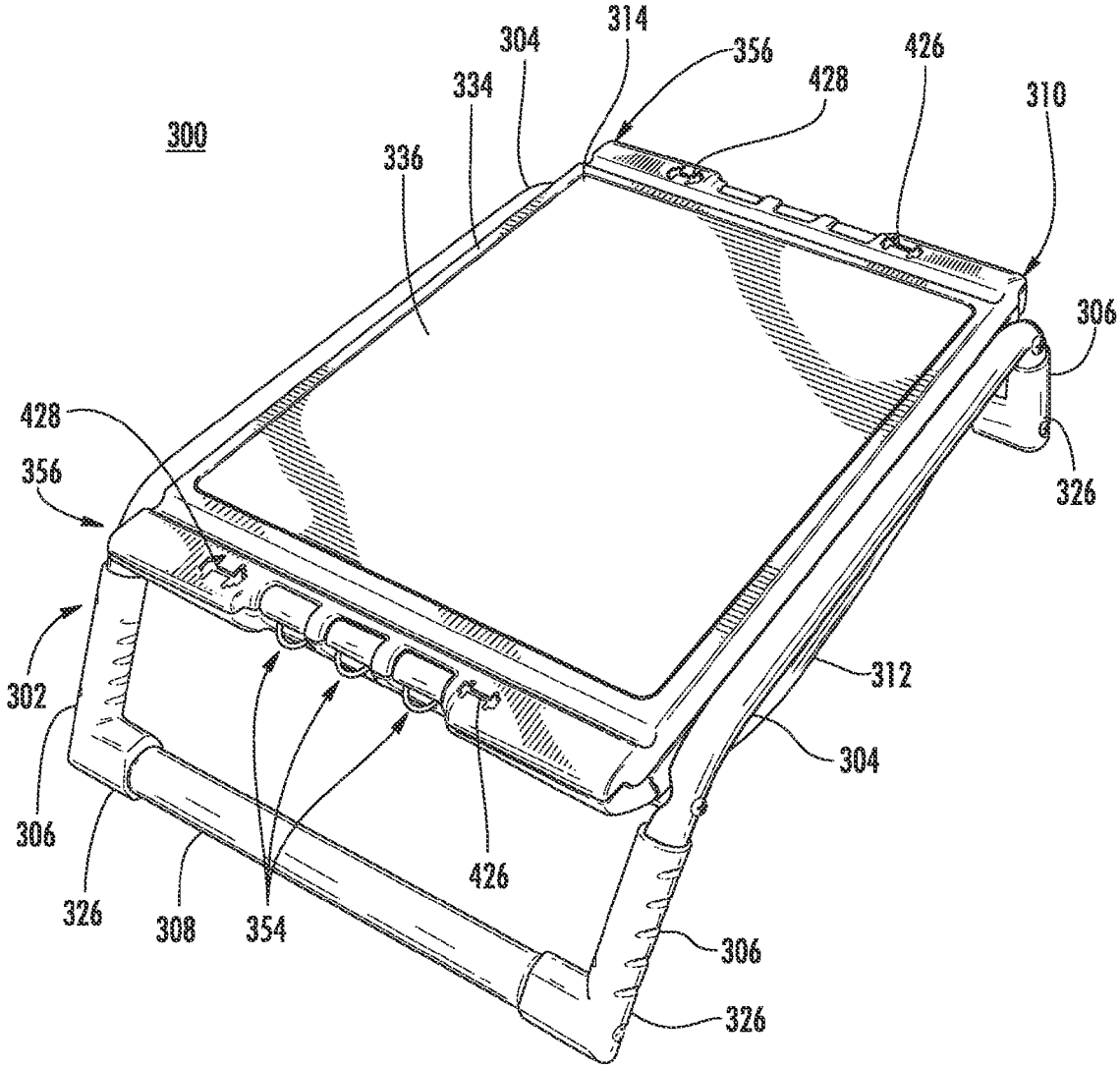
FIG. 40 is a perspective view of an exercise device in accordance with a third preferred embodiment of the present invention.
Figure 41:
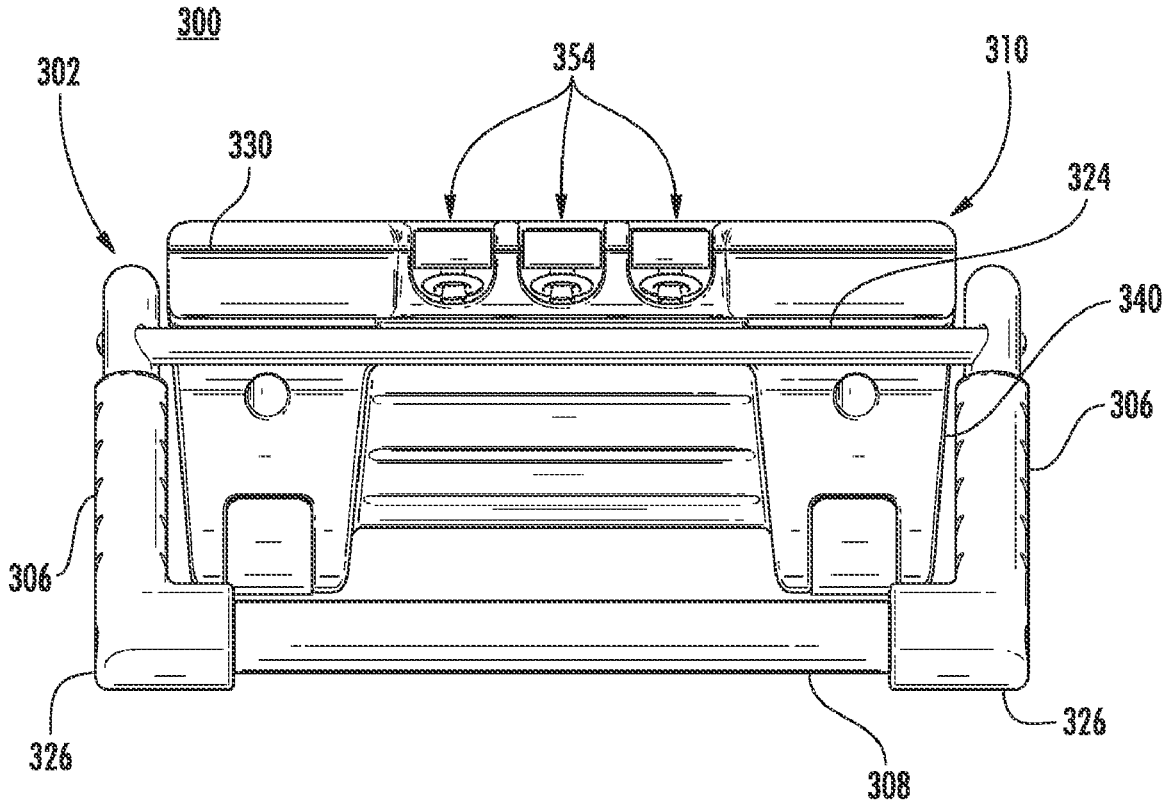
FIG. 41 is an elevational view of a side of the exercise device of FIG. 40.

With particular reference to the resistance band system including the resistance band assembly 118, FIG. 35 shows the exercise device 100 with the stepping deck 114 removed for clarity in viewing the resistance band assembly 118. As with the first preferred embodiment, an end 200 of each of the plurality of resistance bands 120 is disposed exterior to the platform 110 so that the user may easily access the resistance band 120. More particularly, an end 200 of each of the plurality of resistance bands 120 exits the interior of the platform 110 through one of the openings 154 at the ends 156 of the platform 110. Each resistance band 120 exits through a designated opening 154 with only one resistance band 120 exiting through each opening 154, therefore, the number of resistance bands 120 corresponds to the number of openings 154. In this exemplary embodiment, there are six resistance bands 120 and six openings 154 with each resistance band 120 having a particular opening 154 through which to exit the platform interior.

It furthermore is contemplated that the resistance bands 120 at each end of the platform will have varying resistances so that varying amounts of strength or exertion are needed to engage and expand the respective resistance bands 120, and that each end of the platform will have a plurality of resistance bands that are the same as the plurality of resistance bands at the other end of the platform. Such varying resistance at respective ends of the platform may be accomplished by varying the thickness of the resistance bands, with a resistance band having a relatively greater thickness requiring more force to expand than a resistance band having a relatively lesser thickness. In addition, it is contemplated that a user can combine more than one resistance band when using the exercise device to add further versatility to a workout using the exercise device.

It is further contemplated that indicia indicating the relative strength or resistance levels of the resistance bands 120 may be included on the platform 110. In the exemplary embodiment shown, the indicia include schematic barbells of relatively smaller and larger sizing to indicate the direction of increasing resistance levels of the resistance bands 120.

FIGS. 36-40 show various views of the resistance band assembly 118 apart from the exercise device 100. The resistance band assembly 118 is primarily housed within the interior 116 of the platform 110. The resistance band assembly 118 includes the plurality of resistance bands 120, a plurality of pulleys 204, and a plurality of rollers 206,208.

Each of the resistance bands 120 has an attachment ring 210 at an exit end 200 thereof and a hook 212 at an anchor end 202 thereof. The hook 212 is used to anchor the resistance band 120 to one of a plurality of pulley shafts 166 within the interior 116 of the platform 110. The attachment ring 210 is used to enable a user of the exercise device 100 to more easily access the resistance bands 120. For example, a user may attach a handle or strap to the attachment ring 210 of the resistance band 120 using a carabineer or other mechanism. Additionally, a user may attach a handle or strap to multiple resistance bands 120 in order to add further versatility to the functionality of the exercise device 100.

As indicated previously, each end 156 of the platform 110 has three resistance bands 120 exiting therefrom for a total of six resistance bands 120 available in the exercise device 100. The resistance bands 120 are connected with vertical pulley shafts 166 that are aligned at opposite ends 156 of the platform 110. More particularly, a plurality of vertical pulley shafts 166 transect the interior of the platform 110 at either end 156 thereof. The vertical pulley shafts 166 are seated at ends 156 of the platform 110 in the arched base 112 shaft receiving recesses 170 and the stepping deck 114 shaft receiving knobs 168. The vertical pulley shafts 166 also pass through the shaft receiving apertures 162 of the end caps 148.

The anchor end 202 of each resistance band 120 is anchored to a pulley shaft 166 at the same end 156 of the platform 110 from which the exiting end 200 of the resistance band 120 exits. More particularly, following a single exemplary resistance band 120, the anchor end 202 of the resistance band 120 is anchored to a pulley shaft 166 at one end 156 of the platform 110. The resistance band 120 then travels longitudinally across the interior 116 of the platform 110 to a second pulley shaft 166 at the opposite end 156 of the platform 110. The resistance band 120 is partially wrapped around the second pulley shaft 166 such that the resistance band 120 makes approximately a 180° turn around the second pulley shaft 166. The second pulley shaft 166 has a pulley mechanism 204 disposed in surrounding relation thereto that freely rotates around the second pulley shaft 166. The pulley mechanism 204 enables the resistance band 120 to readily change direction around the second pulley shaft 166. After extending around the second pulley shaft 166 and its associated pulley mechanism 204, the resistance band 120 travels longitudinally back across the platform 110 in the opposite direction from which it initially transects the platform 110. The exiting end 200 of the resistance band 120 then exits the platform interior 116 through its designated opening 154.

A pair of vertical rollers 206 are disposed in the opening 154 on either side of the resistance band 120, and a horizontal roller 208 is disposed above the resistance band 120. Each of the vertical rollers 206 is supported by a vertical roller shaft 172 about which it rotates. The roller shaft 172 is seated between the shaft receiving recesses 160 of the end caps 148 and shaft receiving knobs 168 of the stepping deck 114. The horizontal rollers 208 are supported by a single horizontal roller shaft 214 about which they rotate. The roller shaft 214 is supported between the end cap 148 and the stepping deck 114. All of the horizontal rollers 208 at one end 156 of the platform 110 are supported by the same roller shaft 214. The rollers 206,208 facilitate more smooth movement of the resistance band 120 into and out of the interior 116 of the platform 110. The smooth movement makes exercising with the resistance band 120 more comfortable, i.e., less jerky. The rollers 206,208 also are believed to significantly increases the useful life of the resistance band 120 by reducing friction of the resistance band 120 at the opening 154 during expansion and contraction.

It is further noted that no horizontal roller is disposed below a resistance band 120, as the platform 110 has only one orientation for intended use during exercising; this is in contrast to the platform 12 of the exercise device 10. Moreover, it is contemplated that the exercise device 10 may include vertical rollers located on either side of the resistance bands 120 in the exercise device 10.

Each of the six resistance bands 120 follows the path described above for an exemplary resistance band 120. As such, the resistance band assembly 118 includes six pulley mechanisms 204, six pairs of vertical rollers 206, and six horizontal rollers 208.

Because the platform 110 has three resistance bands 120 exiting (and initiating) from one end 156 and three resistance bands 120 exiting (and initiating) from the opposite end 156, there is some functional overlap for the shafts 166. More particularly, for four of the resistance bands 120, the anchor pulley shaft 166 for a first resistance band 120 also serves as the second pulley shaft 166 for a second resistance band 120 that initiates at the opposite end 156 of the platform 110 from the first resistance band 120. The resistance bands 120 are arranged in the resistance band assembly 118 such that the functional overlap of the pulley shafts 166 does not interfere with the functionality of the resistance bands 120. Rather the arrangement of the resistance band assembly 118 enables maximum functionality while maintaining a compact size, which is desirable for the exercise device 100.

Like the exercise device 10, the exercise device 100 can be used in either a steady or stable configuration 190; or an unsteady or unstable configuration. In the stable configuration 190, a user may sit, stand, or lie on the platform 110 to perform various exercise movements including cardiovascular exercises, strength training exercises, and/or stretching exercises. The user may engage the resistance bands 120 on either end 156 of the platform 110 by grasping handles attached thereto and pulling the resistance bands 120. The user may pull the resistance bands 120 with his or her hands. In addition, the user may pull the resistance bands 120 with his or her legs using straps extending around his or her foot or ankle. As indicated previously, the resistance bands 120 may have varying resistances thereby enabling a versatile exercise experience. In addition, more than one resistance band 120 may be joined together at a handle or strap to further add to the versatility of the exercise device 100.

In an unstable configuration of the exercise device 100 with the frame 102 inverted, a user also may sit, stand, or lie on the platform 110 to perform various exercise movements, or a user may engage the frame 102 in supporting himself or herself above the platform 110, such as when performing such as rocking pushups. The exercise device 100 is unstable in this configuration and tends to rock from side to side due to the engagement of the arched base 112 with the ground. This rocking motion is believed to aid in strengthening a user's core muscles and in improving a user's balance. The resistance bands 120 may be used in the unstable configuration in the same way in which they would be used in the stable configuration 190.

In addition, because the frame 102 and the platform 110 are removably coupled, the platform 110 of the exercise device 100 may be used in exercises without the frame 102, and the frame 102 may be used in exercises without the platform 110. That is, the user may engage the frame 102 of the exercise device 100 with his hands to perform various exercises without interacting with the platform 110. Similarly, the user may engage the platform to perform various exercises without interacting with the frame 102.

A Third Preferred Embodiment

FIGS. 40-44 show various views of an exercise device 300 in accordance with a third preferred embodiment of the present invention. The structural design of the exercise device 300 is very similar to that of the exercise device 100, and the exercise device 300 represents the intended commercial embodiment of the present invention. The minor structural differences will be apparent from contrasting of the drawings.

Irrespective of the exercise device 100, the exercise device 300 includes a frame 302 and a platform 310. The frame 302 includes a pair of side rails 304 and a pair of connection bars 308 disposed at ends 306 of the side rails 304. The rails 304 are disposed a fixed distance from one another, and the connection bars 308 are disposed a fixed distance from one another. The connection bars 308 are oriented generally orthogonally in relation to planes defined by the pair of side rails 304 and are fixedly attached to the ends 306 of the side rails 304 to form the frame 302. The rails 304 have a modified arcuate shape with relatively level central portions and curved end portions. Vertical planes defined by the rails 304 are disposed generally orthogonally to a surface on which the exercise device 300 is placed, typically the ground.

The connection bars 308, the intersection of the connection bars 308 and the rails 304, and the end portions 306 of the rails 304 are encased in a covering 326. The covering 326 helps to inhibit slipping of the exercise device 300 when it is in use. The covering 326 also provides an easily graspable surface for a user to grip when the exercise device 300 is in use. It is contemplated that the covering 326 will be made from a non-marking, non-slip, soft, but durable material. Examples of possible materials include, but are not limited to, neoprene, rubber, or a low cost thermoplastic elastomer.

The frame 302 also includes a pair of support cross bars 324 disposed near the transition between the curved end portions and level central portions of the rails 304. The support cross bars 324 are arranged in a parallel orientation with the connection bars 108 and serve to support the platform 310 when the platform 310 is received by the frame 302. To this end, the platform 310 includes groves within which the support cross bars 324 are received in frictional snap-fit manner when the platform 310 is supported by the frame 302. In particular, as perhaps best shown in FIG. 43, the platform 310 is positioned between the rails 304 and is supported by the pair of support cross bars 324 disposed near the transition between the curved end portions and level central portions of the rails 304. The platform 310 thereby is supported on, and is separable from, the frame 302.

Figure 53:
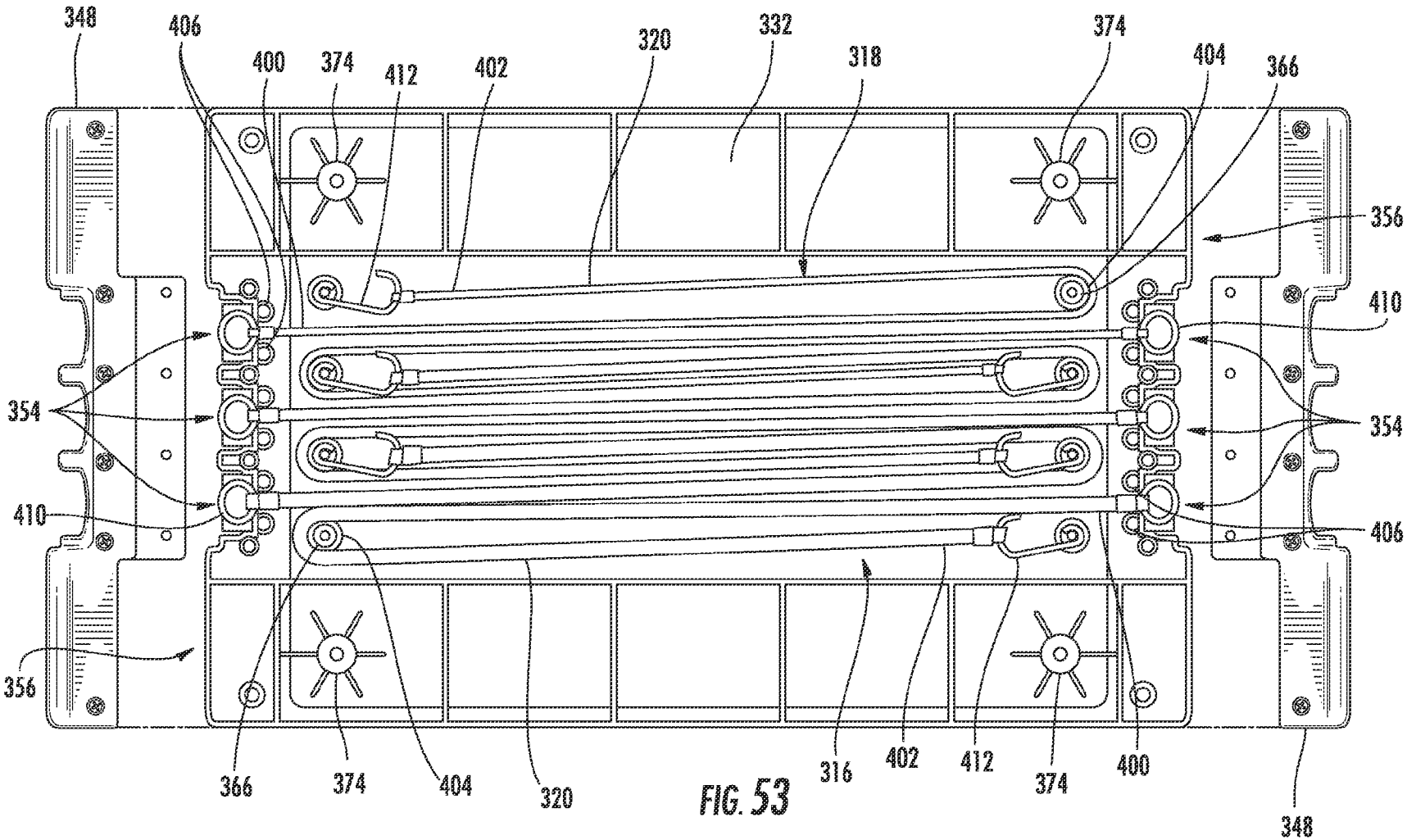
FIG. 53 is a plan view of a bottom of a stepping deck of the platform of FIG. 48, shown with end caps removed and the resistance band assembly situated therein.

With particular regard to the platform 310, the platform 310 comprises an arched base 312 and a stepping deck 314 that are removably fastened together to define an enclosed interior space 316 therebetween (perhaps best seen in FIG. 53). The exercise device 300 also includes a resistance band system housed within the platform 310 that includes a resistance band assembly 318 (perhaps best seen in FIG. 53) having a plurality of resistance bands 320. The plurality of resistance bands 320 are partially disposed within the interior space 316 of the platform 310 and have ends 400,402 that are disposed exterior to the platform 310 for easy access by a user.

The platform 310 and, in particular, the stepping deck 314, may have resilient characteristics similar to conventional step exercise apparatus, whereby the impact experienced by a user in stepping onto the stepping deck of the platform may be lessened. The resilient characteristics are enabled by the material from which the platform 310 is made and the configuration of the platform 310. It is contemplated that the stepping deck 314 may be made from nylon, high density polyethylene, or some other material with similar characteristics.

The stepping deck 314 has a generally planar stepping surface and includes sides 328, ends 330, an interior surface 332 and an exterior surface 334. Portions of the stepping deck 314 near side edges thereof curve toward a surface on which the exercise device 300 is placed and meet side edges of the arched base 312 when the platform 310 is assembled.

A cushioned pad 336 substantially covers the exterior surface 334 of the stepping deck 314. The pad 336 is preferably approximately 3/16 inches thick. Further, it is preferably made from foam rubber, neoprene, or another non-skid, non-slip, cushioned material. The pad 336 may be permanently attached to the exterior surface 334 or removably secured thereto. The pad 336 aids in traction for a user stepping on the stepping deck 314. In variations, the pad may include a loose granular material or fluid for providing additional instability when the platform 310 is used.

Figure 55:
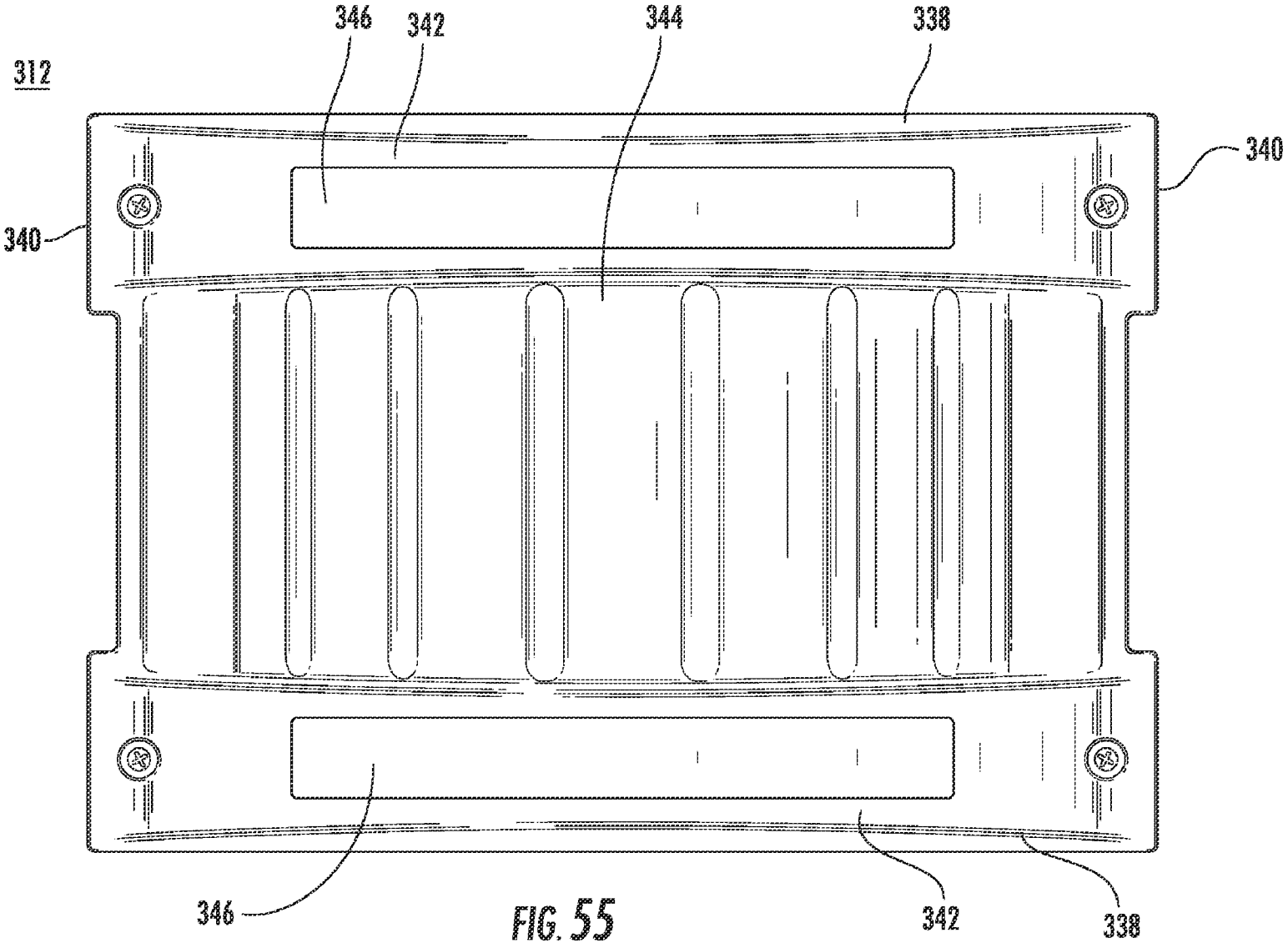
FIG. 55 is a plan view of a bottom of the arched base of the platform of FIG. 46.

The arched base 312 has a generally rectangular perimeter with sides 338 that are longer than ends 340 thereof. An exterior surface 322 of the arched base 312 includes a pair of arched portions 342 disposed adjacent sides 338 of the arched base 312. The exterior surface 322 further includes a recessed central portion 344 between the pair of arched portions 342. As shown in FIG. 55, non-skid pads 346 are disposed on the arched portions 342 of the arched base 312. The non-skid pads 346 are preferably made from foam rubber, neoprene, or another non-skid, non-slip material.

As shown in FIGS. 46-51, the platform 310 is fully detachable from and reattachable to the frame 302. In particular, the platform 310 may be separated from the frame and placed on the ground with the arched portions 342 of the arched base 312 supporting the platform 310. In this regard, the platform 310 is capable of rocking side to side when a user is positioned on the platform 310. Such rocking motion may aid in strengthening a user's core muscles and in improving a user's balance. Additionally, the resistance bands 320 may be used in the same way as they would be used when the platform 310 is supported by the frame 302.

Figure 46:
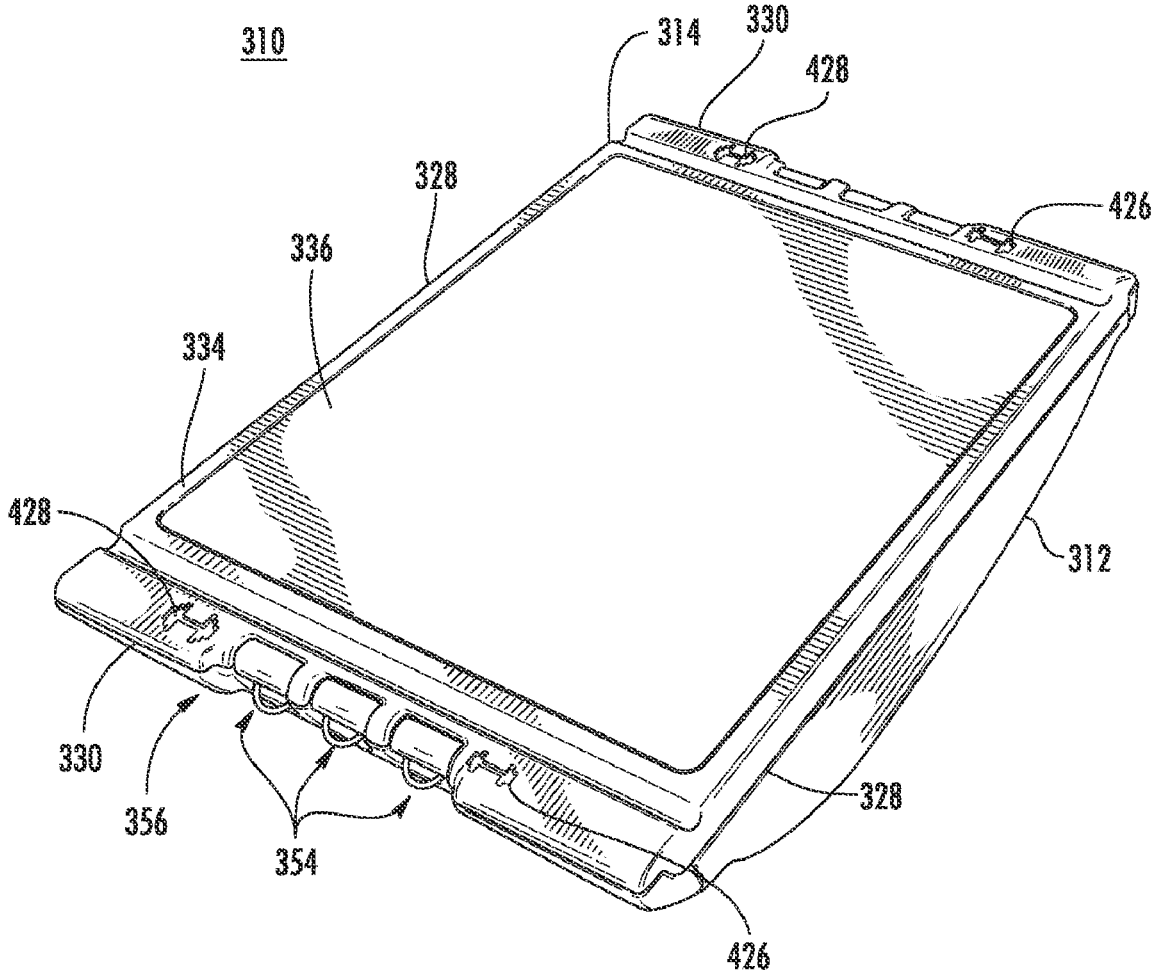
FIG. 46 is a perspective view of a platform of the exercise device of FIG. 40.
Figure 47:
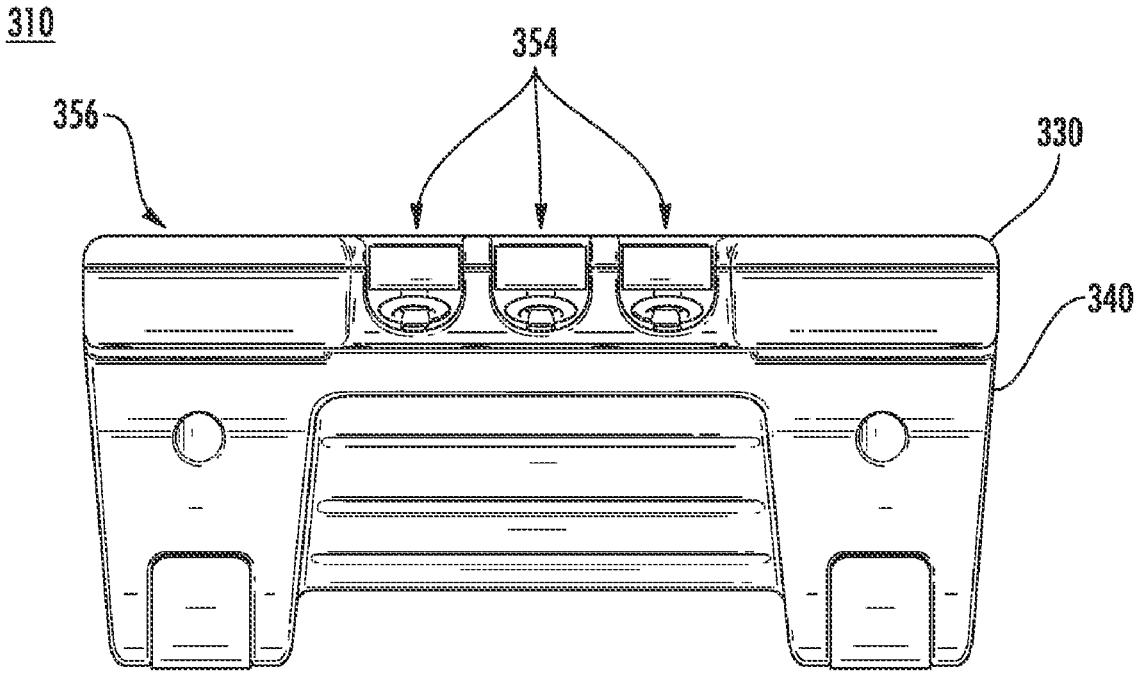
FIG. 47 is an elevational view of a side of the platform of FIG. 46.
Figure 54:
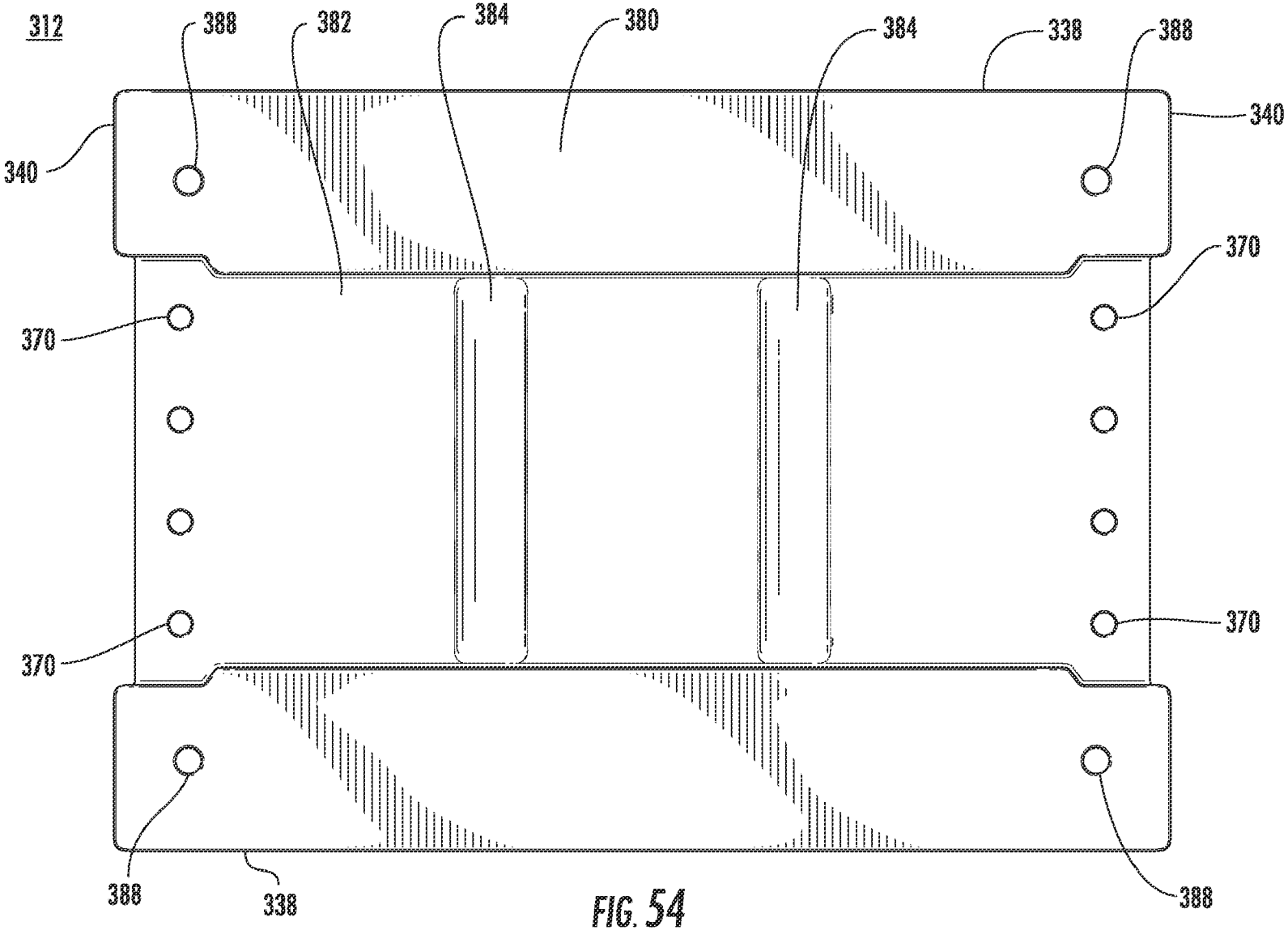
FIG. 54 is a plan view of a top of the arched base of the platform of FIG. 46.

FIG. 53 is a plan view of the bottom of the stepping deck 314 of the platform 310 of FIG. 46, shown with end caps 348 detached and displaced from the ends thereof and the resistance band assembly 318 situated therein. FIG. 54 is a plan view of the top of the arched base 314 of the platform 310 of FIG. 46. With particular reference to FIG. 54, the arched base 312 includes side surfaces 380 that are generally planar and an intermediate surface 382 having a pair of recesses 384. The dimensions, location, and number of recesses 384 may vary in accordance with the present invention.

A plurality of connection openings 388 are disposed at ends 340 of the arched base 312. More particularly, four connection openings 388 are disposed near four corners of the arched base 312. The connection openings 388 are aligned with the threaded knobs 374 of the stepping deck 314 (as shown in FIG. 53). The connection openings 388 and threaded knobs 374 receive threaded binding members (not shown) that connect the arched base 312 with the stepping deck 314 when the platform 310 is assembled.

The arched base 312 further includes a plurality of shaft recesses 370 disposed at ends 340 thereof. More particularly, four shaft recesses 370 transect the recessed central portion 382 near either end 340 of the arched base 312. As indicated previously, the shaft recesses 370 cooperate with shaft receiving knobs (not shown) of the stepping deck 314 to receive and retain pulley shafts 366 of the resistance band assembly 318, as shown in FIG. 53.

With particular reference to FIG. 53, the resistance band assembly 318 is primarily housed within the interior 316 of the platform 310 between the stepping deck 314 and the arched base 312. As with the embodiments set forth above, an end 400 of each of the plurality of resistance bands 320 is disposed exterior to the platform 310 so that the user may easily access the resistance band 320.

The end caps 348, which connect to the stepping deck 314 of the platform 310, provide a series of openings 354 at the ends 356 of the platform. In particular, an end 400 of each of the plurality of resistance bands 320 exits the interior of the platform 310 through one of the openings 354 at the ends 356 of the platform 310.

Each resistance band 320 exits through a designated opening 354 with only one resistance band 320 exiting through each opening 354. In this regard, the number of resistance bands 320 corresponds to the number of openings 354. In this exemplary embodiment, there are six resistance bands 320 and six openings 354 with each resistance band 320 having a particular opening 354 through which to exit the platform interior 316.

Each of the resistance bands 320 has an attachment ring 410 at an exit end 400 thereof and a hook 412 at an anchor end 402 thereof. The hook 412 is used to anchor the resistance band 320 to one of a plurality of pulley shafts 366 within the interior 316 of the platform 310. The attachment ring 410 is used to enable a user of the exercise device 300 to more easily access the resistance bands 320.

Figure 45:
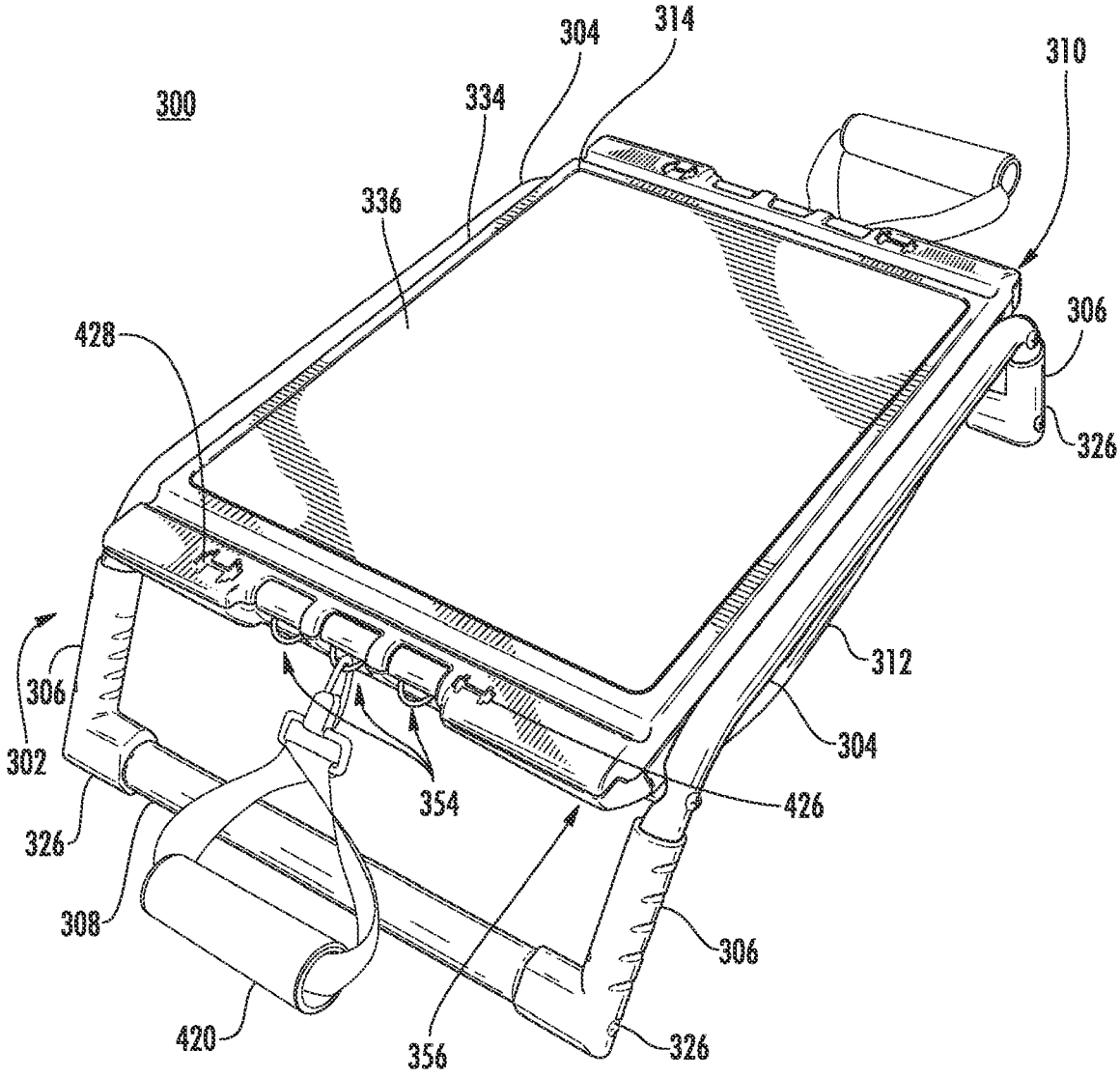
FIG. 45 is a perspective view of the exercise device of FIG. 40, shown with grasping members attached at opposite ends of the platform.
Figure 51:
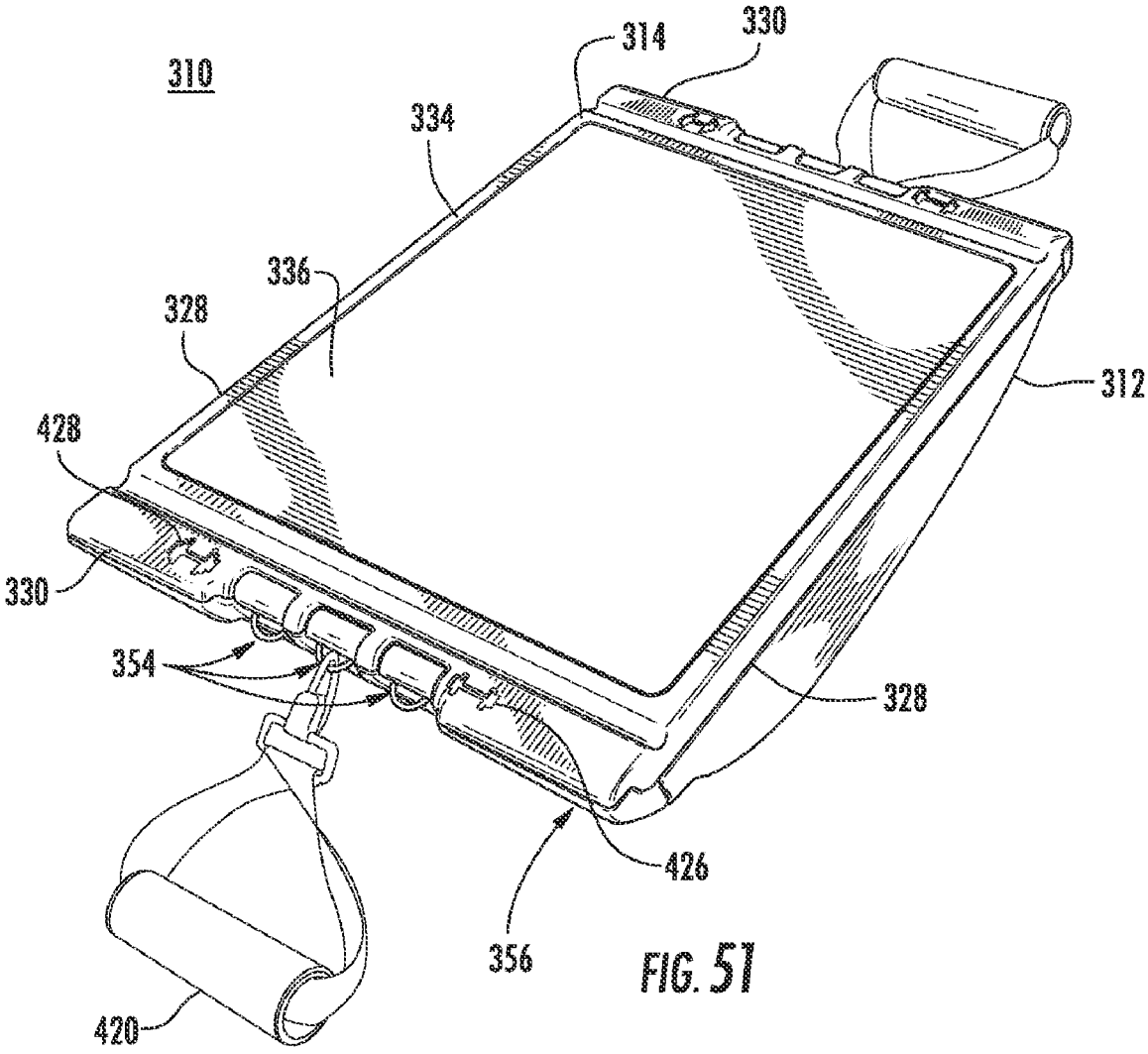
FIG. 51 is a perspective view of the platform of FIG. 46, shown with grasping members attached at opposite ends of the platform.

As shown in FIGS. 45 and 51, a user may attach a grasping member, such as a handle 420, to the end 400 of the resistance band 320 using the attachment ring 410. Additionally, a user may attach the handle 420 to multiple resistance bands 320 using the attachment rings 410 thereof in order to add further versatility to the functionality of the exercise device 300. The handle may be attached to one or more of the attachment rings using a carabineer or other mechanism.

Figure 52:
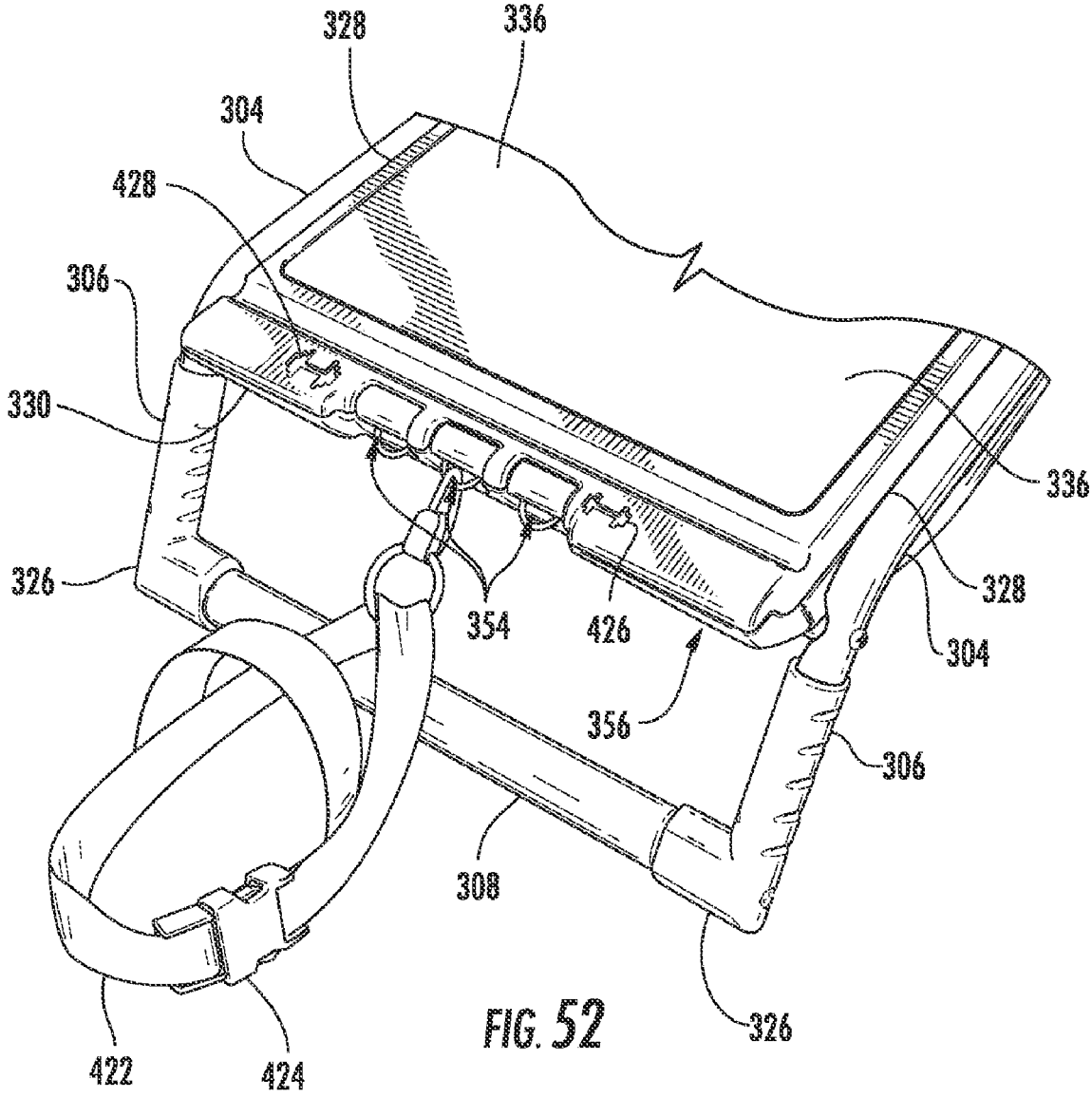
FIG. 52 is a perspective partial view of the exercise device of FIG. 40, shown with a strap attached at an end of the platform.

As shown in FIGS. 45 and 51, the handle 420 is a grasping member that may be most easily graspable by a user with his or her hands. However, it is also within the scope of the present invention that a grasping member attached to one or more attachment rings 410 may take any form that might be preferred to allow the user to grasp the member with other appendages, such as an arm or foot. For example, as shown in FIG. 52, the grasping member may be a strap 422 configured to wrap around or secure to the user's foot. As shown, the strap 422 may include a clasp 424 to secure the strap 422 into a proper use position and to permit adjustment of the strap 422.

As indicated above, each end 356 of the platform 310 has three resistance bands 320 exiting therefrom for a total of six resistance bands 320 available in the exercise device 300. The resistance bands 320 are connected with vertical pulley shafts 366 that are aligned at opposite ends 356 of the platform 310.

More particularly, a plurality of vertical pulley shafts 366 transect the interior of the platform 310 at either end 356 thereof. The anchor end 402 of each resistance band 320 is anchored to a pulley shaft 366 at the same end 156 of the platform 310 from which the exiting end 400 of the resistance band 320 exits.

Following a single exemplary resistance band 320, the anchor end 402 of the resistance band 320 is anchored to a pulley shaft 366 at one end 356 of the platform 310. The resistance band 320 then travels longitudinally across the interior 316 of the platform 310 to a second pulley shaft 366 at the opposite end 356 of the platform 310. The resistance band 320 is partially wrapped around the second pulley shaft 366 such that the resistance band 320 makes approximately a 180° turn around the second pulley shaft 366. The second pulley shaft 366 has a pulley mechanism 404 disposed in surrounding relation thereto that freely rotates around the second pulley shaft 366. The pulley mechanism 404 enables the resistance band 320 to easily change direction and turn around the second pulley shaft 166. After extending around the second pulley shaft 366 and its associated pulley mechanism 404, the resistance band 320 travels longitudinally back across the platform 310 in the opposite direction from which it initially transects the platform 310. The exiting end 400 of the resistance band 320 then exits the platform interior 316 through its designated opening 354.

Two vertical rollers 406 are disposed in the opening 354 on either side of the resistance band 320, and a horizontal roller 407 is disposed above the resistance band 320. Such rollers facilitate smooth expansion and contraction of the resistance band 320 out of and in to the interior 316 of the platform 310. The smooth movement makes exercising with the resistance band 320 more comfortable, i.e., less jerky. The rollers 406, 407 also are believed to significantly increases the useful life of the resistance band 320 by reducing friction of the resistance band 320 at the opening 354 during expansion and contraction.

Each of the six resistance bands 320 follows the path described above for an exemplary resistance band 320. Because the platform 310 has three resistance bands 320 exiting (and initiating) from one end 356 and three resistance bands 320 exiting (and initiating) from the opposite end 356, there is some functional overlap for the shafts 366. More particularly, for four of the resistance bands 320, the anchor pulley shaft 366 for a first resistance band 320 also serves as the second pulley shaft 366 for a second resistance band 320 that initiates at the opposite end 356 of the platform 310 from the first resistance band 320. The resistance bands 320 are arranged in the resistance band assembly 318 such that the functional overlap of the pulley shafts 366 does not interfere with the functionality of the resistance bands 320. Rather the arrangement of the resistance band assembly 318 enables maximum functionality while maintaining a compact size, which is desirable for the exercise device 300.

It furthermore is contemplated that the resistance bands 320 at each end of the platform will have varying resistances so that varying amounts of strength or exertion are needed to engage and expand the respective resistance bands 320, and that each end of the platform will have a plurality of resistance bands that are the same as the plurality of resistance bands at the other end of the platform. The resistance band assembly 318 shown in FIG. 53 includes resistance bands 320 having varying levels of resistance. Such varying resistance at respective ends of the platform is accomplished by varying the thickness of the resistance bands, with a resistance band having a relatively greater thickness requiring more force to expand than a resistance band having a relatively lesser thickness.

Preferably, the resistance bands 320 may be situated within the platform 310 according to the corresponding degree of resistance. In this regard, resistance bands 320 with the least resistance may be positioned toward the front of the platform 310, resistance bands 320 with an intermediate level of resistance may be positioned centrally, and resistance bands 320 with the greatest resistance may be positioned toward the rear of the platform 310.

Figure 42:
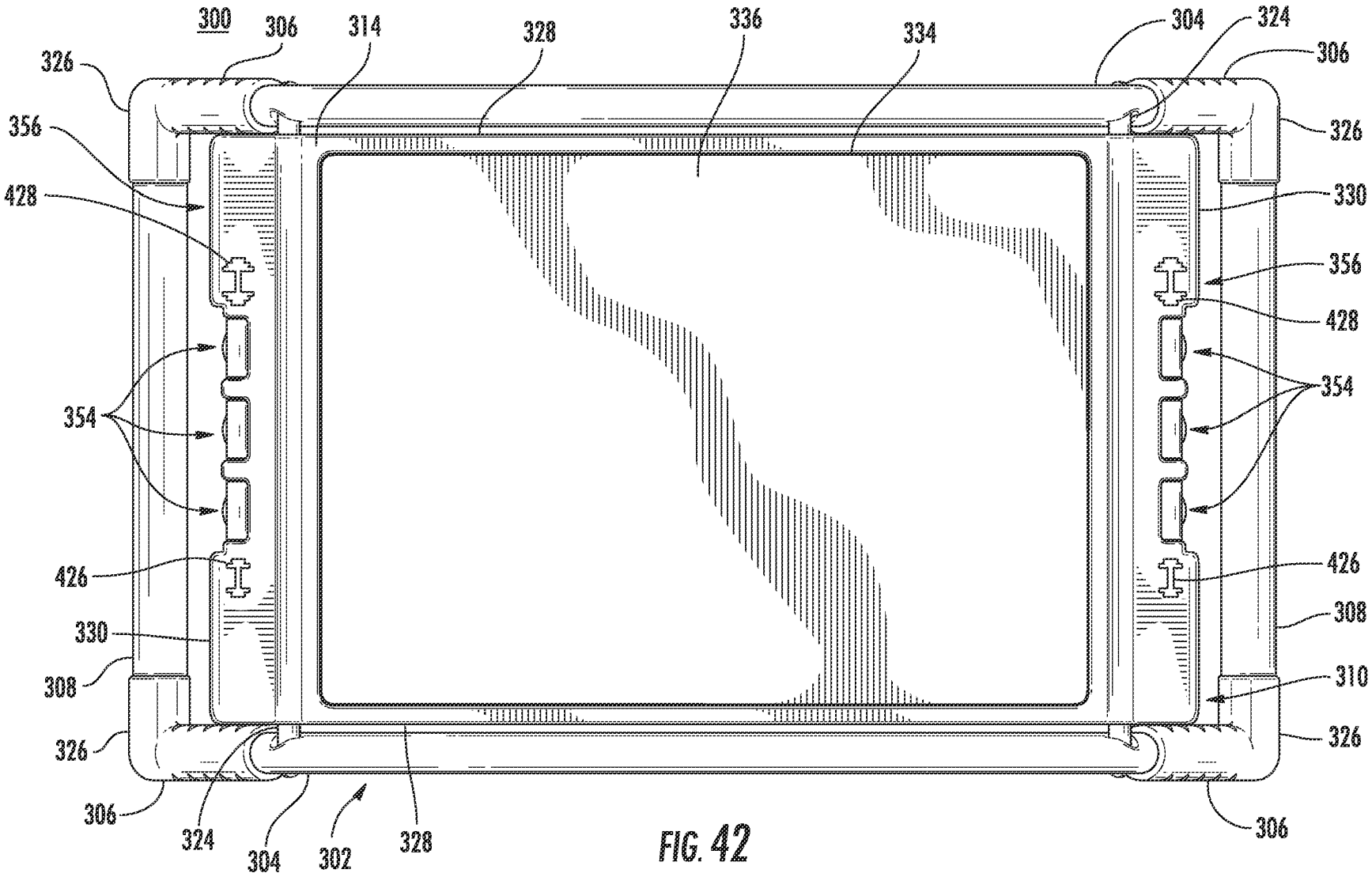
FIG. 42 is a plan view of a top of the exercise device of FIG. 40.
Figure 43:
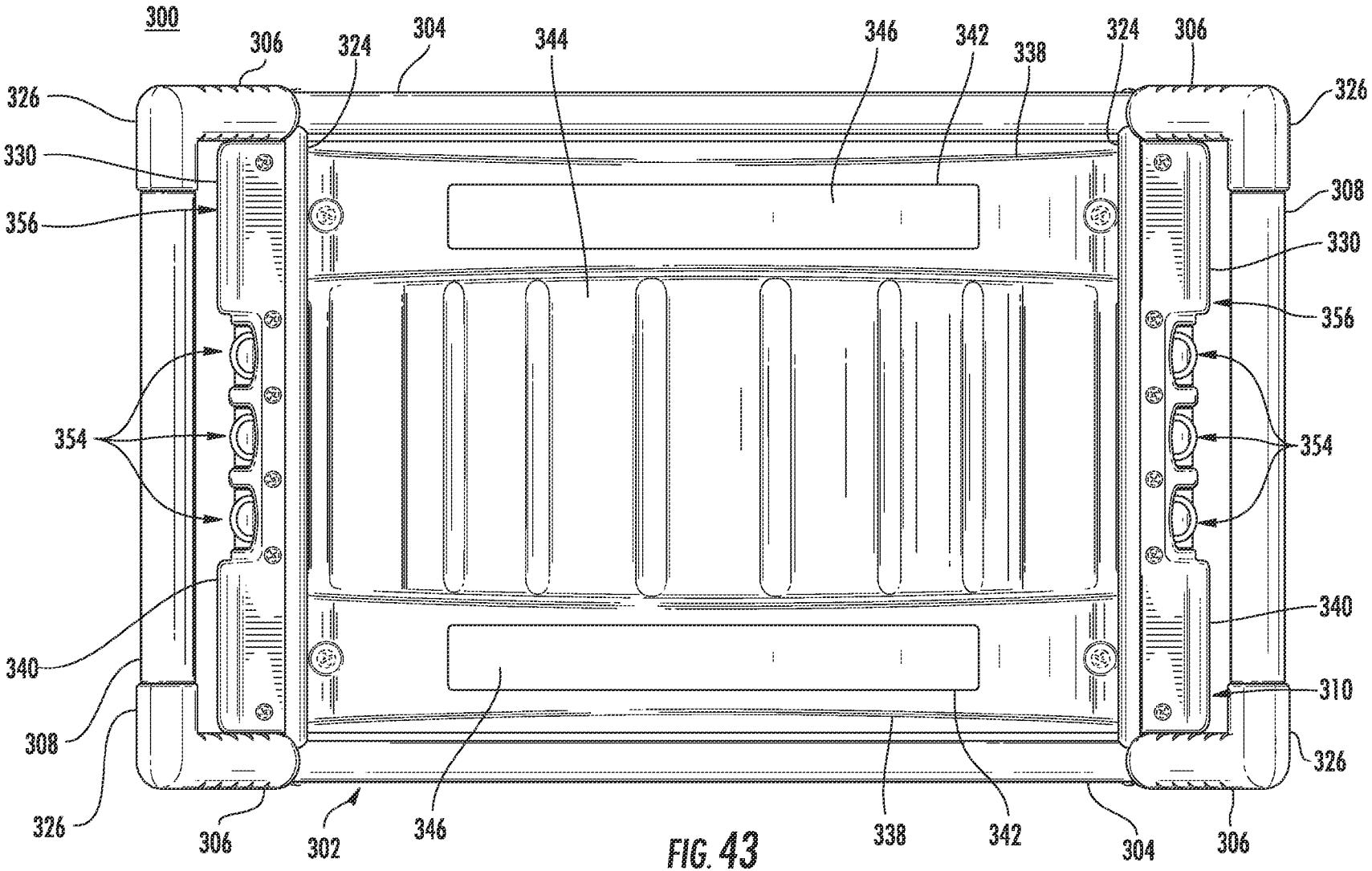
FIG. 43 is a plan view of a bottom of the exercise device of FIG. 40.
Figure 44:
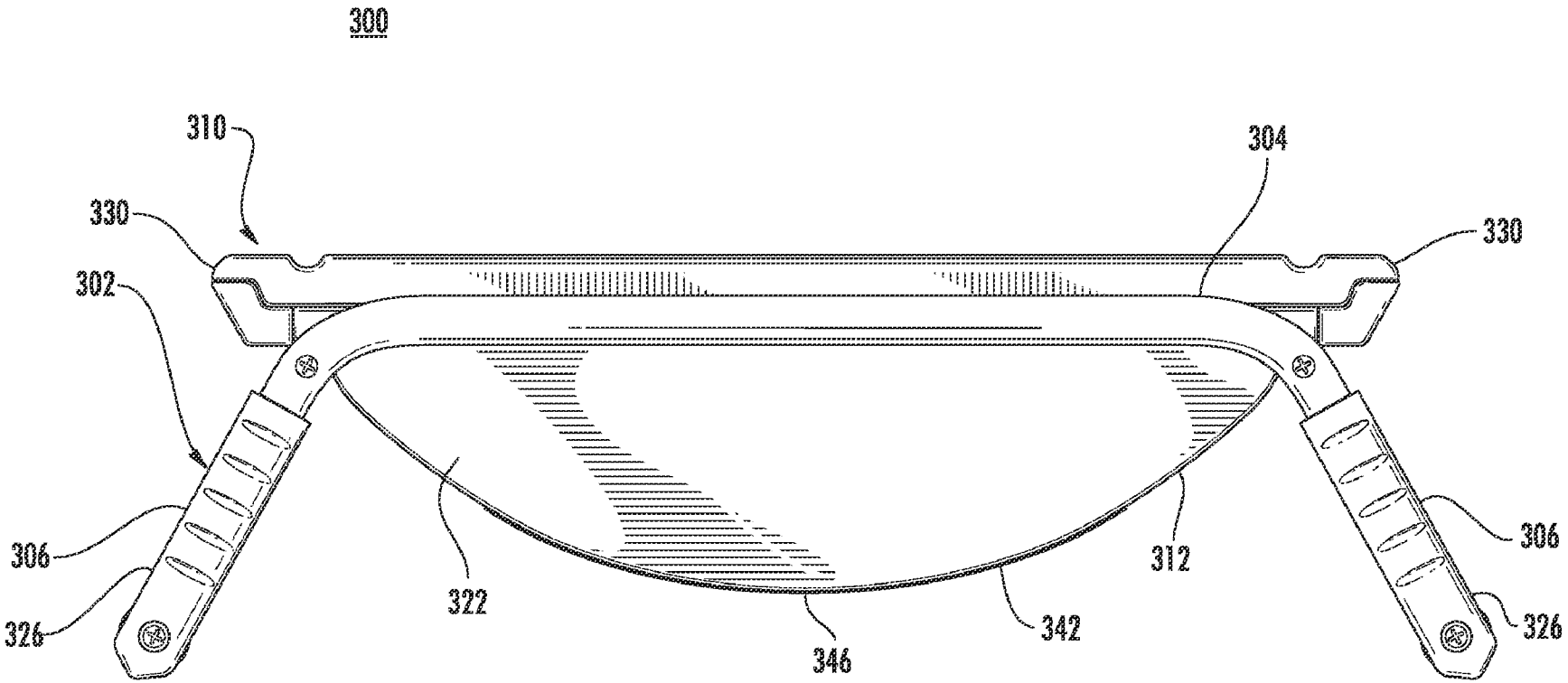
FIG. 44 is an elevational view of a front of the exercise device of FIG. 40.
Figure 48:
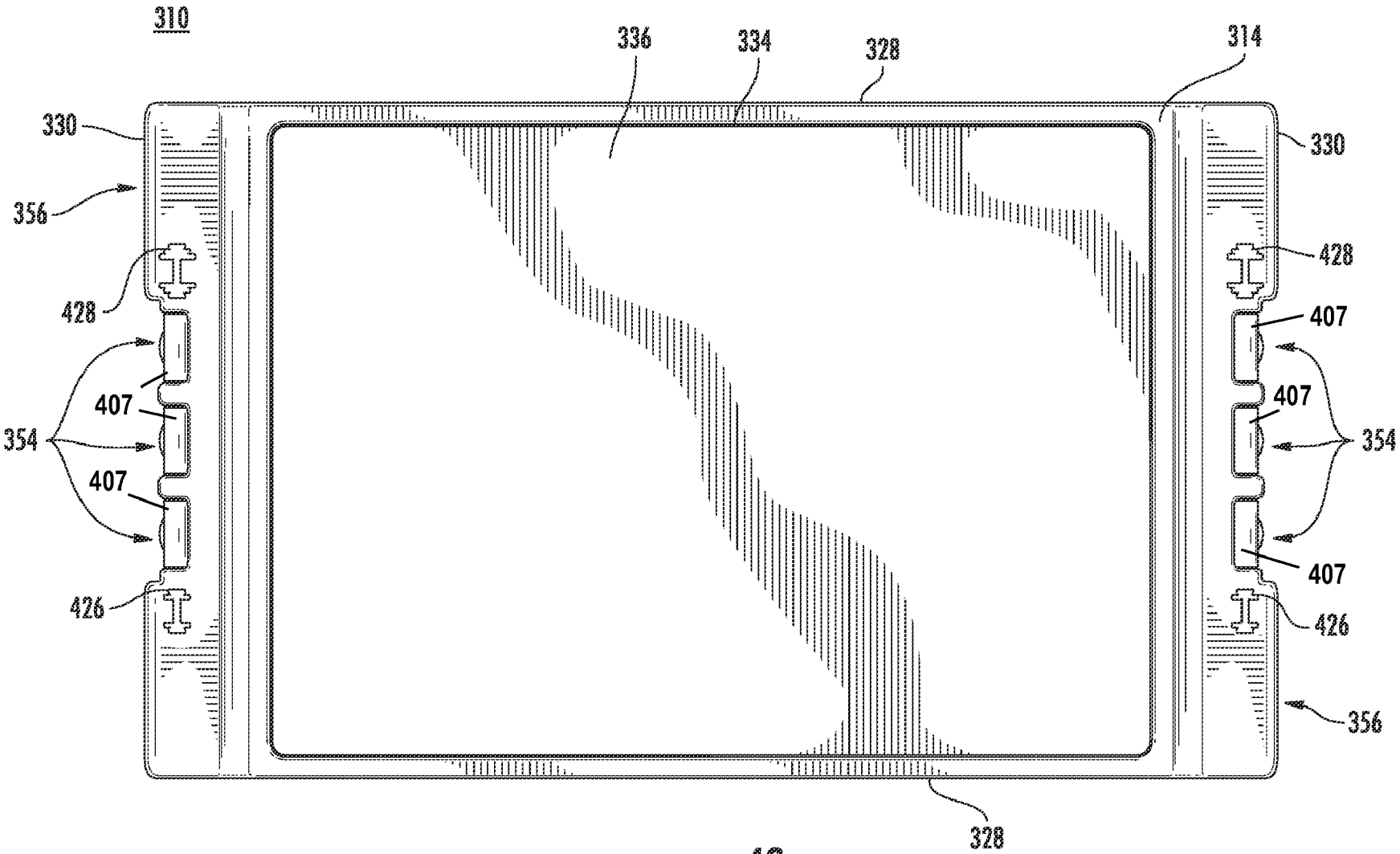
FIG. 48 is a plan view of a top of the platform of FIG. 46.
Figure 49:
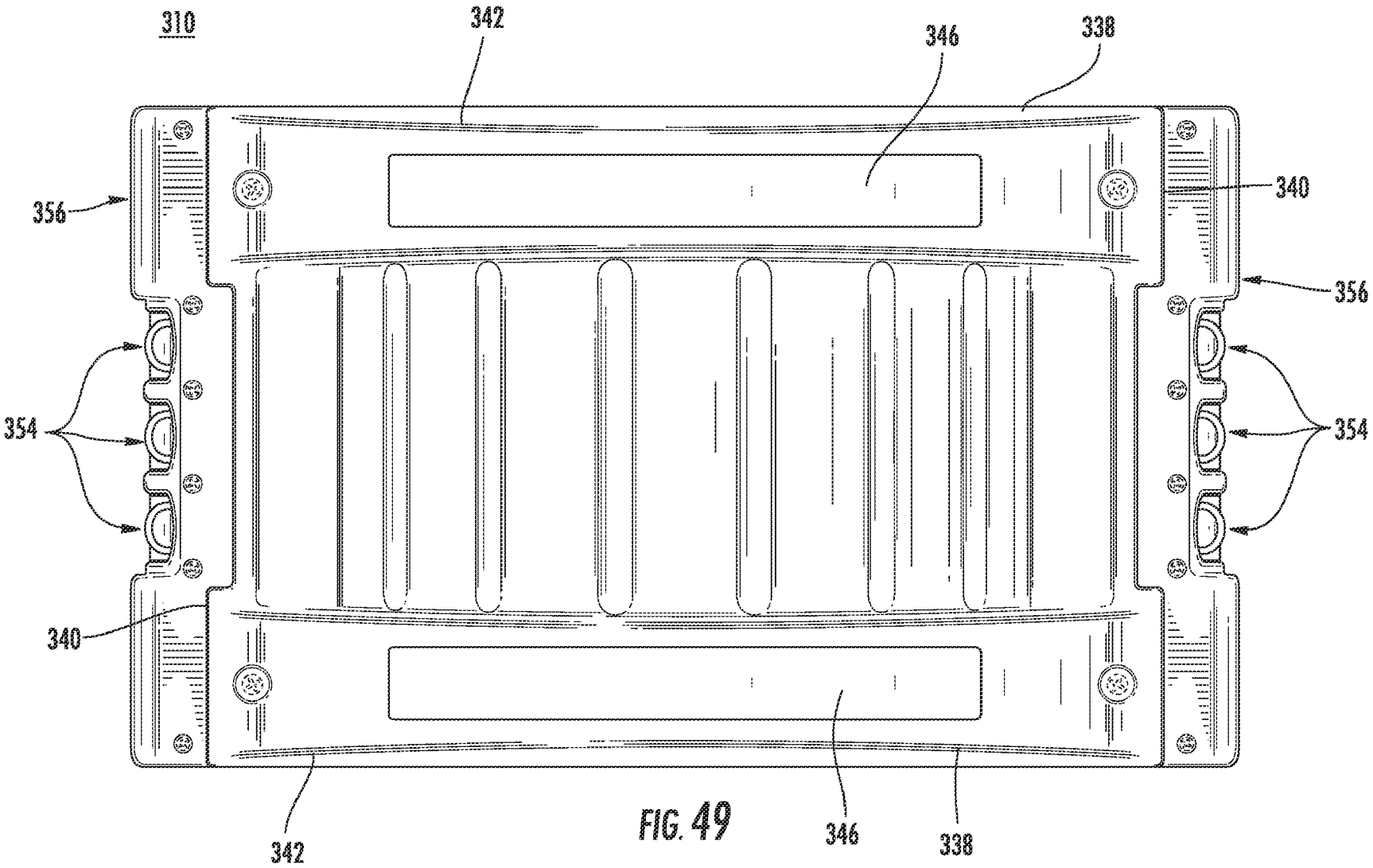
FIG. 49 is a plan view of a bottom of the platform of FIG. 46.
Figure 50:
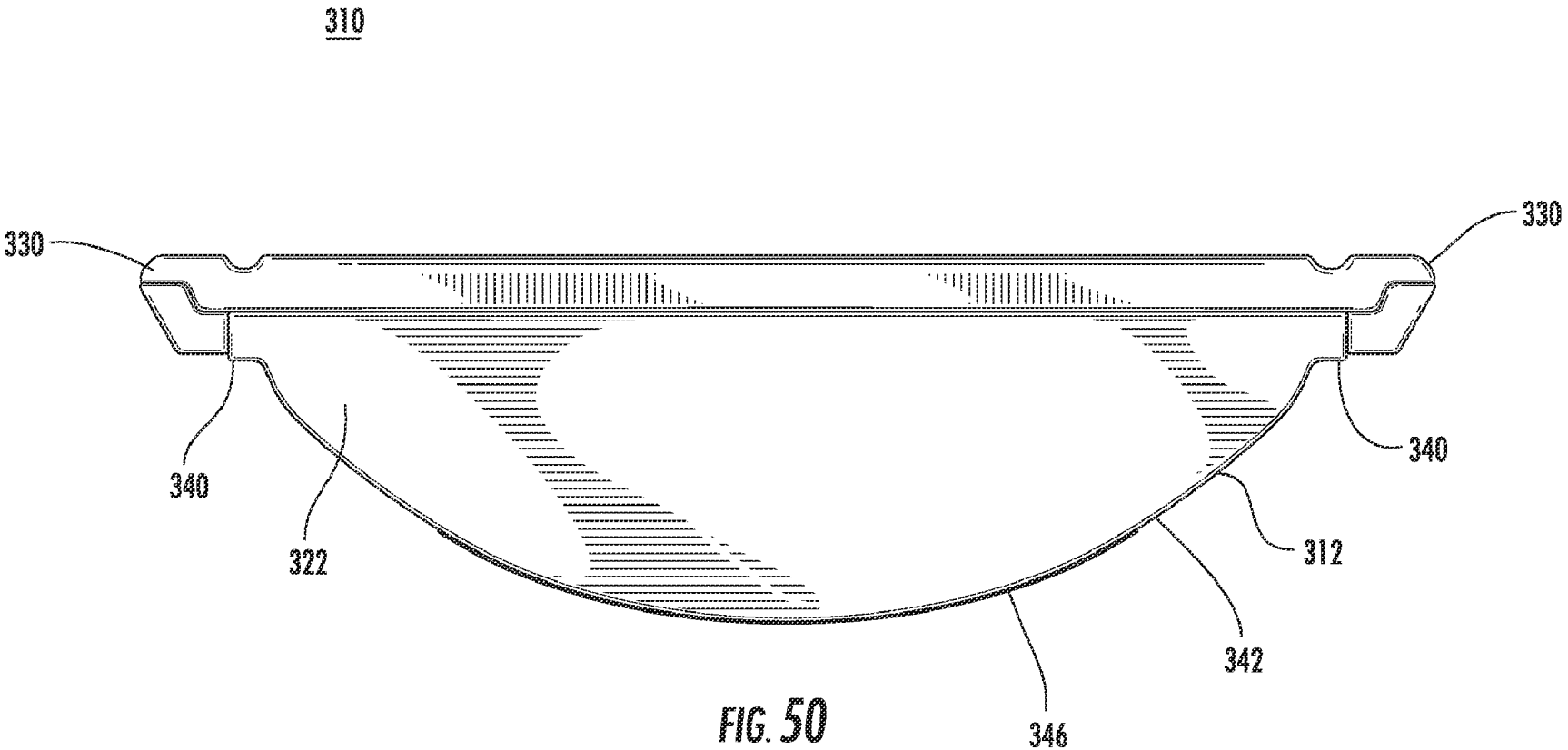
FIG. 50 is an elevation view of a front of the platform of FIG. 46.

It is further contemplated that indicia indicating the relative strength or resistance level of the resistance bands 320 may be included on the platform 310. As shown in FIGS. 42 and 48, the indicia include schematic barbells of relatively smaller and larger sizing. In particular, a smaller barbell 426 may identify the side having resistance bands 320 with less resistance, and a larger barbell 428 may identify the side having resistance bands 320 with greater resistance.

In addition, it is contemplated that a user may combine more than one resistance band 320 when using the exercise device 300 to add further versatility to a workout using the exercise device 300. In particular, the handle 420 or strap 422 (as shown in FIGS. 45 and 52, respectively) may be attached to attachment rings 410 corresponding to any combination of resistance bands 320. In this regard, the user may vary the level of resistance beyond the pre-set level of resistance of each individual resistance band 320.

As will be explained in greater detail below, the exercise device 300 may be used for exercising a wide array of muscles. In particular, the exercise device 300 may be used with the platform 310 being fully supported by the frame 302, as shown in FIGS. 40-45. Here, the platform 310 of the exercise device 300 is in a stable or steady configuration. A user may sit, stand, or lie on the platform 310 to perform various exercise movements including cardiovascular exercises, strength training exercises, and/or stretching exercises. The user may engage and pull the resistance bands 320 on either end 356 of the platform 310 via a user interface, such as a handle 420 or strap 422 attached to the attachment rings with a carabineer. The user may pull the resistance bands 320 with his or her hands if it is desired to exercise some aspect of the upper body. In addition, the user may pull the resistance bands 320 with his or her legs if it is desired to exercise some aspect of the lower body. As indicated previously, the resistance bands 320 may have varying resistances thereby enabling a versatile exercise experience. In addition, more than one resistance band 320 may be connected to a user interface to further add to the versatility of the exercise device 300.

The frame 302 and the platform 310 may also be separated from one another for use individually, as will be explained in greater detail below. As shown in FIGS. 46-51, the platform 310 may be placed onto the ground in order to provide an unstable surface. Here, a user may also sit, stand, or lie on the platform 310 to perform various exercise movements. The exercises may vary significantly because the platform 310 is permitted to rock from side to side. The rocking motion may aid in strengthening a user's core muscles and in improving a user's balance. With the platform 310 separated from the frame 302, the user may still engage the resistance bands 320 on either end 356 of the platform 310 by holding the grasping member attached thereto, such as a handle 420 or strap 422, and pulling the resistance bands 320.

Further still, the frame 302 of the exercise device 310 may be used separately from the platform 310. In particular, the user may engage the frame 302 of the exercise device 300 with his hands to perform various exercises without interacting with the platform 310.

Like the exercise device 100, the frame 102 also may be positioned on top of the platform 110 for performing exercises with the exercise device 300 in this alternative, unstable configuration.

Exercises Using the Third Preferred Embodiment

Figure 56:
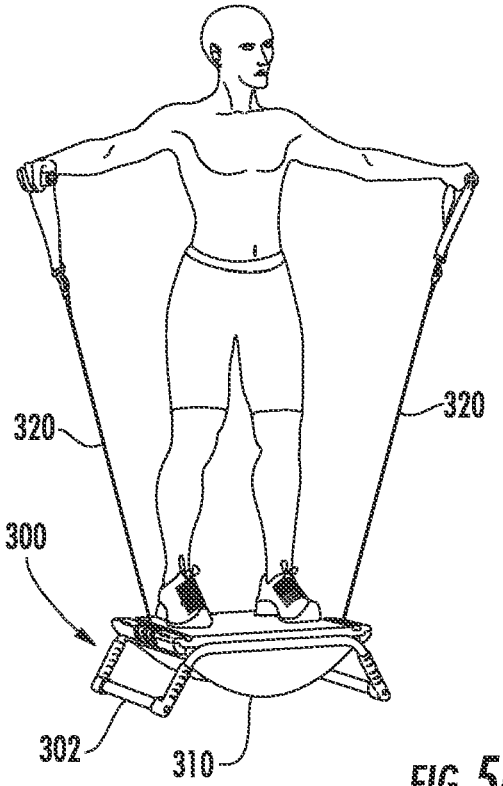
FIGS. 56-60 depict the exercise device of FIG. 45 in use, with the user standing on the exercise device and extending one or more of the resistance bands.
Figure 123:
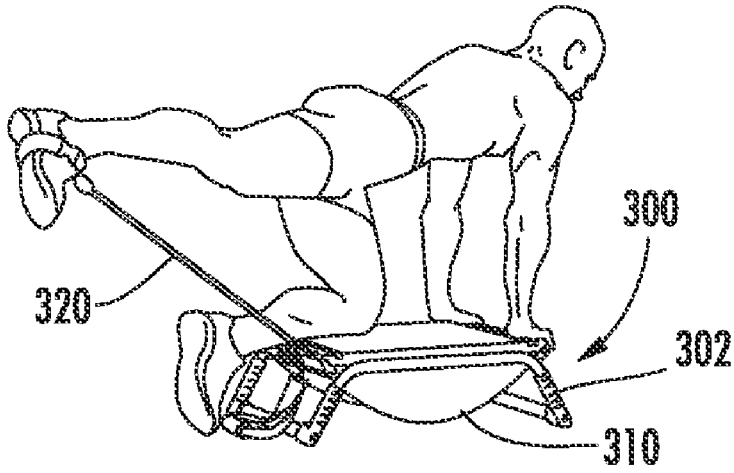
FIG. 123 depicts the exercise device of FIG. 52 in use, with the user placing his or her hands and knees on the platform.

FIGS. 56-123 are directed to various methods of using the exercise device 300, including use of the platform 310 and the frame 302 independently of one another. As will be explained in greater detail below, the exercise device 300 may be used in a stable manner, where the platform 310 is supported by the frame 302 and remains stationary. Further, the platform 310 may be separated from the frame 302 to permit the platform 310 to be used in an unstable manner. In this regard, the arched base supports 312 the platform 310 so that the platform 310 is permitted to rock back and forth. Still further, the frame 302 may be used separately from the platform 310 to permit other types of exercises, and the frame 302 may be used in an unstable configuration in which the frame 302 is supported on top of the platform 310. The versatility of the exercise device 300 may thus be understood, whereby a user is able to have a complete workout experience covering a broad range of different muscle groups with a single exercise device.

With reference to FIG. 56, a user may stand on the platform 310 of the exercise device 300 and grasp handles corresponding to one or more of the resistance bands 320 with his or her hands extended downwardly at his or her sides. The user may then raise each arm to a generally horizontal position in generally parallel disposition relative to the stepping deck 314 while keeping the elbow of each arm slightly bent, as shown in FIG. 56. The arms then may be lowered through the same motion in reverse, and the routine repeated.

Figure 57:
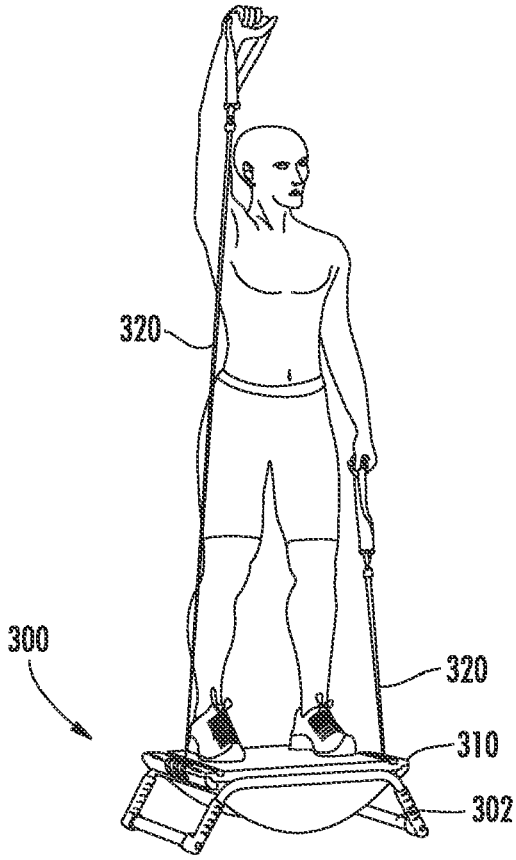

As shown in FIG. 57, a user may stand on the platform 310 of the exercise device 300 and grasp handles corresponding to one or more of the resistance bands 320 with his or her hands. The user may then position each arm in a generally vertical orientation at his or her respective sides, this position being defined as a starting position. Then, the user may raise a first arm out to the side and slightly forward, while keeping an elbow of the first arm slightly bent, until the first arm is generally vertically oriented. The first arm may then be lowered through the same motion in reverse to return to the starting position.

Figure 58:
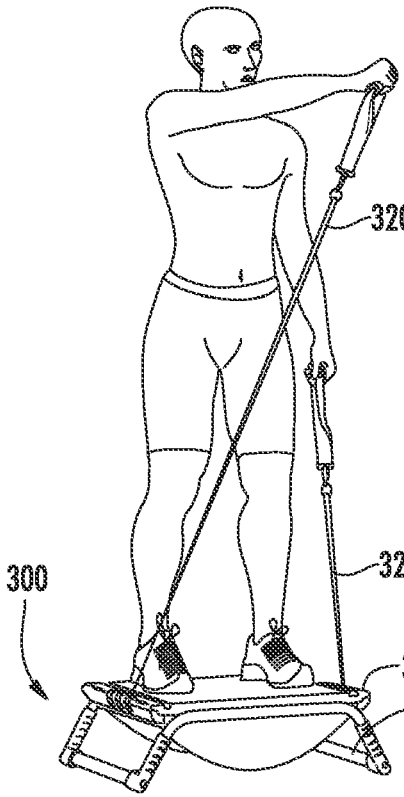

As shown in FIG. 58, a user may stand on the platform 310 of the exercise device 300 and grasp handles corresponding to one or more of the resistance bands 320 with his or her hands. The user may then position each arm in a generally vertical orientation at his or her respective sides, this position being defined as a starting position. Then, the user may raise a first arm upward and across his or her chest, while keeping an elbow of the first arm slightly bent, until the hand of the first arm is proximate the shoulder of the second arm of the user. The first arm may then be lowered through the same motion in reverse to return to the starting position.

Figure 59:
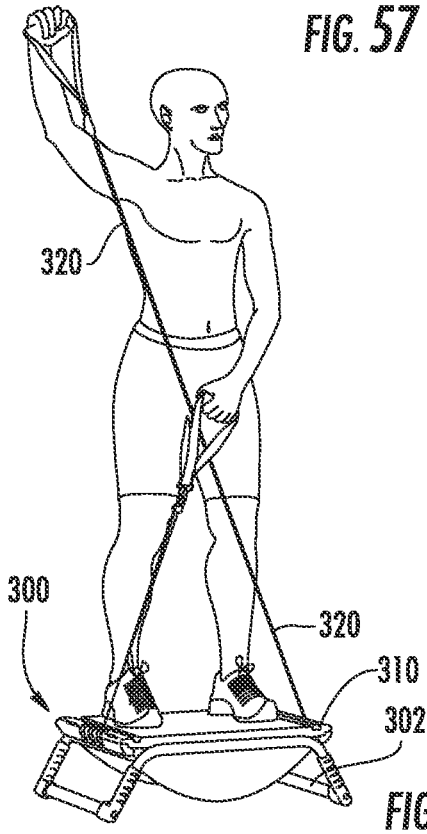

As shown in FIG. 59, a user may stand on the platform 310 of the exercise device 300 and grasp handles corresponding to one or more of the resistance bands 320 with his or her hands.

In particular, the user may stand on the platform in such a way that if the user's arms are positioned in generally vertical orientations at his or her respective sides, then one of the plurality of resistance bands 320 will be crossed with another of the plurality of resistance bands 320. The user may then position his or her arms across his or her torso such that his or her hands are generally at a waist level in front of the user, this position being defined as a starting position. Then, the user may raise a first arm up and across his or her torso, while keeping the elbow of the first arm slightly bent, until the first arm is generally parallel to the stepping deck of the platform 310. The first arm may then be lowered through the same motion in reverse to return to the starting position.

Figure 60:
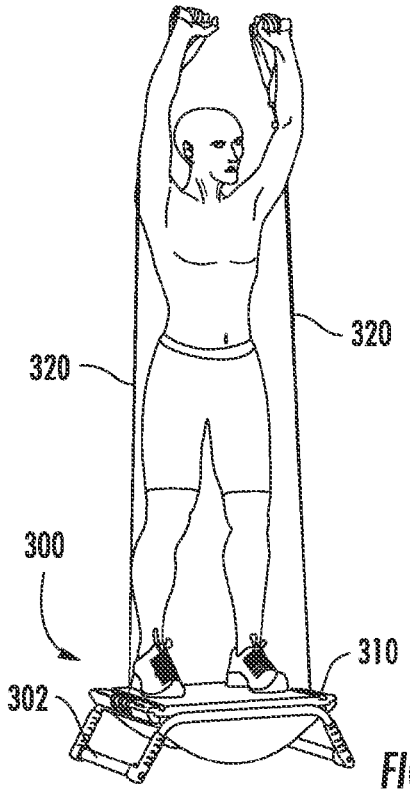

As shown in FIG. 60, a user may stand on the platform 310 of the exercise device 300 and grasp handles corresponding to one or more of the resistance bands 320 with his or her hands. The user may then position handles of the resistance bands 320 at a height that is level with his or her shoulders, this position being defined as a starting position. Then, the user may press the handles upward generally simultaneously, until the handles are above the user's head. The handles may then be lowered downward through the same motion in reverse to return to the starting position. Additionally, a user may stand on the platform 310 of the exercise device 300 and grasp handles corresponding to one or more of the resistance bands 320 with his or her hands. The user may then position handles of the resistance bands 320 in front of his or her hips with his or her palms facing backward, this position being defined as a starting position. Then, the user may pull the handles upward, generally simultaneously, by bending his or her elbows, while keeping his or her hands close to his or her torso. This action may be continued until the handles are proximate the user's chin. The handles may then be lowered downward through the same motion in reverse to return to the starting position.

Figure 63:
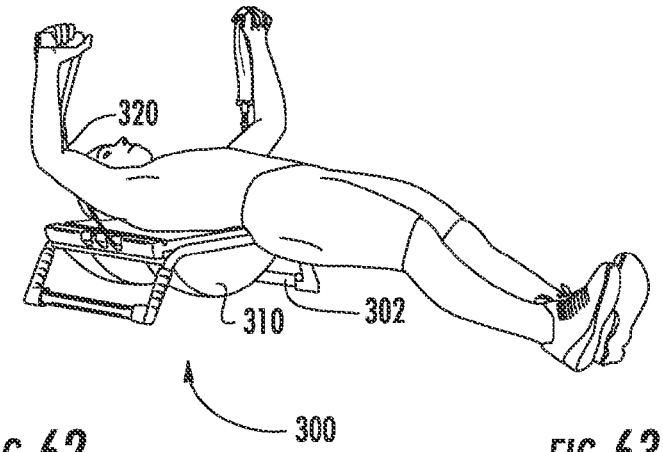
FIG. 63 depicts the exercise device of FIG. 45 in use, with the user placing his or her back against the exercise device and extending one or more of the resistance bands.

As shown in FIG. 63, a user may lie on the platform 310 of the exercise device 300 such that a portion of his or her upper back rests on the platform 310. The user may grasp handles corresponding to one or more of the resistance bands 320 with his or her hands. The user may then position the handles at a level that is equal to the user's chest proximate the arm pits of the user, this position being defined as a starting position. Then, the user may press the handles upward, generally simultaneously, until his or her arms are oriented generally vertically. The handles are then lowered downward through the same motion in reverse to return to the starting position.

Figure 64A:
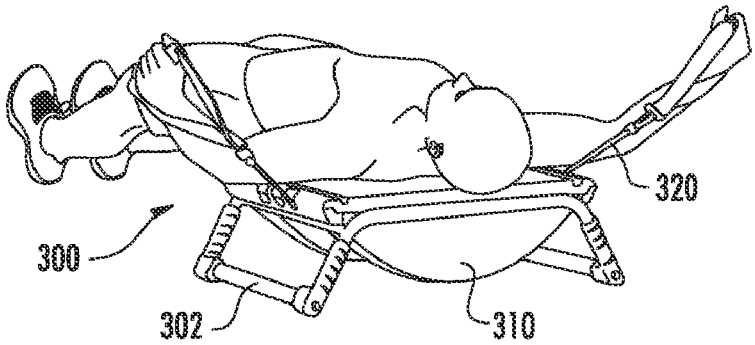
FIGS. 64A-64B depict the exercise device of FIG. 45 in use, with the user placing his or her back against the exercise device and extending one or more of the resistance bands.
Figure 64B:
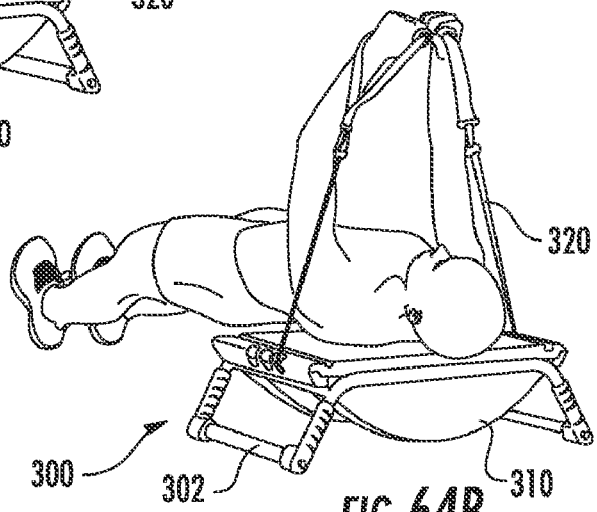

As shown in FIGS. 64A and 64B, a user may lie on the platform 310 of the exercise device 300 such that a portion of his or her upper back rests on the platform 310. The user may grasp handles corresponding to one or more of the resistance bands 320 with his or her hands. The user may then position the handles above his or her chest with elbows straight, this position being defined as a starting position. Then, the user may lower the handles downward and outward through an arc, generally simultaneously, until his or her arms are oriented generally parallel to the stepping deck 314 of the platform 310. The handles may then be raised upward and inward through the same motion in reverse to return to the starting position.

Figure 66:
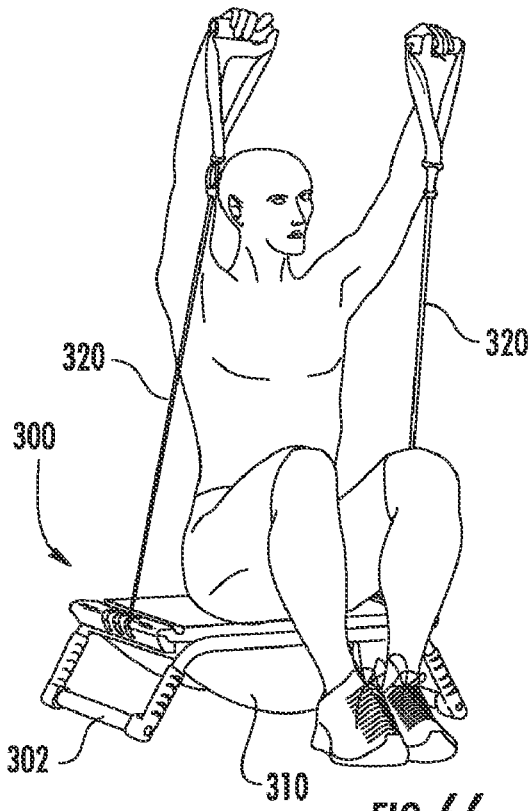
FIG. 66 depicts the exercise device of FIG. 45 in use, with the user sitting on the exercise device and extending one or more of the resistance bands.

As shown in FIG. 66, a user may sit on the platform 310 of the exercise device 300 such that a portion of the user's rear rests on the platform 310. The user may grasp handles corresponding to one or more of the resistance bands 320. The user may then position the handles at a level that is equal to the user's chest proximate his or her shoulders, this position being defined as a starting position. Then, the user may press the handles upward generally simultaneously, until his or her elbows are generally straight. The handles may then be lowered downward through the same motion in reverse to return to the starting position.

Figure 67:
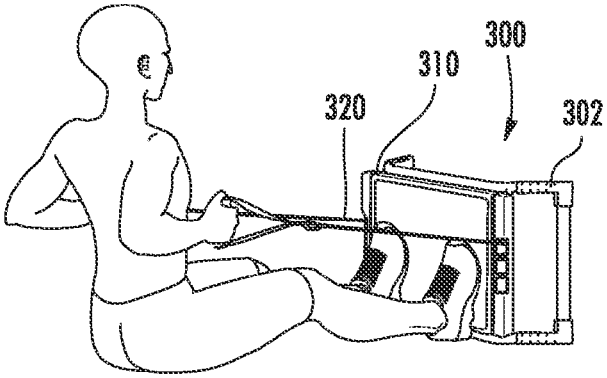
FIG. 67 depicts the exercise device of FIG. 45 in use, with the device laying on its side and the user extending one or more of the resistance bands with his or her feet against the exercise device.

As shown in FIG. 67, a user may sit on the floor or ground with his or her knees generally straight and his or her feet pressed against the platform 310 of the exercise device 300. The user may grasp handles corresponding to one or more of the resistance bands 320. The user may position the handles proximate his or her ankles, this position being defined as a starting position. Then, the user may pull the handles toward his or her torso, generally simultaneously, until his or her elbows are bent at a generally 90° angle and his or her shoulder blades are contracted. The handles may then be returned through the same motion in reverse to return to the starting position.

Figure 69:
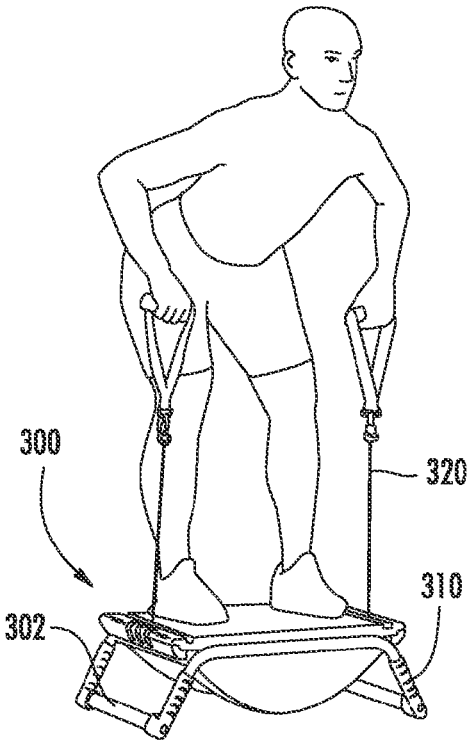
FIG. 69-71 depict the exercise device of FIG. 45 in use, with the user standing on the exercise device and extending one or more of the resistance bands.

As shown in FIG. 69, a user may stand on the platform 310 of the exercise device 300 and grasp handles corresponding to one or more of the resistance bands 320 with his or her hands. The user may bend forward at his or her hips while preventing his or her back from rounding. The user may bend forward until his or her torso is generally parallel to the stepping deck of the platform 310. The user may then position the handles proximate the user's knees, this position being defined as a starting position. Then, the user pulls the handles toward his or her torso, generally simultaneously, until his or her elbows are bent at a generally 90° angle and his or her shoulder blades are contracted. The handles may then be returned through the same motion in reverse to return to the starting position.

Figure 70:
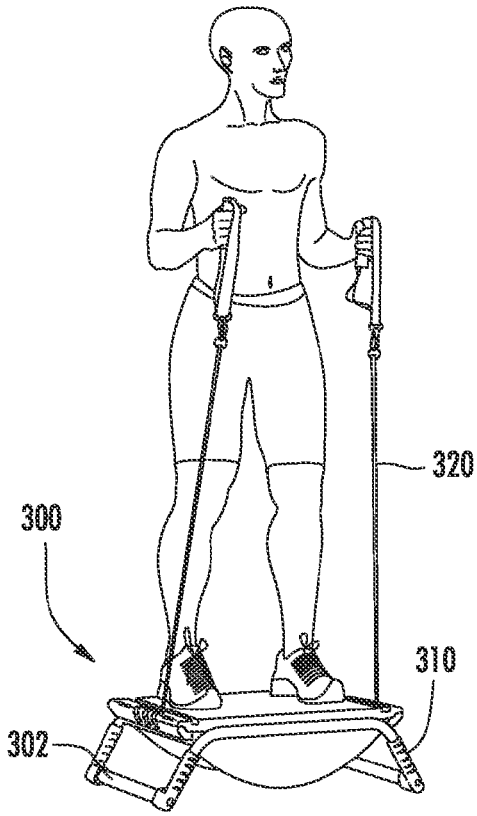

As shown in FIG. 70, a user may stand on the platform 310 of the exercise device 300 such that the distance between the user's feet is generally equal to the distance between the user's shoulders. The user may grasp handles corresponding to one or more of the resistance bands 320. The user may bend his or her knees slightly. The user may then position his or her arms each in a generally vertical orientation with elbows at a generally 90° angle and palms facing upward, this position being defined as a starting position. Then, the user may pull up by bending at the elbows and curling the handles until the handles are proximate the user's shoulders. The handles may then be lowered through the same motion in reverse to return to the starting position. Additionally, a user may stand on the platform 310 of the exercise device 300 such that the distance between the user's feet is generally equal to the distance between the user's shoulders. The user may grasp handles corresponding to one or more of the resistance bands 320. The user may then position his or her arms each in a generally vertical orientation with elbows bent at a generally 90° angle and with palms facing inward, this position being defined as a starting position. Then, the user may pull up by bending at the elbows and curling the handles until the handles are proximate the user's shoulders. The handles may then be lowered through the same motion in reverse to return to the starting position.

Figure 79:
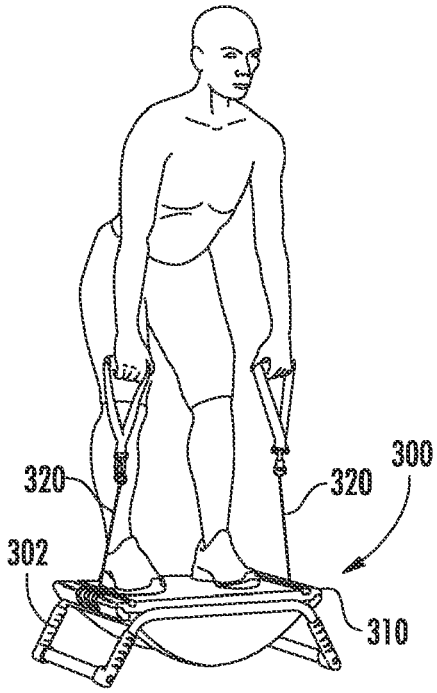
FIG. 79 depicts the exercise device of FIG. 45 in use, with the user standing on the exercise device and extending one or more of the resistance bands.

As shown in FIG. 79, a user may stand on the platform 310 of the exercise device 300 and grasp handles corresponding to one or more of the resistance bands 320 with his or her hands. The user may bend forward at his or her hips while keeping his or her back from rounding. The user may bend forward until his or her torso is generally parallel to the stepping deck of the platform 310. The user may then position the handles proximate his or her ankles, this position being defined as a starting position. Then, the user may straighten at the hips while keeping his or her back straight. The user may then undergo the same motion in reverse to return to the starting position.

Figure 84:
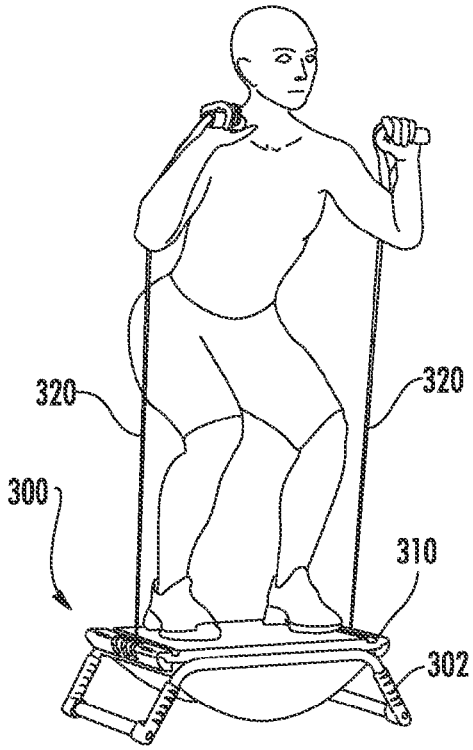

As shown in FIG. 84, a user may stand on the platform 310 of the exercise device 300 and grasp handles corresponding to one or more of the resistance bands 320 with his or her hands. The user may stand with knees slightly bent with the handles at a height that is level with the user's shoulders, this position being defined as a starting position. Then, the user may bend his or her knees until the knees are bent at a generally 90° angle. The user may then straighten his or her knees through the same motion in reverse to return to the starting position. Additionally, a user may stand on the platform 310 of the exercise device 300 and grasp handles corresponding to one or more of the resistance bands 320 with his or her hands. The user may stand with knees slightly bent with the handles at a height that is level with a portion of the user's torso, this position being defined as a starting position. Then, the user may bend his or her knees until the knees are bent at a generally 90° angle. The user may then straighten his or her knees through the same motion in reverse to return to the starting position.

Figure 83:
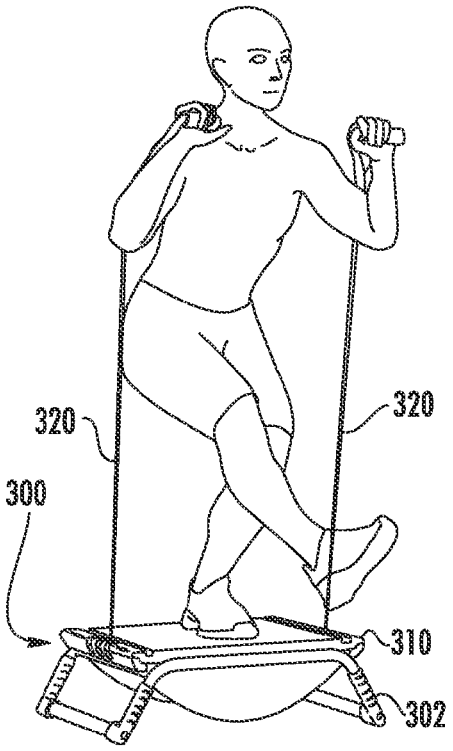

As shown in FIG. 83, a user may position the foot of a first leg on the platform 310 of the exercise device 300 with the knee slightly bent. The user may position his or her other foot in front of his or her body such that the other foot is not supported by the platform 310. The user may grasp handles corresponding to one or more of the resistance bands 320. The user may position the handles at a height that is level with the user's shoulders, this position being defined as a starting position. Then, the user may bend the knee of the first leg until the knee is bent at a generally 90° angle. The user may then straighten the knee of the first leg through the same motion in reverse to return to the starting position.

Figure 82:
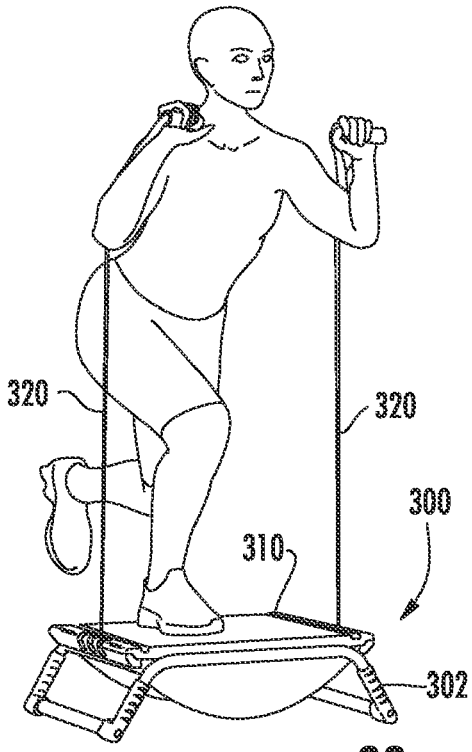
FIGS. 82-84 depict the exercise device of FIG. 45 in use, with the user standing on the exercise device and extending one or more of the resistance bands.

As shown in FIG. 82, a user may position the foot of a first leg on the platform 310 of the exercise device 300 with the knee slightly bent. The user may position his or her other foot behind his or her body such that the other foot is not supported by the platform 310. The user may grasp handles corresponding to one or more of the resistance bands 320. The user may position the handles at a height that is level with the user's shoulders, this position being defined as a starting position. Then, the user may bend the knee of the first leg until the knee is bent at a generally 90° angle. The user may then straighten the knee of the first leg through the same motion in reverse to return to the starting position.

Figure 113:
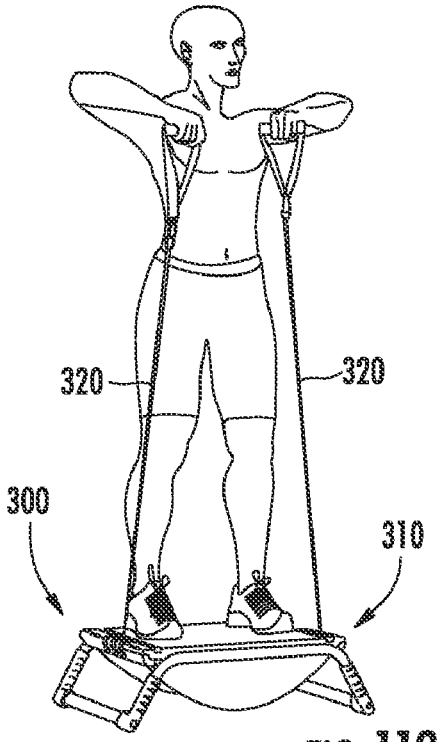

As shown in FIG. 113, a user may stand on the platform 310 of the exercise device 300 and grasp handles corresponding to one or more of the resistance bands 320 with his or her hands. The user may bend forward at the hips while keeping his or her back from rounding until his or her torso is generally parallel to the stepping deck of the platform 310. Then, the user may position the handles proximate his or her ankles, this position being defined as a starting position. The user may then straighten at the hips while keeping his or her back straight. Then, the user may pull the handles upward, generally simultaneously, by bending his or her elbows while keeping his or her hands close to the torso. This action may be performed until the handles are proximate the user's chin. The user may then undergo the same motion in reverse to return to the starting position.'

Figure 116:
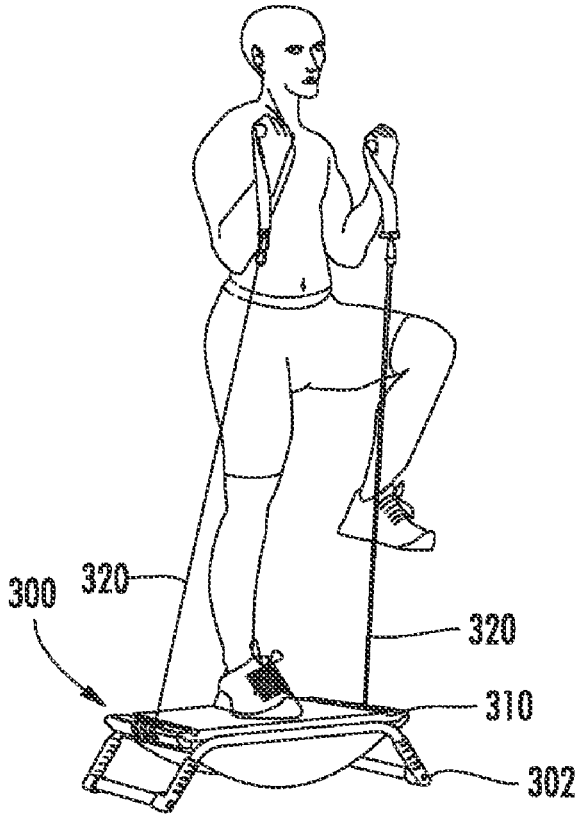
Figure 117:
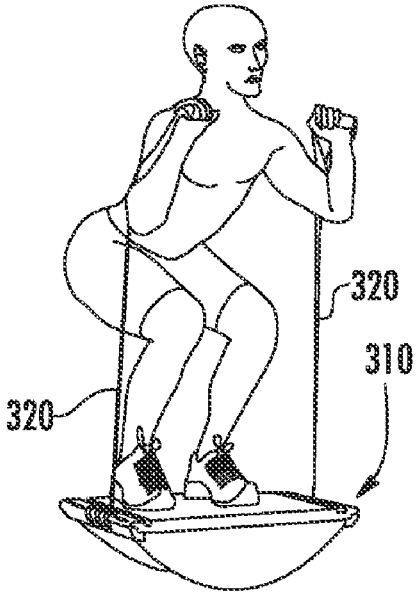
FIGS. 117-118 depict the platform of the exercise device of FIG. 51 in use, with the user standing on the platform and extending one or more of the resistance bands.
Figure 118:
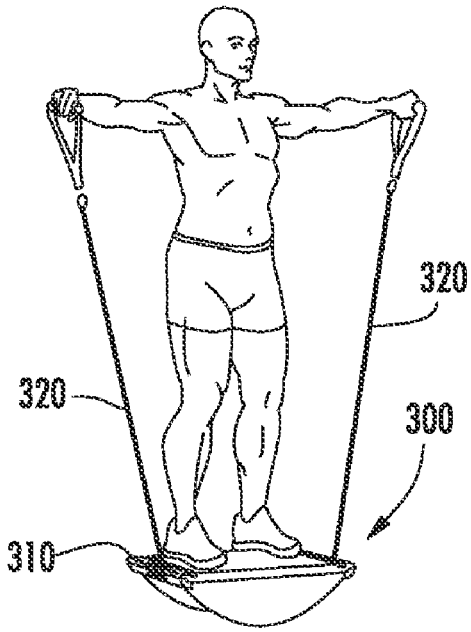

As shown in FIG. 116, a user may position the foot of a first leg on the platform 310 of the exercise device 300. The user may position the second leg in the air with the knee slightly bent at a generally 90° angle. The user may grasp handles corresponding to one or more of the resistance bands 320. The user may position his or her arms each in a generally vertical orientation with elbows bent at a generally 90° angle and with palms facing upward, this position being defined as a starting position. Then, the user may pull up by bending at the elbows and curling the handles until the handles are proximate the user's shoulders. The handles may then be lowered through the same motion in reverse. Additionally, the user may lower the second leg and remove his or her foot of the first leg from the platform 310 so that both feet are supported by the floor or ground.

Figure 62:
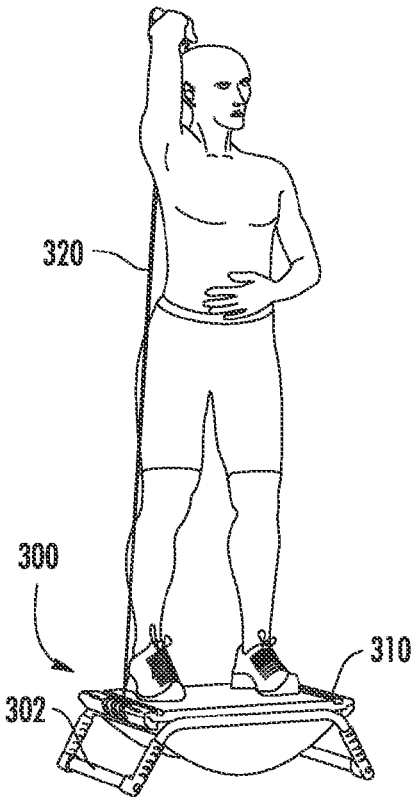
FIG. 62 depicts the exercise device of FIG. 45 in use, with the user standing on the exercise device and extending one or more of the resistance bands.

As shown in FIG. 62, a user may stand on the platform 310 of the exercise device 300 and grasp a handle corresponding to one or more of the resistance bands 320 with a hand. The user may then position a first arm in a vertical orientation such that a portion of the forearm is above the user's head with a palm of the hand facing forward, this position being defined as a starting position. Then, the user lowers the forearm of the first arm behind the user by bending the first arm at the elbow while keeping his or her shoulders and an upper portion of the first arm above the elbow in generally fixed positions. The user may then raise the forearm of the first arm so as to return to the starting position while keeping his or her shoulders and the upper portion of the first arm in generally fixed positions.

Figure 65:
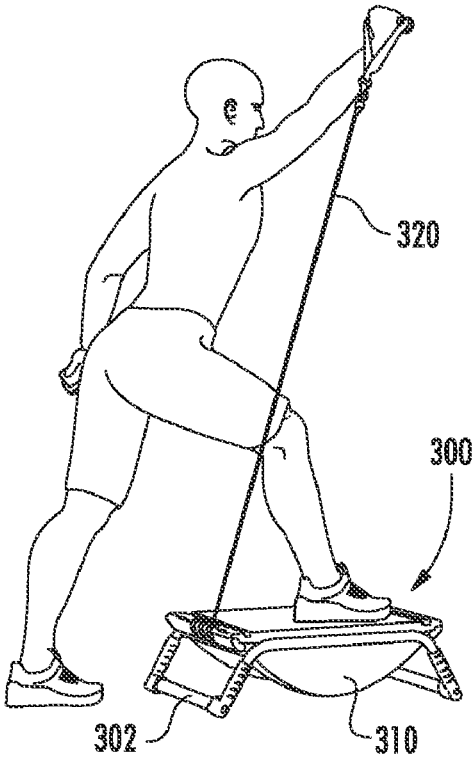
FIG. 65 depicts the exercise device of FIG. 45 in use, with the user placing one foot on the exercise device and extending one or more of the resistance bands.

As shown in FIG. 65, a user may position the foot of one leg on the platform 310 of the exercise device 300 with the knee bent. The user may grasp a handle corresponding to one or more of the resistance bands 320 with a hand. The user may then position the hand grasping the handle proximate his or her chest with the palm of the hand facing downward, this position being defined as a starting position. Then, the user may press the hand grasping the handle up and away from his or her chest. The hand grasping the handle may then be returned through the same motion in reverse to the starting position.

Figure 61:
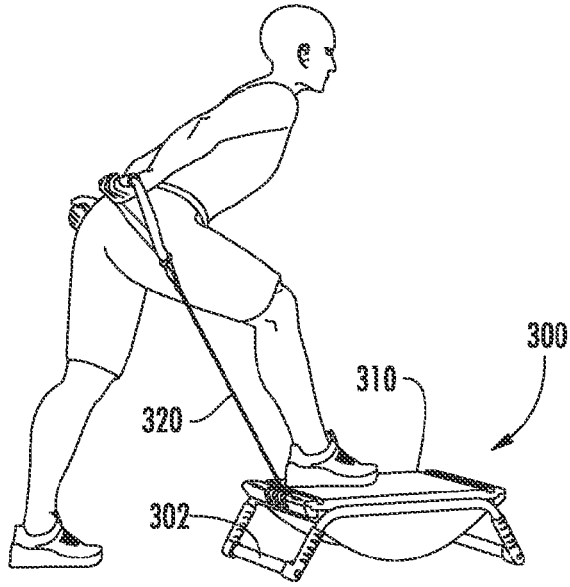
FIG. 61 depicts the exercise device of FIG. 45 in use, with the user placing one foot on the exercise device and extending one or more of the resistance bands.

As shown in FIG. 61, a user may position the foot of one leg on the platform 310 of the exercise device 300 with the knee bent. The user may grasp a handle corresponding to one or more of the resistance bands 320 with a hand. The user may then bend forward at his or her hips. The user may position an elbow of the arm that retains the handle behind his or her body such that the elbow is generally at an equal height with the user's shoulders and such that the elbow is bent with the palm of the hand facing inward, this position being defined as a starting position. Then, the user may straighten the elbow of the arm that retains the handle. The elbow may then be returned through the same motion in reverse to return to the starting position.

Figure 68:
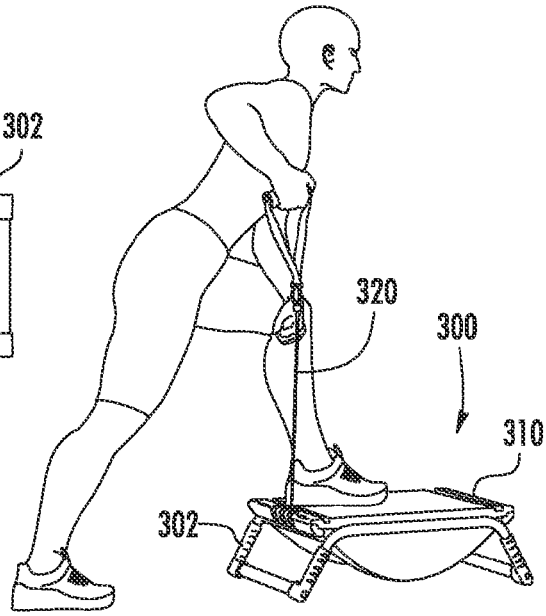
FIG. 68 depicts the exercise device of FIG. 45 in use, with the user placing one foot on the exercise device and extending one or more of the resistance bands.

As shown in FIG. 68, a user may position the foot of one leg on the platform 310 of the exercise device 300 with the knee bent. The user may grasp a handle corresponding to one or more of the resistance bands 320 with a hand. The user may then bend forward at his or her hips. The user may position the hand grasping the handle generally proximate to or below the knee of the user with a palm of the hand facing inward, this position being defined as a starting position. Then, the user may pull the hand grasping the handle up and slightly back until the elbow of the first arm is at an equal height with the user's shoulder. The hand grasping the handle may then be returned through the same motion in reverse to the starting position.

Figure 114:
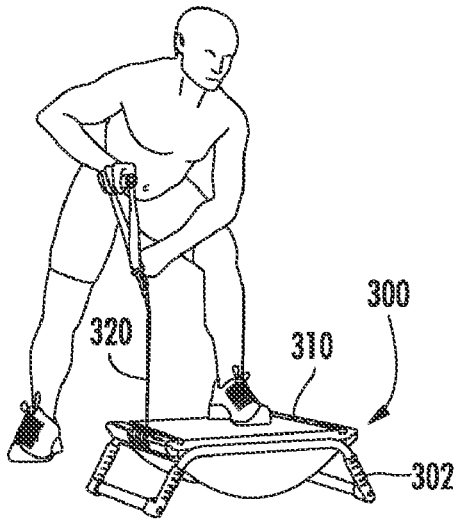
FIGS. 114-116 depict the exercise device of FIG. 51 in use, with the user placing one foot on the exercise device and extending one or more of the resistance bands.

As shown in FIG. 114, a user may position the foot of one leg on the platform 310 of the exercise device 300 with the knee of the leg bent. The user may grasp a handle corresponding to one or more of the resistance bands 320 with the hand of a first arm. The user may then bend forward at his or her hips. Then, the user may place the second arm on an upper portion above the knee of the leg supported on the platform 310. The user may then position the hand of the first arm generally proximate to or below the knee supported on the platform 310 with a palm of the hand facing inward, this position being defined as a starting position. Then, the user may pull the hand of the first arm up and slightly back until the elbow of the first arm is at an equal height with the user's shoulder. The hand of the first arm may then be returned through the same motion in reverse to the starting position.

Figure 71:
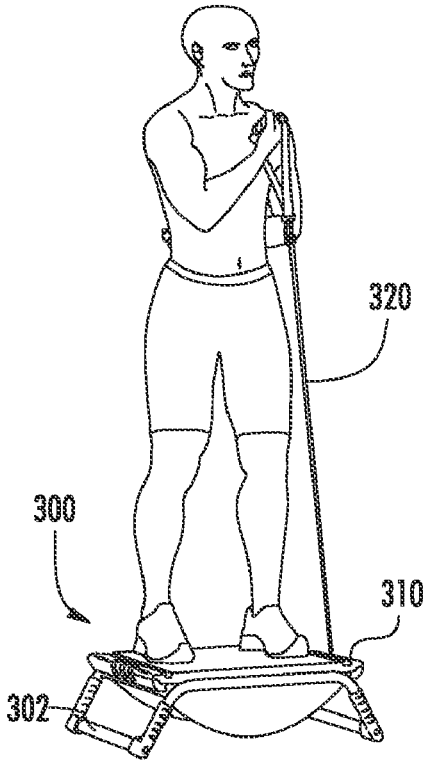
Figure 72:
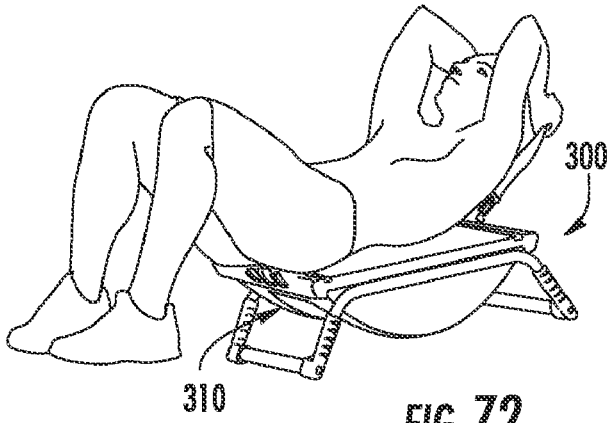

As shown in FIG. 71, a user may stand on the platform 310 of the exercise device 300 and grasp a handle corresponding to one or more of the resistance bands 320 with a hand. The user may position a first arm in a generally vertical orientation with the elbow either straight, or else bent at an angle greater than about 90°, with the palm of the hand grasping the handle facing inward, this position being defined as a starting position. Then, the user may pull the hand grasping the handle up by bending the first arm at the elbow of the first arm, thereby curling the hand to a height equal with the user's shoulder. This action may be performed while keeping the elbow slightly in front of the user and close to the user's abdomen and while squeezing the user's shoulder blades together. The hand grasping the handle may then be returned through the same motion in reverse to the starting position.

Figure 115:
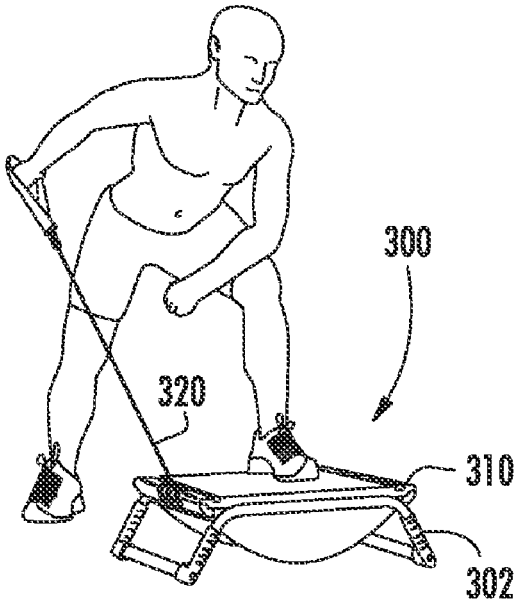

As shown in FIG. 115, a user may position the foot of one leg on the platform 310 of the exercise device 300 with the knee bent. The user may grasp a handle corresponding to one or more of the resistance bands 320 with the hand of a first arm. The user may then bend forward at his or her hips. The user may then place a second arm on an upper portion above the knee of the leg supported on the platform 310. Then, the user may position the elbow of the first arm behind his or her body such that the elbow is generally at an equal height with the user's shoulder. In this regard, the elbow may be bent with a palm of the hand facing inward. This position may be defined as a starting position. The user may then straighten the elbow of the first arm. The elbow of the first arm may then be returned through the same motion in reverse to return to the starting position.

Figure 74:
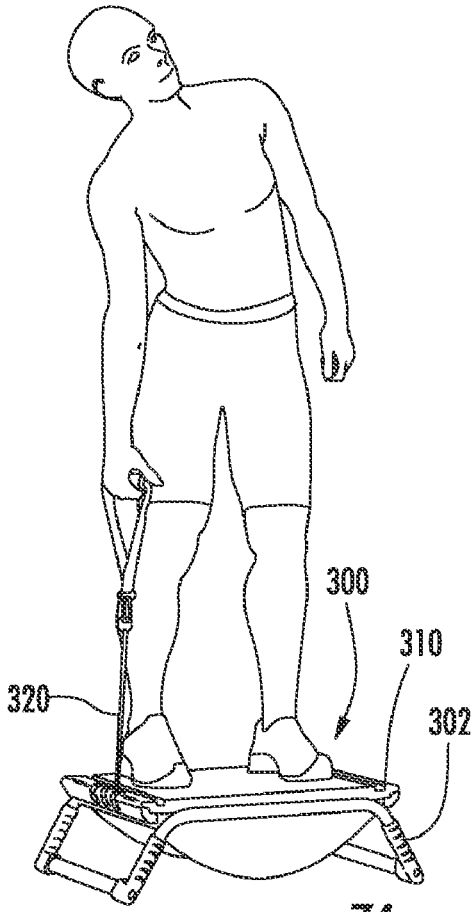
FIGS. 74-75 depict the exercise device of FIG. 45 in use, with the user standing on the exercise device and extending one or more of the resistance bands.

As shown in FIG. 74, a user may stand on the platform 310 of the exercise device 300 such that the distance between the user's feet is generally equal to the distance between the user's shoulders. The user may grasp a handle corresponding to one or more of the resistance bands 320 with a hand. The user may bend toward the side of the body that retains the handle. This bending action may be performed while keeping the knees straight and the elbow of the arm that retains the handle straight. The user may then return through an unbending motion to a standing position.

Figure 86:
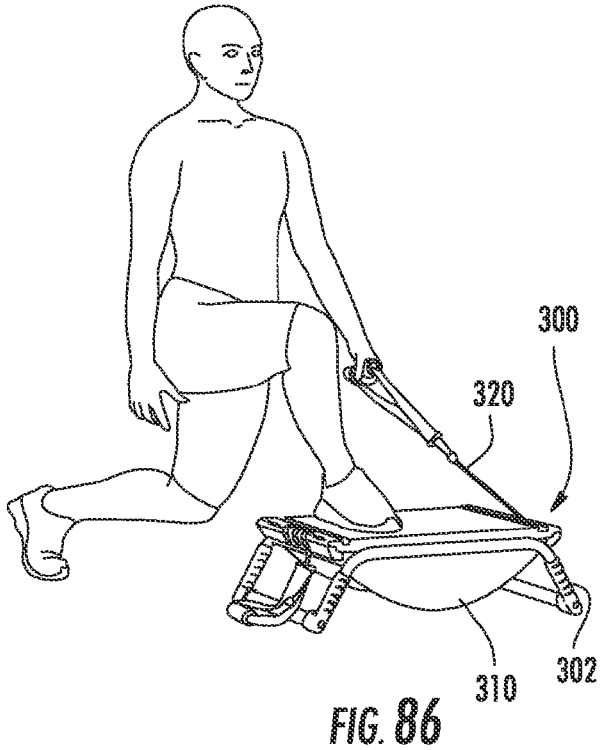
FIG. 86 depicts the exercise device of FIG. 45 in use, with the user placing one foot on the exercise device and extending one or more of the resistance bands.

As shown in FIG. 86, the user may stand behind the platform 310 of the exercise device 300 and to one side of the platform 310 where a first leg is closer to the platform 310 than a second leg. At that particular side, the user may grasp a handle corresponding to one or more of the resistance bands 320 with a hand. The user may then raise the second leg and cross the raised second leg over the first leg. Then, the user may place the foot of the second leg on the platform 310 and bend the knee of the second leg to a generally 90° angle. The user may then push off from the platform 310 by straightening the knee of the second leg.

Figure 72:
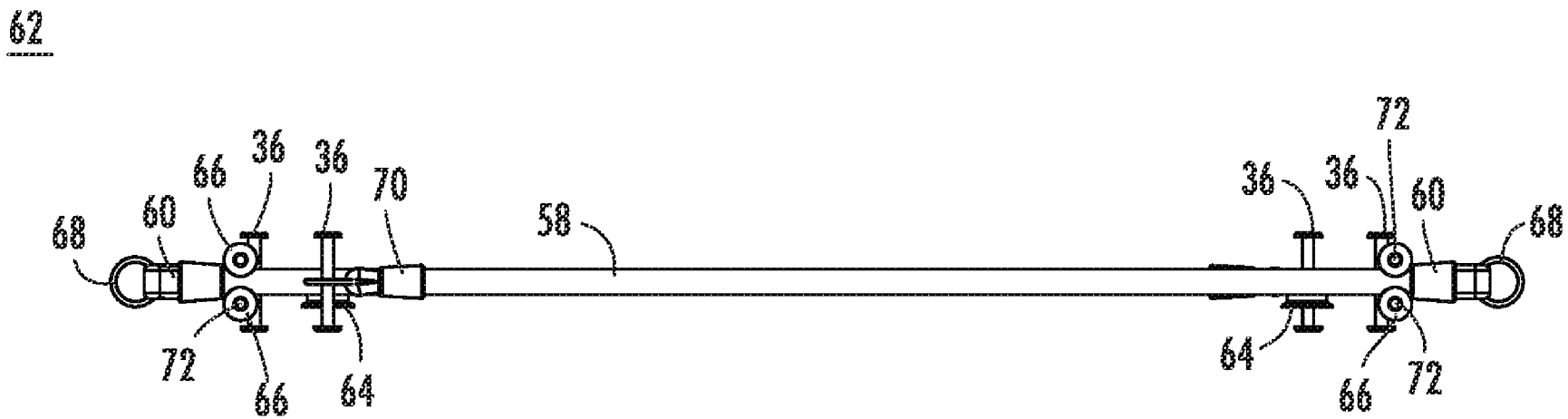
FIG. 72 depicts the exercise device of FIG. 45 in use, with the user placing his or her back against the exercise device and extending one or more of the resistance bands.
Figure 13:
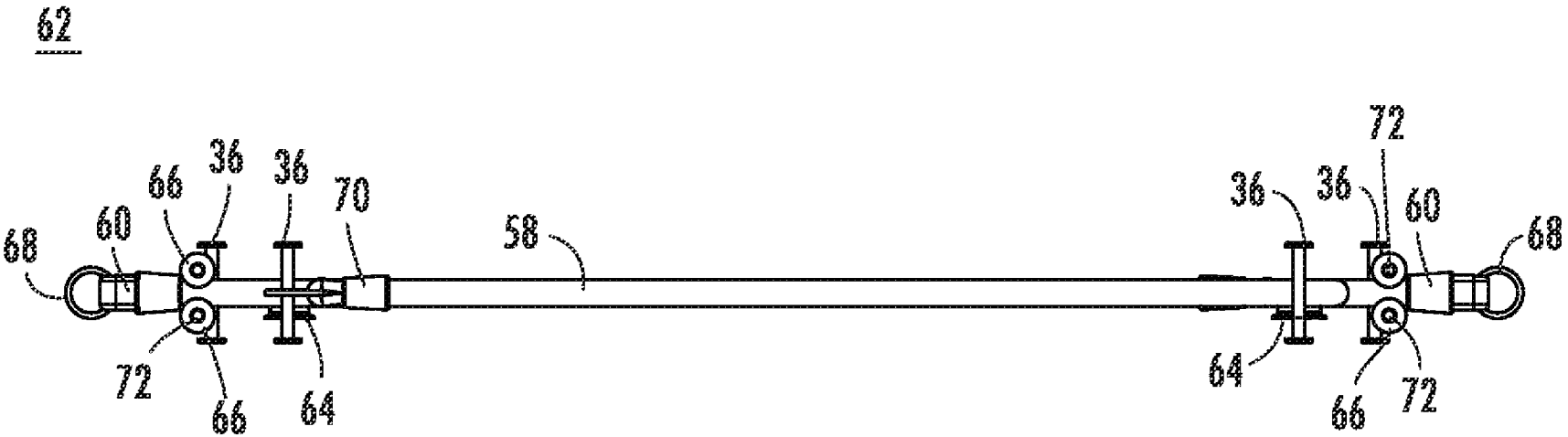
FIG. 13 is an elevational view of a rear of the resistance band assembly of FIG. 9.
Figure 14:
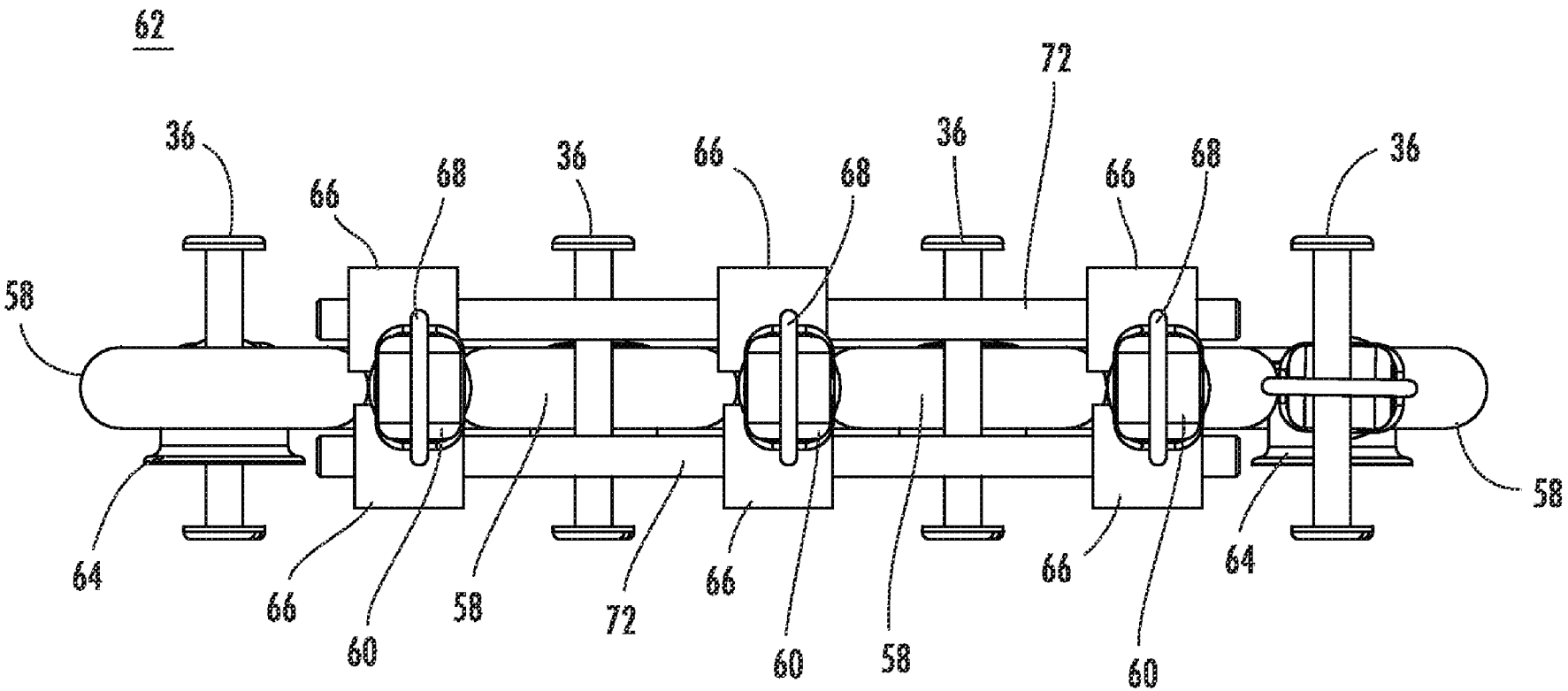
FIG. 14 is an elevational view of a side of the resistance band assembly of FIG. 9.
Figure 15:
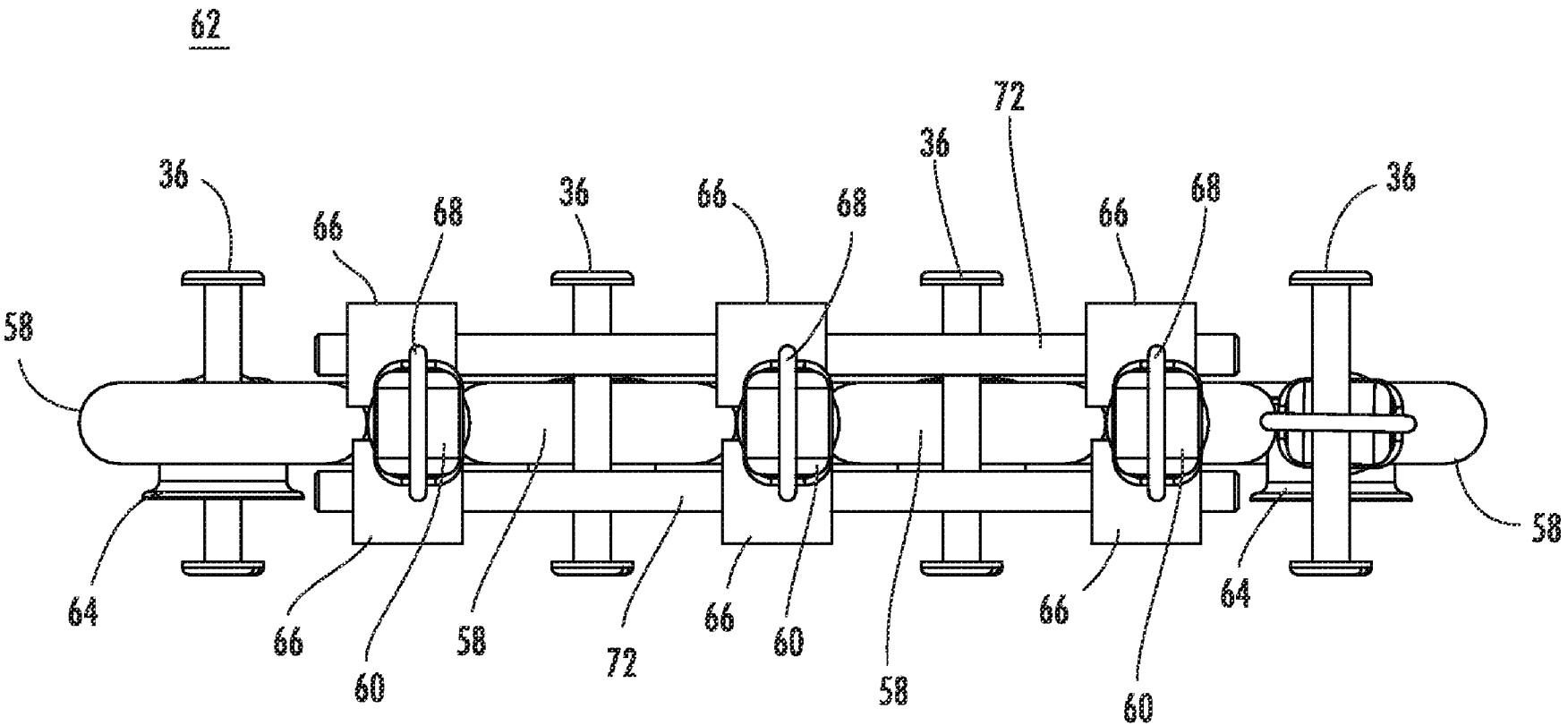
FIG. 15 is an elevational view of an opposite side of the resistance band assembly of FIG. 9.

As shown in FIG. 72, the user may lie on the platform 310 of the exercise device 300 with the user's feet in contact with the ground. The user may grasp a handle corresponding to one or more of the resistance bands 320 with both hands. The user may then position the handle behind the user's head. Then, the user may curl his or her torso upward, thereby lifting his or her shoulder blades off of the platform 310. The user may then lower his or her torso downward through the same motion in reverse.

Figure 73:
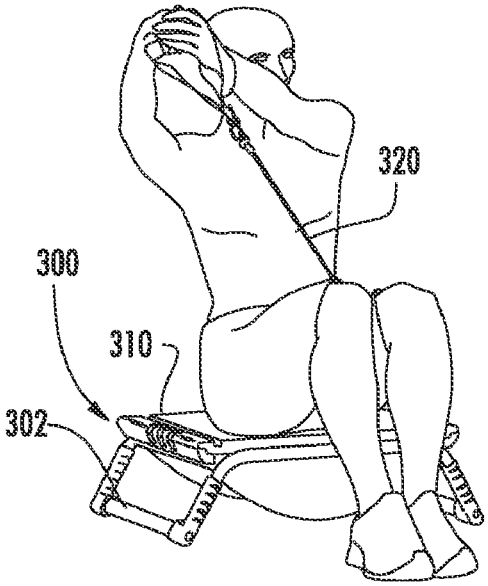
FIG. 73 depicts the exercise device of FIG. 45 in use, with the user sitting on the exercise device and extending one or more of the resistance bands.

As shown in FIG. 73, the user may sit on the platform 310 of the exercise device 300 and grasp a handle corresponding to one or more of the resistance bands 320 with both hands. The user may position the handle proximate the user's midsection, this position being defined as a starting position. Then, the user may twist his or her torso away from a side of the platform 310 associated with the one or more resistance bands 320 in use while keeping his or her elbows slightly bent. The user may then return through the same motion in reverse to the starting position.

Figure 75:
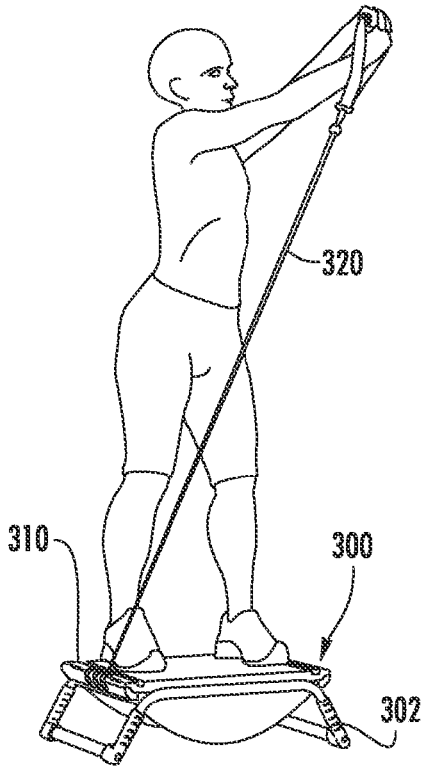

As shown in FIG. 75, the user may stand on the platform 310 of the exercise device 300 and grasp a handle corresponding to one or more of the resistance bands 320 with both hands. The user may stand on the platform 310 such that the distance between the user's feet is generally equal to the distance between the user's shoulders. The user may then bend his or her knees slightly and bend forward slightly at his or her hips. Then, the user may extend his or her arms down toward his or her feet. The user may then raise his or her arms upward and across the torso until the handle is above the user's shoulders. The user's arms may then be lowered downward through the same motion in reverse.

Figure 76:
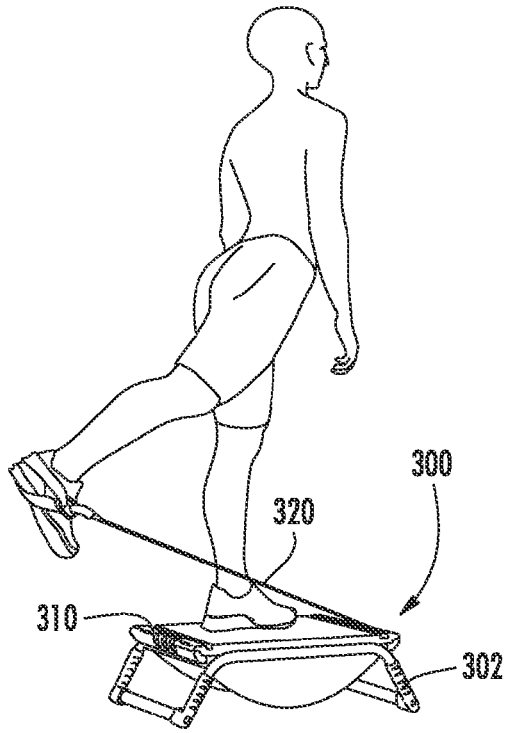
FIGS. 76-78 depict the exercise device of FIG. 52 in use, with the user standing on the exercise device and extending one or more of the resistance bands.

As shown in FIG. 76, the user may stand on the platform 310 of the exercise device 300 and secure a strap corresponding to one or more of the resistance bands 320 to the foot of a working leg. The user may then extend the working leg forward while keeping the knee generally straight. Additionally, the user may stand on the platform 310 of the exercise device 300 and secure a strap corresponding to one or more of the resistance bands 320 to the foot of a working leg. The user may then extend the working leg backward while keeping the knee generally straight.

Figure 78:
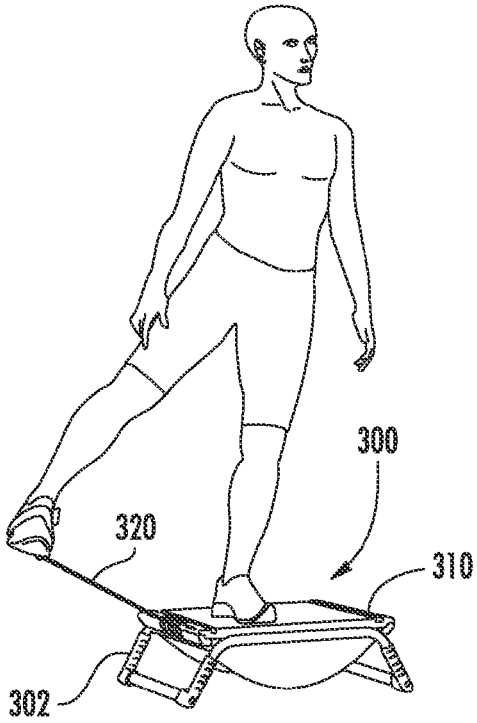
Figure 119:
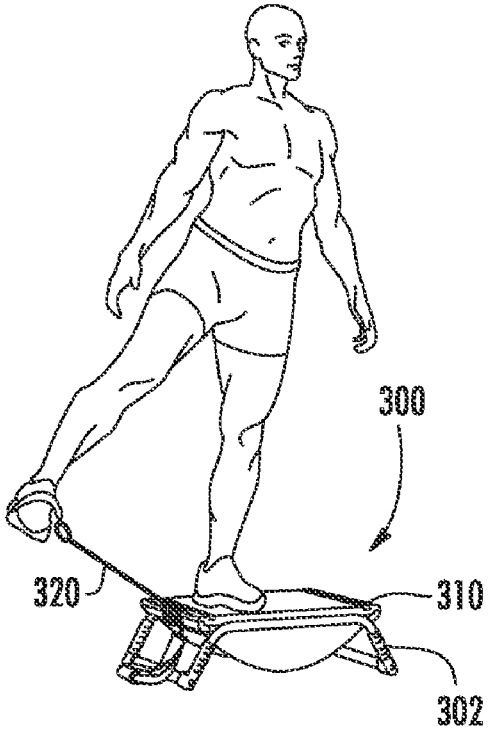
FIG. 119 depicts the exercise device of FIG. 52 in use, with the user standing on the exercise device and extending one or more of the resistance bands.
Figure 120:
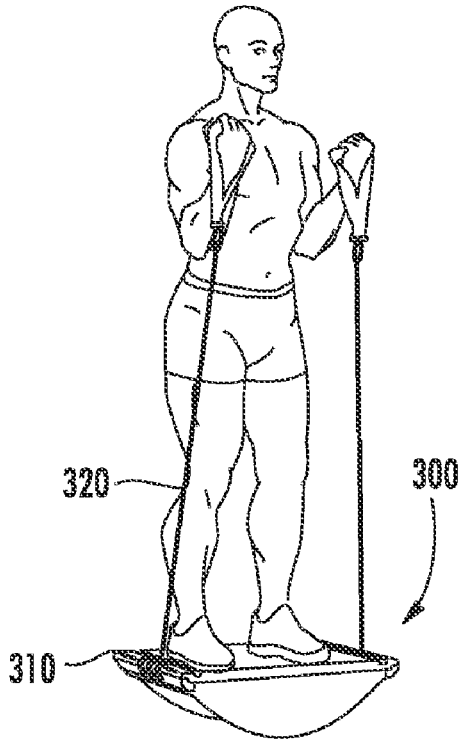
FIG. 120 depicts the platform of the exercise device of FIG. 51 in use, with the user standing on the platform and extending one or more of the resistance bands.

As shown in FIGS. 78 and 119, the user may stand on the platform 310 of the exercise device 300 and secure a strap corresponding to one or more of the resistance bands 320 to the foot of a working leg. The user may then raise the working leg outward while keeping the knee slightly bent. Additionally, the action may be reversed, where the strap is secured to the opposite leg of the user.

Figure 77:
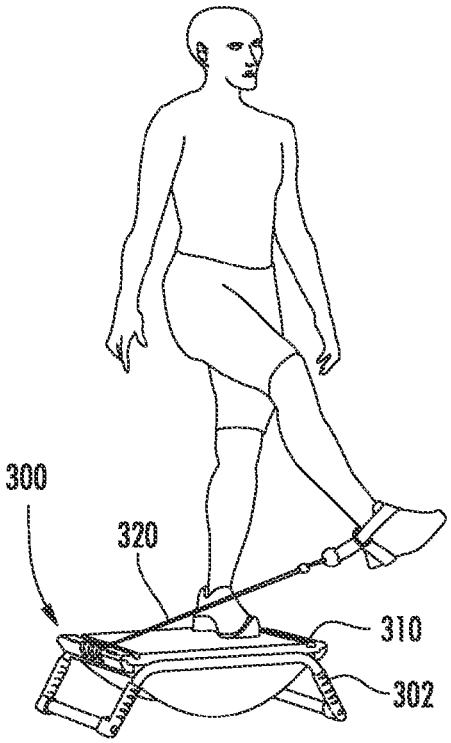

As shown in FIG. 77, the user may stand on the platform 310 of the exercise device 300 and secure a strap corresponding to one or more of the resistance bands 320 to the foot of a working leg. The user may then pull the working leg inward across a non-working leg while keeping the knee of the working leg slightly bent.

Figure 80:
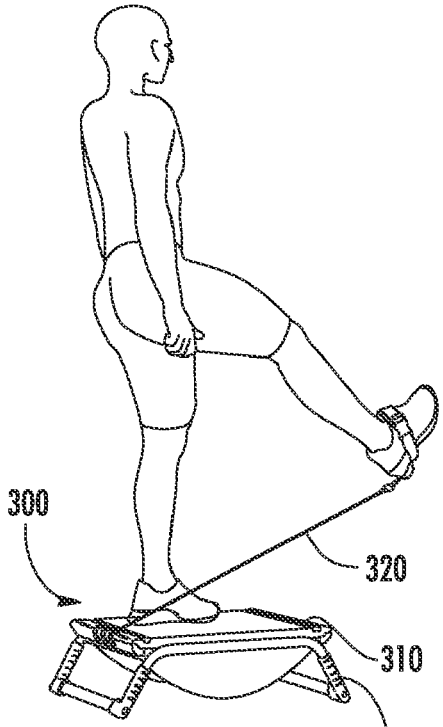
FIGS. 80-81 depict the exercise device of FIG. 52 in use, with the user standing on the exercise device and extending one or more of the resistance bands.

As shown in FIG. 80, the user may stand on the platform 310 of the exercise device 300 and secure a strap corresponding to one or more of the resistance bands 320 to the foot of a working leg. The user may raise the working leg upward until his or her thigh is generally parallel with the stepping deck of the platform 310 and his or her knee is bent at a generally 90° angle. The user may then extend the foot of the working leg forward by straightening the knee without moving the thigh of the working leg.

Figure 81:
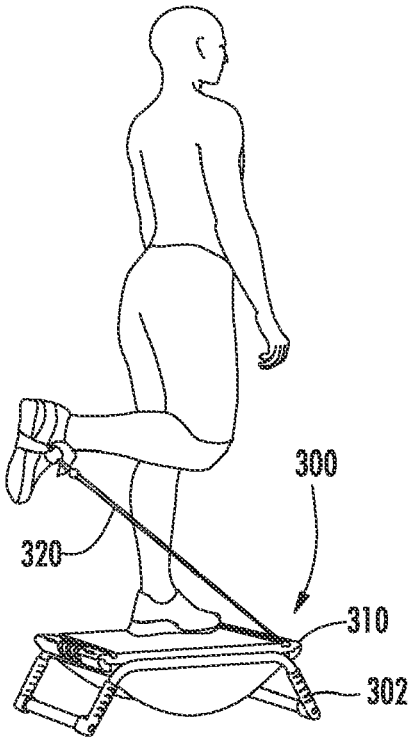

As shown in FIG. 81, the user may stand on the platform 310 of the exercise device 300 and secure a strap corresponding to one or more of the resistance bands 320 to the foot of a working leg. The user may bend the working leg behind the user's body at the knee while keeping the knee in line with the user's hip.

As shown in FIG. 123, the user may position the user's hands and knees on the platform 310 of the exercise device 300 and secure a strap corresponding to one or more of the resistance bands 320 to the foot of a working leg. The user may then extend the working leg back and up in one motion while simultaneously straightening the knee of the working leg.

Figure 85:
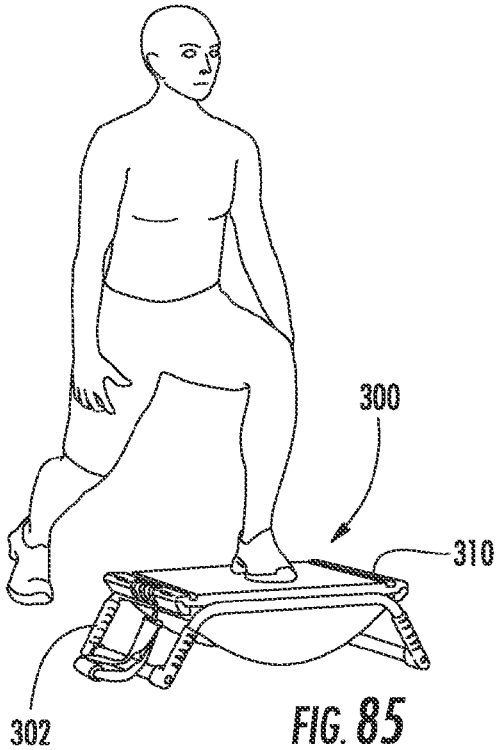
FIG. 85 depicts the exercise device of FIG. 45 in use, with the user placing one foot on the exercise device.
Figure 87:
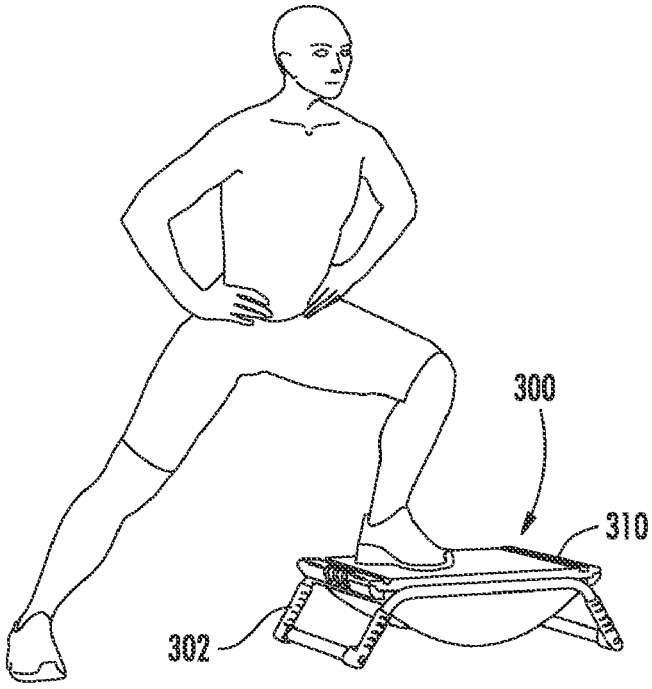
FIG. 87 depicts the exercise device of FIG. 40 in use, with the user placing one foot on the exercise device.
Figure 92:
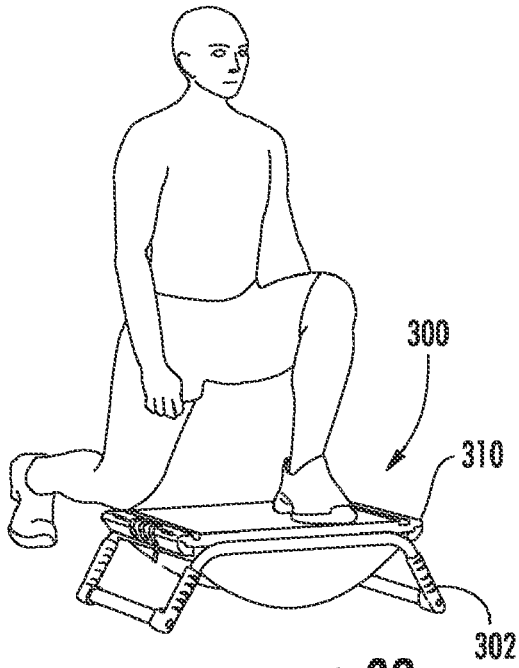
Figure 93:
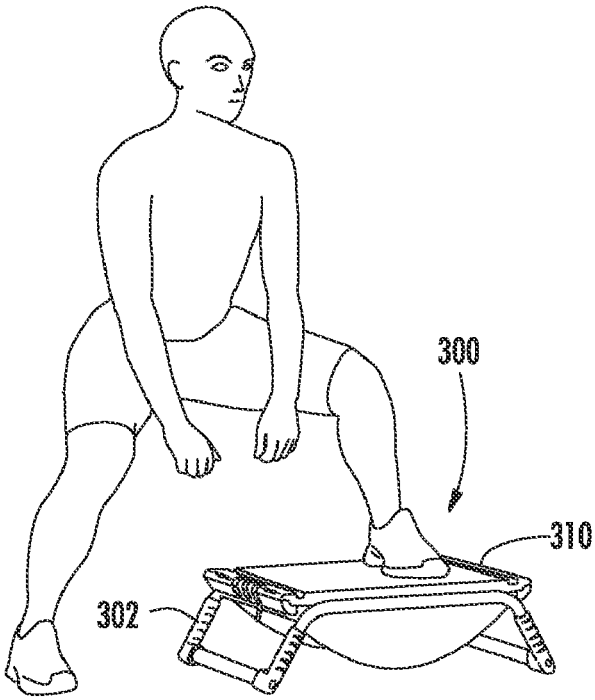

As will be understood, the exercise device 300 may also be used to exert muscles through exercises such as lunging, stepping, jumping, and hopping. FIG. 85 depicts a user performing a forward lunge exercise with a single leg. FIG. 87 depicts a user performing a lateral lunge exercise with a single leg. FIGS. 92 and 93 depict a user performing a reverse lunge exercise. As shown in FIG. 92, the user may begin in a standing position with both feet on the platform 310. The user may step back with one foot so that the foot is positioned flatly on the floor or ground, while bending the other knee to a generally 90° angle. The user then returns the foot back to the platform 310 and returns to a standing position. As shown in FIG. 93, a user may begin in a standing position with both feet on the platform 310. The user may step back with one foot so that the user's toes touch the floor or ground, while bending the other knee to a generally 90° angle. The user then returns the foot back to the platform 310 and returns to a standing position. In each lunging exercise, the user may repeat the exercise several times, or in combination with other exercises, as might be required for a particular workout.

Figure 88:
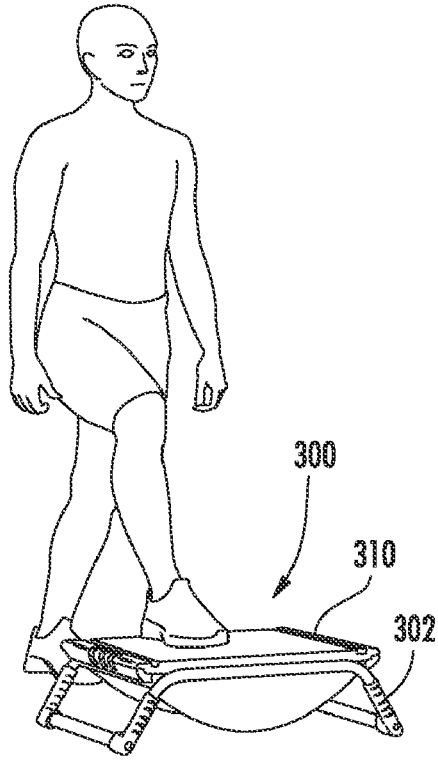
FIGS. 88-99 depict the exercise device of FIG. 40 in use, with the user stepping or jumping on and off of the exercise device.
Figure 89:
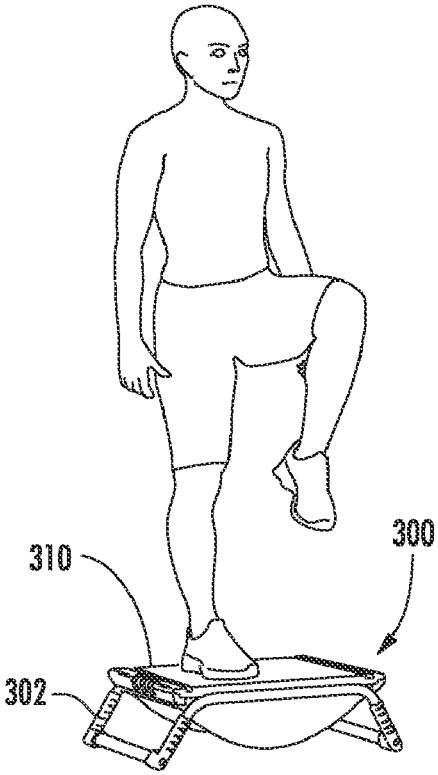
Figure 90:
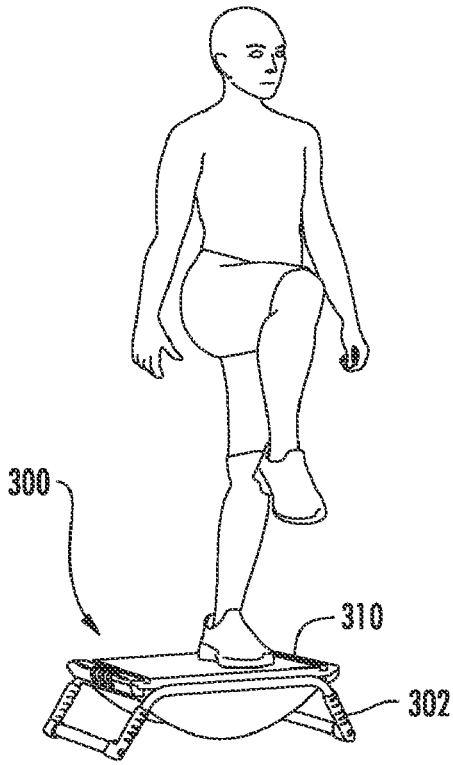
Figure 91:
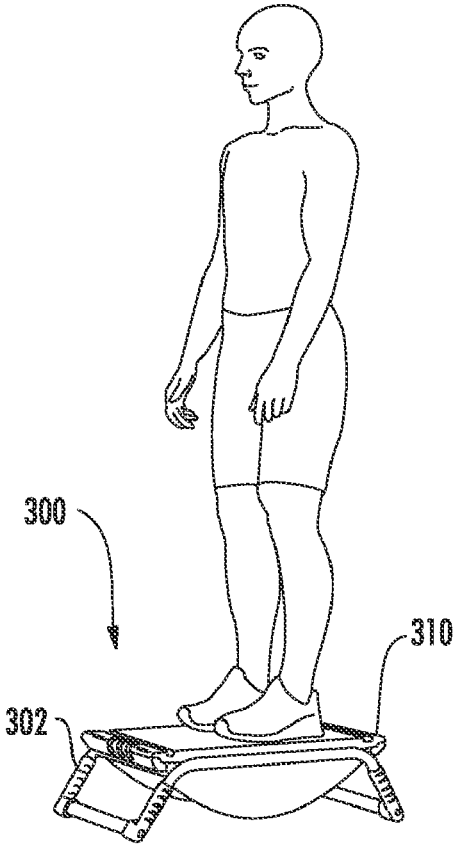

FIGS. 88-91 depict a user performing various step exercises with the exercise device 300. As shown in FIG. 88, a user may perform a basis step exercise, by stepping on and off of the platform 310 with one foot at a time. As shown in FIG. 89, a user may perform a step exercise, where the user raises his or her knee while stepping on and off of the platform 310 with one foot at a time. As shown in FIG. 90, a user may perform a step exercise while standing on the platform 310, where the user alternates between raising each knee while stepping. In exercises where the user raises his or her knee, the knee may be raised such that his or her thigh is generally parallel to the stepping deck of the platform 310 when the knee is bent. As shown in FIG. 91, a user may perform an "over the top" step exercise where the user steps onto and over the platform 310 one foot at a time. In particular, a user may position the first foot on the platform 310 followed by the second foot. Once standing on the platform 310, the user may then step off of the platform 310 on the opposite side thereof beginning with the first foot followed by the second foot. In each stepping exercise, the user may repeat the exercise several times, or in combination with other exercises, as might be required for a particular workout.

Figure 94:
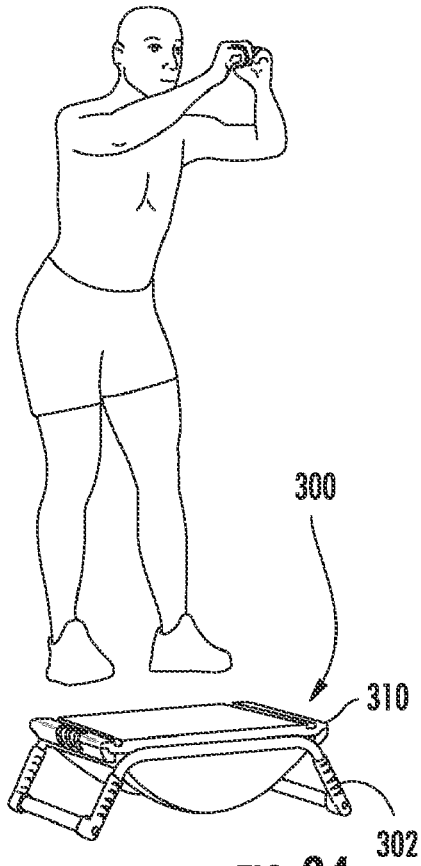
Figure 95:
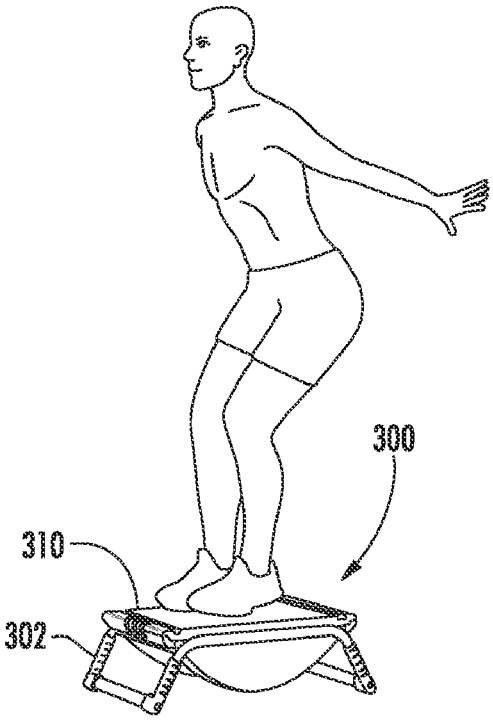
Figure 96:
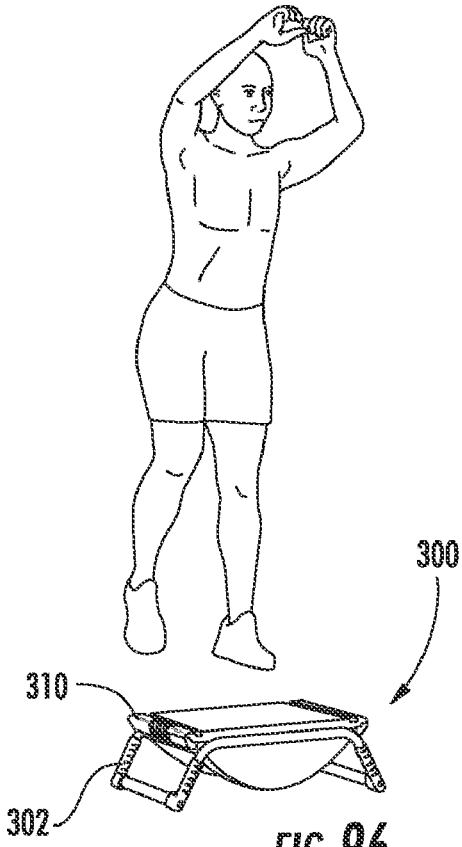
Figure 97:
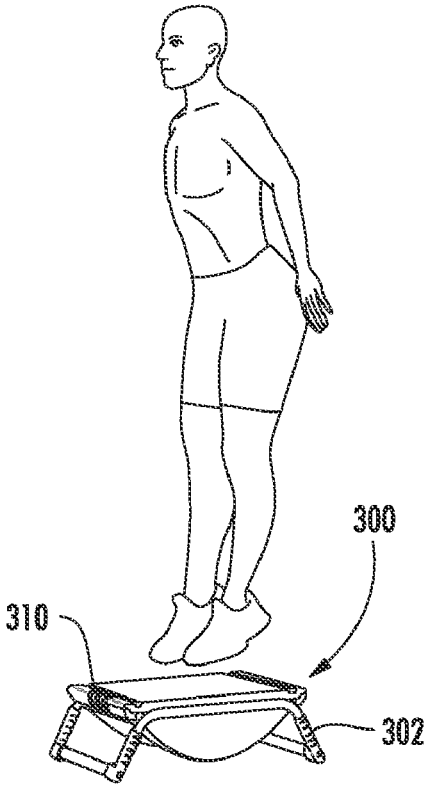
Figure 98:
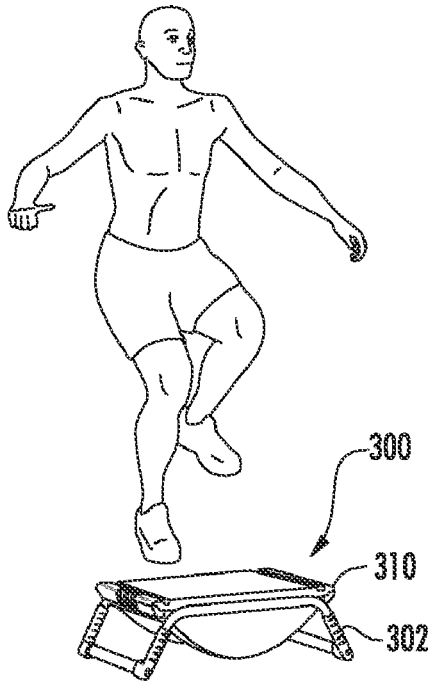
Figure 99:
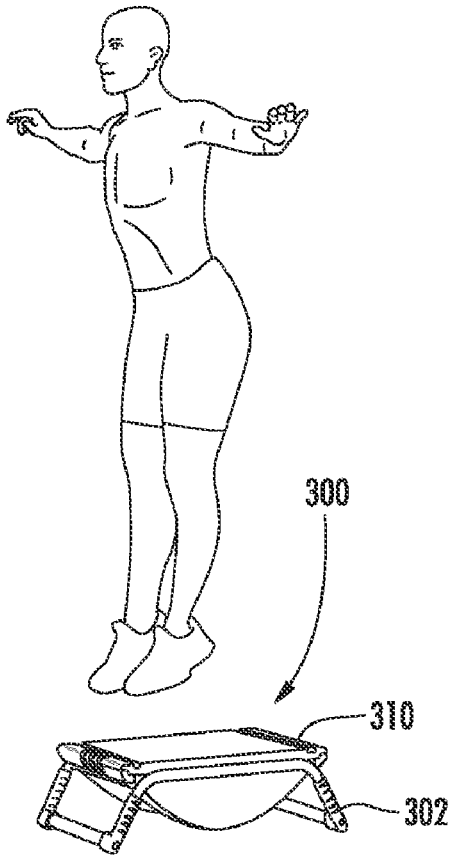

FIGS. 94-99 depict a user performing various jump exercises with the exercise device 300. FIG. 94 depicts a user performing a forward jump exercise onto the platform 310. FIG. 95 depicts a user performing a lateral jump exercise onto the platform 310. FIG. 98 depicts a user performing a single leg jump exercise, where the user may jump from the floor or ground and land on the platform 310 with a single leg. As shown in FIG. 96, a user may perform an exercise where the user begins with a first foot on the floor or ground and a second foot supported by the platform 310. The user may then quickly push off from the platform 310 and alternate the position of his or her feet during the jump so that the first foot is supported by the platform 310 and the second foot is on the floor or ground. As shown in FIG. 97, a user may perform an exercise where the user may stand at one side of the exercise device 300 with a first foot on the floor or ground and the second foot supported by the platform 310. The user may bounce quickly with the foot on the floor or ground before jumping. During the jump, the user may switch the position of his or her feet so that the first foot is supported by the platform 310 and the second foot is on the floor or ground at the other side of the exercise device 300. As shown in FIG. 99, a user may perform an exercise where the user stands with a first foot on the floor or ground and a second foot supported by the platform 310. The user may then jump and land with the first foot supported by the platform 310 and the second foot on the floor or ground. In each jumping exercise, the user may repeat the exercise several times, or in combination with other exercises, as might be required for a particular workout.

Advantageously, a broad range of exercises may be performed with either of a stable surface or an unstable surface. The exercises set forth above are described with a user using the exercise device 300 having a stable surface, where the platform 310 is supported by the frame 302. It should also be appreciated that each of the exercises set forth above may also be performed in connection with an unstable surface.

In this regard, the platform 310 may be separated from the frame 302 and placed on the floor or ground with the arched base 312 in contact with the floor or ground. As such, the user may then use the platform 310 of the exercise device 300 in order to provide an unstable surface that further enhances the versatility of the exercise device 300. For many of the exercises set forth above, performance by a user in connection with an unstable surface may also enhance the difficulty of the exercise and may increase the range of muscle groups that are engaged with each exercise.

The exercise device may also be used in connection with pushup exercises. To enhance pushup exercises with an unstable surface, the platform 310 may be separated from the exercise device 300 to create such an unstable surface. FIGS. 100-102, 105-111, and 121-122 depict a broad range of different push-up exercises that may be performed with the platform 310 or the frame 302.

Figure 100:
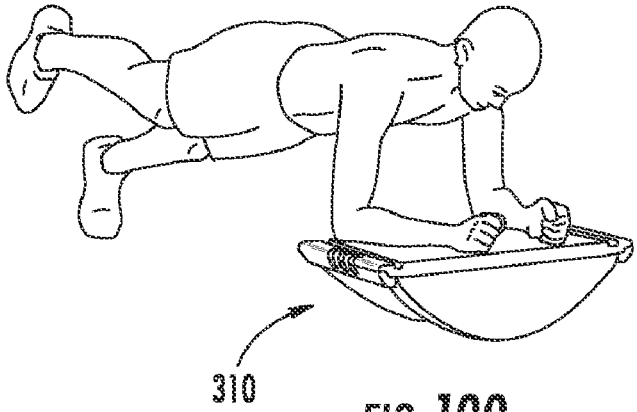
FIGS. 100-101 depict the platform of FIG. 46 in use, with the user placing his or her forearms on the platform.

As shown in FIG. 100, a user may position his or her elbows on the platform 310 and position his or feet on the floor or ground. The user may then raise his or her hips such that the user's feet, hips, and head are generally in a straight line. Additionally, a user may position his or her elbows on the platform 310. The user may position one foot on the floor or ground and the other foot in the air. The user may then raise his or her hips such that the user's feet, hips, and head are generally in a straight line.

Figure 101:
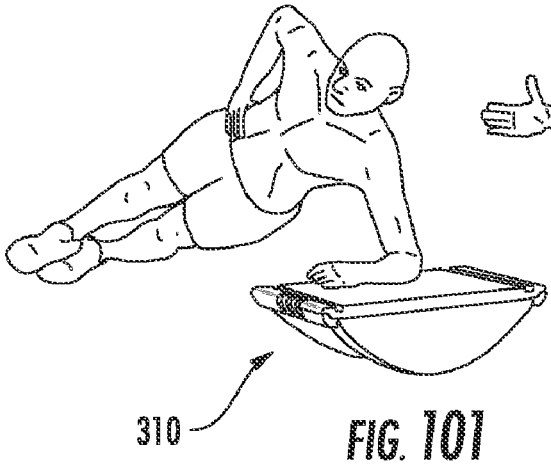

As shown in FIG. 101, a user may position one elbow on the platform 310 and place a side of one foot on the floor or ground. The user may then raise his or her hips such that the user's foot, hips, and head are generally in a straight line.

Figure 102:
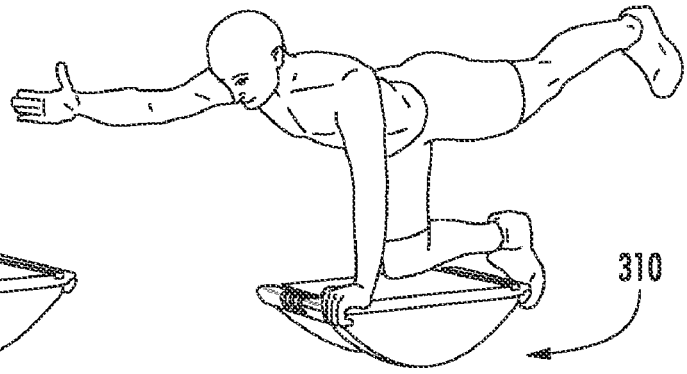
FIG. 102 depicts the platform of the exercise device of FIG. 46 in use, with the user placing his or her hands and knees on the platform.
Figure 103:
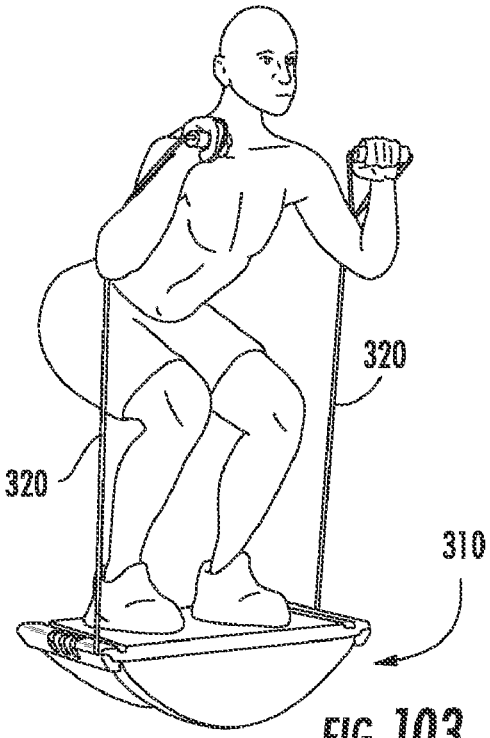
FIG. 103 depicts the platform of the exercise device of FIG. 51 in use, with the user standing on the platform and extending one or more of the resistance bands.

As shown in FIG. 102, a user may position a knee, hand, and foot on the platform 310. The user may then extend the other arm outward in front of his or her body and the other leg outward behind his or her body.

Figure 105:
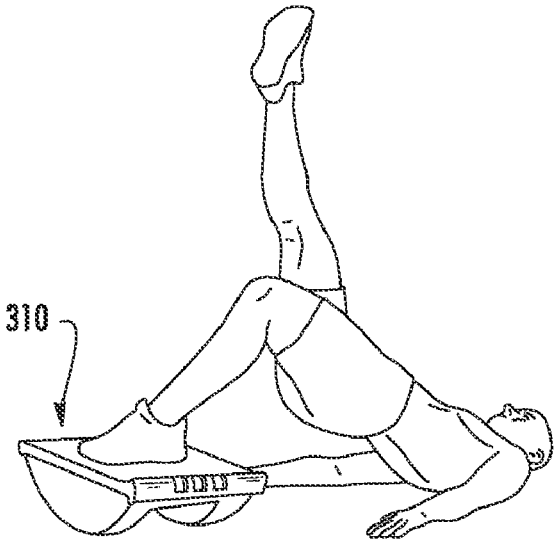
FIG. 105 depicts the platform of the exercise device of FIG. 46 in use, with the user lying down and placing one foot on the platform.

As shown in FIG. 105, a user may position a portion of his or her upper back against the floor or ground. The user may then position one foot on the platform 310 with the knee being bent. Then, the user may position the other foot in the air with the knee being generally straight. The user may then press his or her hips upward.

Figure 106:
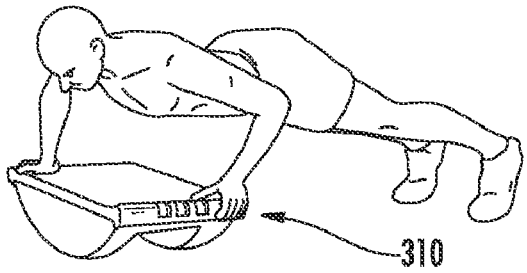
FIGS. 106-107 depicts the platform of the exercise device of FIG. 46 in use, with the user grasping the ends of the platform with his or her hands.

As shown in FIG. 106, a user may position one hand generally more forward on the platform 310 and position the other hand generally more backward on the platform 310. The user may then perform a pushup exercise.

Figure 107:
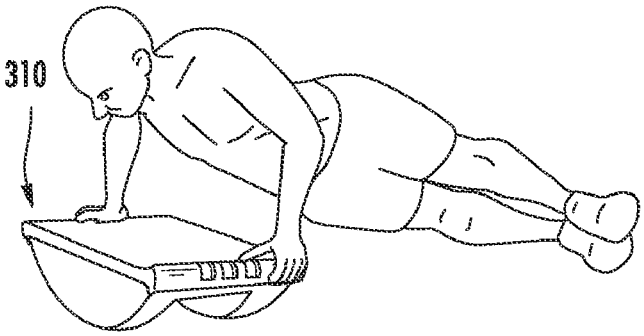

As shown in FIG. 107, a user may position both hands on the platform 310. The user may then perform an oblique pushup exercise, where the user's feet are positioned side by side behind the user's body and against the surface of the floor or ground.

Figure 108:
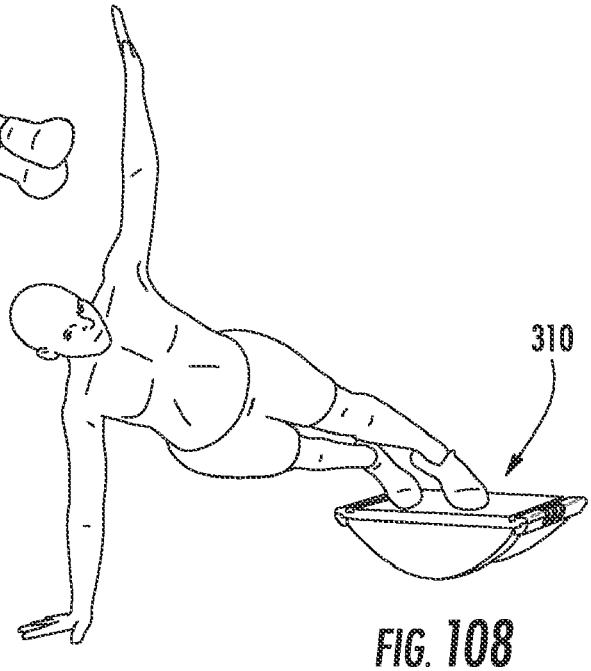
FIGS. 108-111 depict the platform of the exercise device of FIG. 46 in use, with the user placing his or her hands on the surface supporting the platform and placing his or her feet on the platform.

As shown in FIG. 108, a user may position both feet on the platform 310 and position both hands on the surface of the floor or ground. The user may then perform a "T" pushup exercise, where the user raises one arm off of the floor or ground and rotates his or her body until the arm creates a straight line overhead with the user's body.

Figure 109:
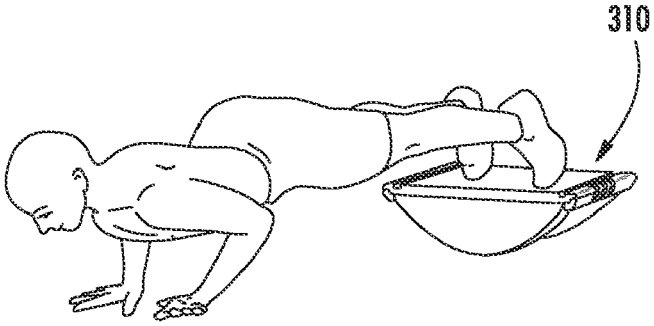

As shown in FIG. 109, a user may position both feet on the platform 310 and position both hands close together on the surface of the ground. The user may then perform a close-handed pushup exercise, where the user lowers his or her body to the floor or ground while his or her hands are positioned close together.

Figure 110:
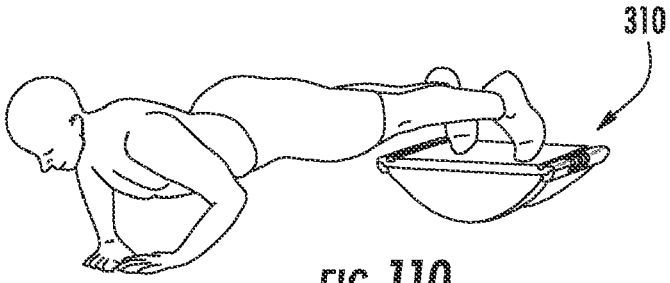

As shown in FIG. 110, a user may position both feet on the platform 310 and position both hands on the floor or ground such that the digits of each hand form a diamond shape when positioned together. The user may then perform a pushup exercise, where the user lowers his or her body to the floor or ground while his or her hands are positioned to form the diamond shape.

Figure 111:
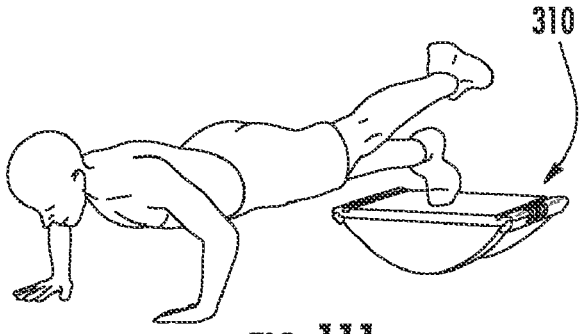
Figure 112:
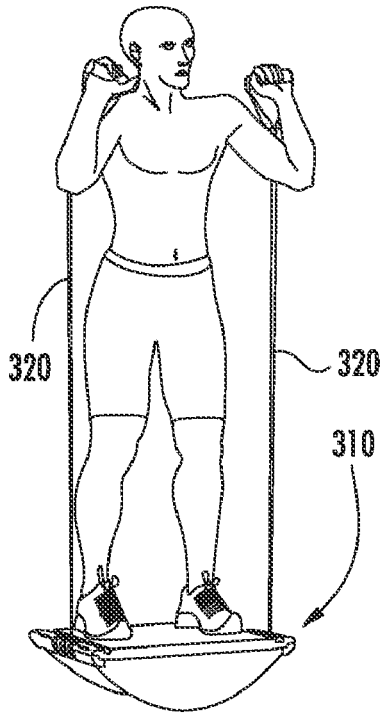
FIGS. 112-113 depict the platform of the exercise device of FIG. 51 in use, with the user standing on the platform and extending one or more of the resistance bands.

As shown in FIG. 111, a user may position one foot on the platform 310 and the other foot in the air with both hands on the floor or ground. The user may then perform a pushup exercise.

Figure 121:
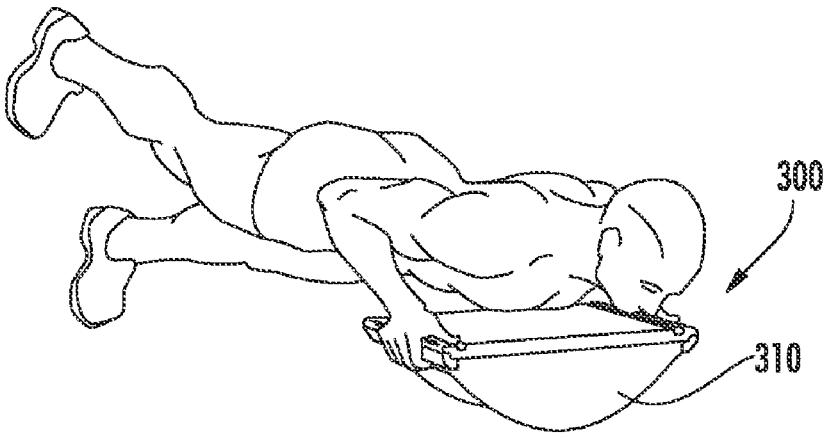
FIG. 121 depicts the platform of the exercise device of FIG. 46 in use, with the user grasping the ends of the platform with his or her hands.

As shown in FIG. 121, a user may position both hands on the platform 310 and place one foot on the floor or ground and the other foot in the air. The user may then perform a pushup exercise.

Figure 122:
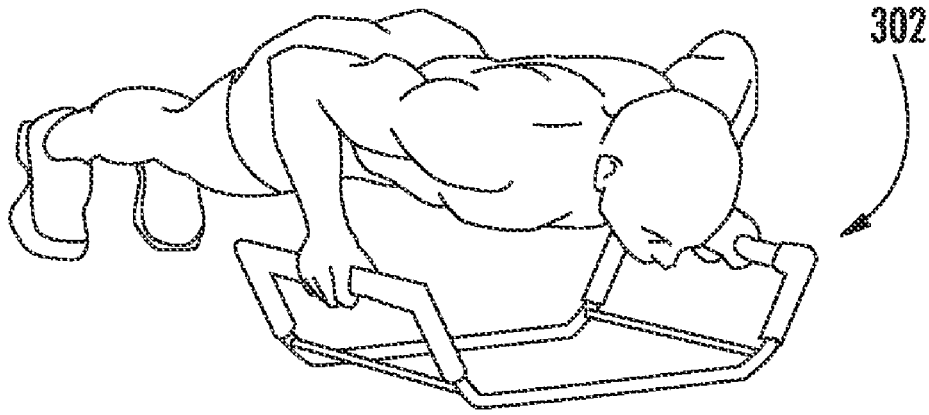
FIG. 122 depicts the frame of the exercise device of FIG. 40 in use, with the frame positioned upside-down and the user grasping the ends of the frame with his or her hands.

In each pushup exercise, the user may repeat the exercise several times, or in combination with other exercises, as might be required for a particular workout. Additionally, as can be appreciated, a user may also prefer to have a stable surface for use in connection with any of the pushup exercises set forth above. In this regard, the user may choose to attach the platform 310 to the frame 302 in order to provide such a stable surface. Alternatively, the user may choose to use the frame 302 alone for use in providing a stable surface for pushup exercises and other exercises. For example, FIG. 122 depicts a user performing a pushup exercise using the frame 302. In particular, in one contemplated pushup exercise, a user may position his or her hands at either end of the frame 302 and position his or her feet on the floor or ground. In accordance with another contemplated pushup exercise, the user may position his or her hands at either end of the frame 302 and position one foot on the floor or ground and the other foot in the air.

The various exercises set forth above may be performed in connection with a stable surface, as provided by the exercise device 300 or the frame 302, or with an unstable surface, as provided by the platform 310. Some exercises, discussed in greater detail below, are contemplated as providing a particular advantage to users when performed in connection with an unstable surface.

Figure 104:
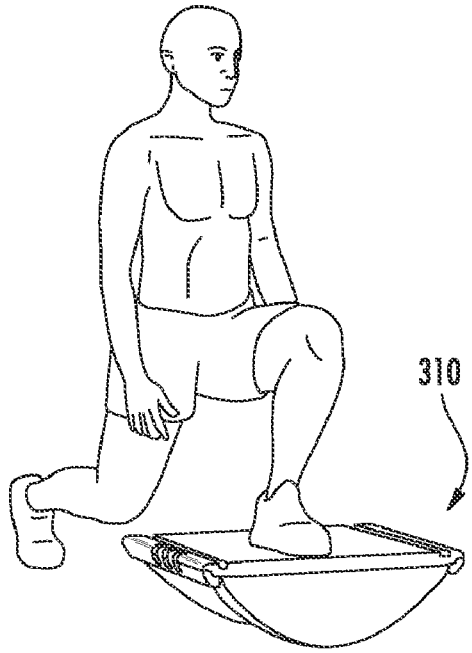
FIG. 104 depicts the platform of the exercise device of FIG. 46 in use, with the user placing one foot on the platform.

As shown in FIG. 104, a user may perform a single leg forward lunge using the platform 310 as an unstable surface. A user may stand with both feet on the floor or ground adjacent to the platform 310. The user may then lunge with one foot forward and place the foot on top of the platform 310. The user may bend his or her knee to about a 90° angle before pushing off to return to a standing position adjacent the platform 310.

FIGS. 103, 112, 117-118, and 120 depict various exercises that use the platform 310 as an unstable surface. In each exercise, the user stands on the platform 310 and may grasp handles corresponding to one or more of the resistance bands 320. The user may retain the handles at shoulder height with his or her elbows bent or at the sides of his or her body. In this position, the user may turn the palms of his or her hands to face outward. The user may then bend his or knees to about a 90° angle. As the user returns to a standing position, the user may curl or pull the handles such that each is raised approximately at shoulder height (as perhaps best shown in FIGS. 112 and 120). The user may then repeat the exercise. Additionally, the user may incorporate additional steps to the exercise or replace some of the steps with alternate steps. According to one step, the user may continue to raise the handles such that each handle is extended over the user's head. According to another step, the user may extend the handles outwardly away from his or her body in a lateral direction (as perhaps best shown in FIG. 118).

The exercises as set forth above may be repeated or combined with one another in order to develop a workout routine as might be preferred.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An exercise apparatus having a combination of exercise configurations, comprising:

(a) a platform including (i) a stepping deck for receiving a user, (ii) an rigid arched base for rocking support of the stepping deck on a workout surface, and (iii) a resistance band assembly housed within the platform, the resistance band assembly including a plurality of resistance bands and pulleys; and (b) a frame, said platform removably seated within said frame; said frame configured to allow the platform to be supported by the frame above a workout surface;

(c) wherein the exercise apparatus combination of exercise configurations is transitionable between:

(i) a first state in which the platform is removably seated within the frame for use in exercises in a stable position, and (ii) a second state in which the platform is separated from the frame for use in exercises in an unstable position.

2. The exercise apparatus of claim 1, wherein the frame includes a pair of side rails, a pair of connection bars that extend between and connect ends of the side rails, and a pair of support cross bars that extend between and connect the side rails.

3. The exercise apparatus of claim 2, wherein the platform includes groove within which the connection bars are received in a snap-fit frictional fit.

4. The exercise apparatus of claim 1, wherein the platform is further configured to receive the frame in an inverted orientation such that the arched base supports both the stepping deck and the frame on the workout surface.

5. The exercise apparatus of claim 4, wherein the frame includes a pair of side rails, a pair of connection bars that extend between and connect ends of the side rails, and a pair of support cross bars that extend between and connect the side rails.

6. The exercise apparatus of claim 5, wherein the platform includes a pair of grooves on opposite sides thereof that are configured to receive the connection bars of the frame in a snap-fit frictional fit.

7. The exercise apparatus of claim 5, wherein the connection bars include handle grips.

8. The exercise apparatus of claim 1, wherein the resistance band assembly includes a plurality of pulleys located within the platform, each of the resistance bands extending around one of the plurality of pulleys.

9. The exercise apparatus of claim 1, wherein the platform has a length extending between opposite ends thereof that is longer than a width extending between opposite sides thereof, and wherein an end of each of the plurality of resistance bands is exposed at one of the opposite ends of the platform for access by a user.

10. The exercise apparatus of claim 9, wherein the platform includes a plurality of openings at each opposite end thereof, and wherein a respective end of one of the plurality of resistance bands extends through a respective one of the plurality of openings.

11. The exercise apparatus of claim 10, further comprising a plurality of rollers located at the openings for engaging the resistance bands.

12. The exercise apparatus of claim 11, wherein the plurality of rollers includes a horizontal roller located at each opening for engaging a respective one of the resistance bands.

13. The exercise apparatus of claim 11, wherein the plurality of rollers includes two vertical rollers located at each opening for engaging a respective one of the resistance bands.

14. The exercise apparatus of claim 11, wherein the plurality of rollers includes a horizontal roller and two vertical rollers located at each opening for engaging a respective one of the resistance bands.

15. The exercise apparatus of claim 9, wherein each resistance band has an end thereof anchored within the platform at one of the opposite ends of the platform.

16. The exercise apparatus of claim 15, wherein the anchored end and the exposed end of each respective resistance band are both located at the same end of the platform.

17. The exercise apparatus of claim 9, further comprising a user interface removably attached to one or more of the exposed ends of the resistance bands.

18. The exercise apparatus of claim 17, wherein the user interface is a handle.

19. The exercise apparatus of claim 1, wherein the plurality of resistance bands have varying resistance levels.

20. The exercise apparatus of claim 19, wherein the platform includes indicia indicating the resistance levels of the resistance bands.

21. The exercise apparatus of claim 1, wherein the stepping deck includes resilient characteristics such that the impact experienced by a user in stepping onto the platform is lessened.

22. The exercise apparatus of claim 1, wherein at least a portion of the frame is encased in a non-slip covering for gripping contact.

23. The exercise apparatus of claim 1, further comprising non-slip material located on a bottom surface of the arched base.

* * * * *